US006316157B1

(12) United States Patent
Yoshikawa et al.

(10) Patent No.: US 6,316,157 B1
(45) Date of Patent: Nov. 13, 2001

(54) TONER AND IMAGE FORMING METHOD

(75) Inventors: Junko Yoshikawa, Numazu; Kenji Okado; Masaaki Taya, both of Mishima; Yushi Mikuriya, Numazu; Kazumi Yoshizaki, Mishima; Yasushi Katsuta; Kenichi Nakayama, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/610,914

(22) Filed: Jul. 5, 2000

(30) Foreign Application Priority Data

| | | |
|---|---|---|
| Jul. 5, 1999 | (JP) | 11-190062 |
| Aug. 31, 1999 | (JP) | 11-244742 |
| May 31, 2000 | (JP) | 12-161883 |

(51) Int. Cl.[7] ..... G03G 9/097
(52) U.S. Cl. ..... 430/110; 430/126
(58) Field of Search ..... 430/45, 106, 109, 430/126, 110

(56) References Cited

U.S. PATENT DOCUMENTS

| | | | | |
|---|---|---|---|---|
| 4,540,646 | * | 9/1985 | Karabara et al. | 430/106.6 |
| 4,904,560 | | 2/1990 | Yamashiro et al. | 430/137 |
| 5,856,055 | | 1/1999 | Ugai et al. | 430/106 |
| 6,013,402 | | 1/2000 | Kanbayashi et al. | 430/45 |
| 6,030,737 | | 2/2000 | Ugai et al. | 430/106 |
| 6,187,490 | * | 2/2001 | Taya et al. | 430/45 |

FOREIGN PATENT DOCUMENTS

| | | |
|---|---|---|
| 36-10231 | 7/1961 | (JP) . |
| 43-10799 | 5/1968 | (JP) . |
| 56-116044 | 9/1981 | (JP) . |
| 63-210849 | 9/1988 | (JP) . |
| 298388 | 1/1989 | (JP) . |
| 1035457 | 2/1989 | (JP) . |
| 1-145664 | 6/1989 | (JP) . |
| 7-64337 | 3/1995 | (JP) . |
| 10-186713 | 7/1998 | (JP) . |

OTHER PUBLICATIONS

Database WP1, Sec. Ch, wk. 199104, Derwent, AN1991–024954, XP002147991 for JP02–293858.
Database WPI, Sec. Ch, wk. 199851, Derwent, AN 1998–598932, XP002147992 for JP 10–268548.
Database WPI, Sec. Ch, wk. 199836, Derwent, AN1998–418138, XP002147993 for JP 10–171163.
Database WPI, Sec. Ch, wk. 1992 33, Derwent, AN1992–273177, XP002147994 for JP 04–186373.
Patent Abstracts of Japan, vol. 018, No. 405, Jul. 1994 for JP 06–118705.

* cited by examiner

*Primary Examiner*—John Goodrow
(74) *Attorney, Agent, or Firm*—Fitzpatrick, Cella, Harper & Scinto

(57) ABSTRACT

A non-metallic black toner is disclosed. The toner has toner particles containing at least a binder resin, a carbon black and an organometallic compound, and an external additive. The toner particles contain 10 to 200 ppm of at least one kind of alkali metal element and at least one kind of organometallic compound. The toner particles further contain a polyester resin. The non-metallic black toner has a weight-average particle diameter of 4 to 11 $\mu$m, the following loss tangents tan $\delta$ shown by dielectric loss factor $\in''$/dielectric constant $\in'$ at frequencies of $5\times10^4$ Hz and $10^5$ Hz:

$$\tan\delta\ (5\times10^4\ \text{Hz}) \leqq 0.0125$$

$$\tan\delta\ (10^5\ \text{Hz}) \leqq 0.0105,$$

a Carr's flowability index of 50 or more, and a Carr's floodability index of 65 or more. Also, an image forming method is disclose using the black toner.

31 Claims, 8 Drawing Sheets

TONER AND IMAGE FORMING METHOD

BACKGROUND OF THE INVENTION

Field of the Invention

Related Background Art

The present invention relates to non-metallic black toner used for electrophotography and an image forming method using the toner.

A developer using an electrophotographic process has been manufactured so far in accordance with the so-called pulverization method of adding a coloring agent, a charge control agent, and moreover a wax component to a binder resin such as a polyester resin, styrene-acrylic resin, or epoxy resin and melting, kneading, and uniformly dispersing them, thereafter pulverizing them into a predetermined particle size, and moreover removing excessive fine powder and coarse powder from them by a classifier.

Moreover, toner-particle manufacturing methods in accordance with the suspension polymerization method are disclosed in Japanese Patent Publication Nos. 36-10231, 43-10799, and 51-14895. The suspension polymerization method is a method of obtaining toner particles having a desired particle diameter by uniformly dissolving or dispersing polymerizable monomer, coloring agent, and polymerization initiator, and moreover cross-linking agent, charge control agent, and other additives according to necessity and thereby preparing a monomer composition and thereafter, dispersing the monomer composition in a continuous phase containing a dispersion stabilizer such as an aqueous phase by a proper agitator and polymerizing it.

This method does not include the pulverizing step and therefore, it is unnecessary to give brittleness to toner particles and moreover, this method uses a large quantity of low-softening-point material that has hardly been used by a conventional crushing method. Therefore, the material selection width is increased. Moreover, a wax component or coloring agent that is a hydrophobic material is not easily exposed to the surface of a toner particle. Therefore, this method has a feature that a toner carrying member, a photosensitive member, a transfer roller, and a fixing unit are not easily contaminated and it is recently noticed.

Moreover, digital full-color copying machines and full-color printers have been practically used so far and thereby, it has been necessary to further improve such characteristics as the image fidelity and color reproducibility of a toners. In the case of a digital full-color copying machine and a full-color printer, a plurality of toners are superposed and an image is formed. Therefore, requests for the toner fixing property and color reproducibility are increasingly raised. Polyester resin is preferably used as a binder resin for toner for meeting these requests.

However, polyester resin is easily influenced by moisture at a high humidity because it has a hydroxyl value and toner containing polyester resin easily causes a charged quantity to decrease at a high humidity.

Moreover, in manufacturing toner in accordance with the pulverization method and polymerization method, many problems occur when using carbon black as a coloring agent.

First, carbon black has a small primary particle diameter and a large specific surface area compared to other pigments. Therefore, carbon black is hardly dispersed or maldistributed on the surface of a toner particle and easily produces free carbon black. Because carbon black is fine powder having a high stickiness, presence of free carbon black causes the flowabllity of toner to deteriorate and prevents preferable frictional electrification, and particularly deteriorates the reproducibility of a half-tone image. Moreover, when carbon black is not completely dispersed, a problem also occurs that a sufficient image density is not obtained.

Secondly, electric charges of carbon black easily leak when the carbon black is present on the surface of toner because the carbon black has conductivity. Therefore, when forming an image by using the toner, fog, toner scatter, or transfer skip occurs.

Moreover, when manufacturing toner in accordance with the polymerization method, carbon black has a functional group for preventing polymerization of a polymerizable monomer such as a quinone group on its surface. Therefore, the polymerization rate lowers, the polymerization degree does not rise, particles become unstable when they are formed, cohesion or coalescence is caused, and it is difficult to take out the carbon black as particles.

To solve the above problems, Japanese Patent Application Laid-Open No. 56-116044 discloses a method of using carbon black whose surface is grafted and Japanese Patent Application Laid-Open No. 63-210849 discloses a method of using carbon black whose surface is treated by an aluminum coupling agent. However, it is industrially difficult to use these methods because the step of treating the surface of carbon black is complex and takes a lot of time, and requires a lot of manufacturing cost.

Though Japanese Patent Application Laid-Open Nos. 64-35457 and 1-145664 are applications relating to improvement of dispersibility of carbon black, it cannot be said yet that the dispersibility is not completely solved.

Moreover, Japanese Patent Application Laid-Open Nos. 7-64337 and 10-186713 disclose the improvement of dispersibility of carbon black and electrification property of toner by combining carbon black having a specific solid-state property with an azo-based iron compound having a specific structure. For example, the method disclosed in Japanese Patent Application Laid-Open No. 10-186713 is a superior method for obtaining toner having a high tinting strength and a stable electrification property but it has a slight problem on solid image uniformity and durability under a high-humidity environment.

SUMMARY OF THE INVENTION

It is an object of the present invention to provide a non-metallic black toner solving the above problems and an image forming method using the toner.

It is another object of the present invention to provide a non-metallic black toner having a high tinting strength and an image forming method using the toner.

It is still another object of the present invention to provide non-metallic black toner in which quick electrification is performed in any environment and which has a preferable electrified quantity and an image forming method using the toner.

It is still another object of the present invention to provide non-metallic black toner having a small weight-average particle diameter and a sharp particle size distribution and an image forming method using the toner.

It is still another object of the present invention to provide non-metallic black toner having the above superior characteristics independently of the pulverization method or polymerization method and an image forming method using the toner.

An object of the present invention is to provide a non-metallic black toner comprising toner particles containing at least a binder resin, a carbon black and an organometallic compound, and an external additive, wherein:

the toner particles contain 10 to 200 ppm of at least one kind of alkali metal element;

the toner particles contain at least one kind of organometallic compound selected from organoiron compounds, organoaluminum compounds, organochromium compounds, organozinc compounds, organoboron compounds, and organozirconium compounds;

the toner particles contain a polyester resin as a resin component; and the non-metallic black toner has a weight-average particle diameter of 4 to 11 $\mu$m, the following loss tangents tan δ shown by dielectric loss factor ∈"/dielectric constant ∈' at frequencies of $5\times10^4$ Hz and $10^5$ Hz:

$$\tan\delta\ (5\times10^4\ \text{Hz})\leqq0.0125$$

$$\tan\delta\ (10^5\ \text{Hz})\leqq0.0105,$$

a Carr's flowability index of 50 or more, and a Carr's floodability index of 65 or more.

Another object of the present invention is to provide an image forming method comprising:

a development stop of developing an electrostatic latent image held by a latent image holding member with a non-metallic black toner to form a toner image;

a transfer step of transferring the toner image formed on the latent image holding member onto a recording material through or not through an intermediate transfer member; and a fixing step of fixing the toner image transferred onto the recording material, wherein:

the non-metallic black toner comprises toner particles containing at least a binder resin, a carbon black and an organometallic compound, and an external additive;

the toner particles contain 10 to 200 ppm of at least one kind of alkali metal element;

the toner particles contain at least one kind of organometallic compound selected from organoiron compounds, organoaluminum compounds, organochromium compounds, organozinc compounds, organoboron compounds, and organozirconium compounds;

the toner particles contain a polyester resin as a resin component; and the non-metallic black toner has a weight-average particle diameter of 4 to 11 $\mu$m, the following loss tangents tan δ shown by dielectric loss factor ∈"/dielectric constant ∈' at frequencies of $5\times10^4$ Hz and 10 Hz:

$$\tan\delta\ (5\times10^4\ \text{Hz})\leqq0.0125$$

$$\tan\delta\ (10^5\ \text{Hz})\leqq0.0105,$$

a Carr's flowability index of 50 or more, and a Carr's floodability index of 65 or more.

DETAILED DESCRIPTION OF THE INVENTION

Figure 1:
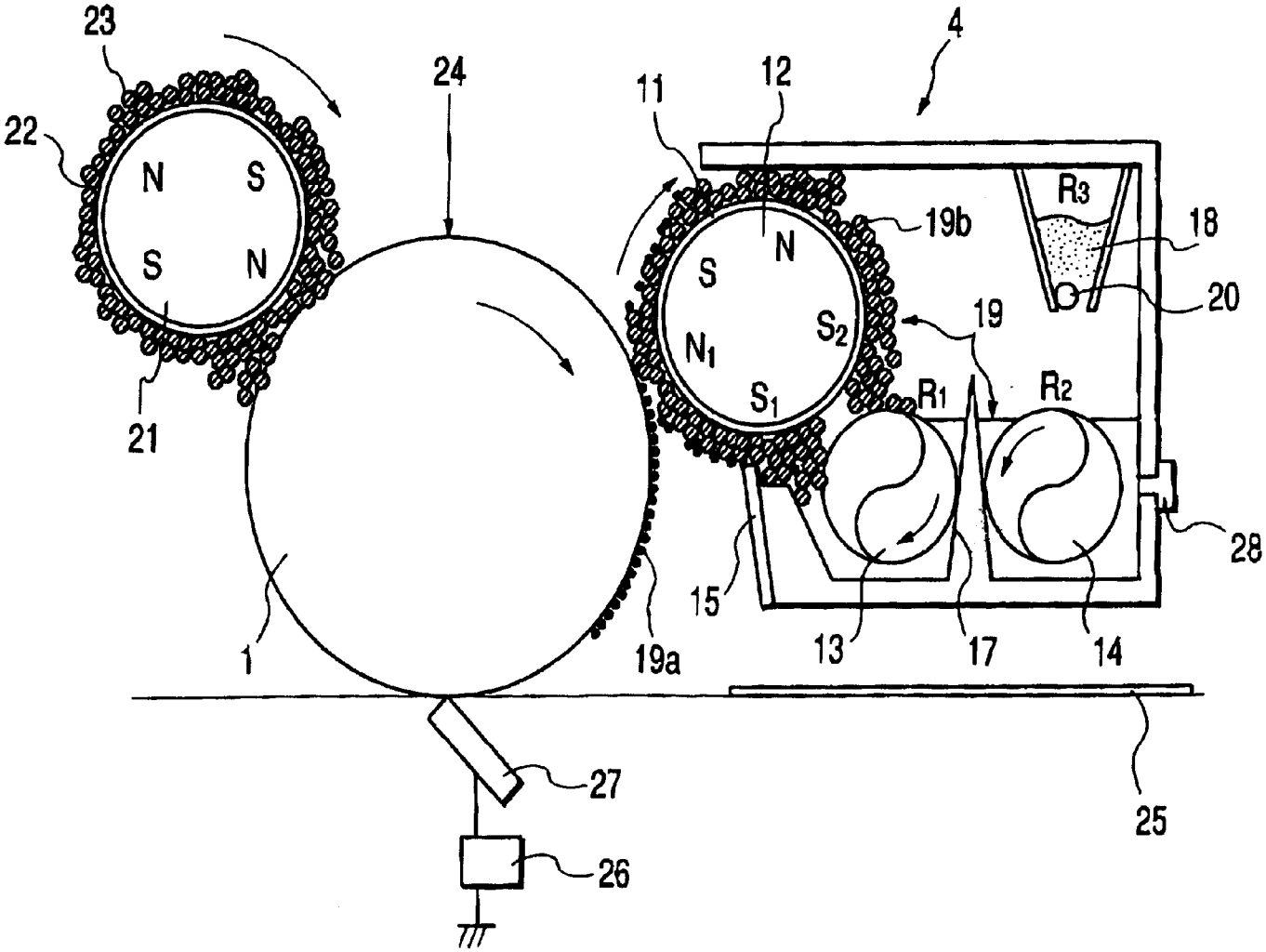
FIG. 1 is a schematic view showing a preferred example of an image forming method of the present invention.

As the result of the inventors' devotion to the study, the following are found in regard to a non-metallic black toner containing a carbon black.

At first, the dispersibility of a carbon black can be improved by properly adding a specified organometallic compound and an alkali metal element. Secondly, the affinity of a resin with a carbon black is increased and the surface of the carbon black is wrapped with the resin and further the decrease in the resistance of the toner attributable to conductivity of the carbon black can, therefore, sufficiently be suppressed by properly adding a polyester resin having polarity and an alkali metal element. Owing to those effects, a toner with excellent coloring capability and quick and excellent electric chargeability in any ambient environments can be provided.

Moreover, since the dispersibility of the carbon black can be improved, a carbon black having a low DBP oil absorption and a little toluene extraction can be employed. Though the carbon black with a little toluene extraction causes deterioration of wettability with a polymerizable monomer, even in the case a toner is produced by the polymerization method, an excellent toner can be produced due to the fewness of polymerization inhibitory functional groups. On the other hand, though the carbon black with a low DBP oil absorption is inferior in dispersibility, a toner with stably electric chargeability even in highly humid environments can be produced due to that the carbon black is hardly affected with moisture in the air.

Consequently, it is found that a toner having excellent coloring capability and electric chargeability as compared with a toner containing a conventional carbon black can be obtained.

The non-metallic black toner which the present invention is characterized by contains a polyester resin as a resin component, a carbon black as a coloring material, a specified organometallic compound as a charge controlling agent, and further a specified amount of an alkali metal.

According to minute examinations by the inventors of the present invention, owing to the combination of a polyester resin with a proper amount of an alkali metal element, the charging speed and the saturation of charge quantity of the toner can be heightened, and moreover, the effect of the conductive carbon black can be suppressed as low as possible.

Though the reason for that is not clear, the inventors of the present invention assume as following.

Regarding the chargeability property of the toner, carboxyl groups which the polyester resin contains are supposed to increase the charging speed and OH groups which the polyester resin contains are supposed to have a function of decreasing the saturated charging quantity.

Since carboxyl groups are functional groups having extremely strong polarity, the carboxyl groups associate one another and make polymer chains extended to their peripheries from the associated parts. In the case, for example, two carboxyl groups are associated with each other,

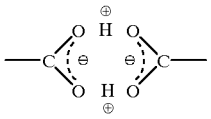

the following state is assumed and stable association state is presumably produced. Further, in consideration of the bond angle of C—O bond, four or more carboxyl groups are assumedly associated to form an assembly. The carboxyl groups-associated assembly formed by such a manner is like a hole, so that the assembly is supposed to easily accept free electrons and consequently, the carboxyl group is assumed to have a function of improving the charging speed of the toner. As long as the associated state is kept, the carboxyl group has high resistance to attack from the outside and especially, even if a water molecule tends to be coordinated, such coordination hardly occurs. As a result, the environmental stability of the toner is high.

In opposition to carboxyl groups, regarding OH groups, in the case two OH groups are associated, the OH groups form the following state $$—O^{\Delta}H^{\ominus}$$

$$H^{\ominus}O^{\ominus}—$$

and are provided with stronger polarity than that of one OH group. The OH groups, not like the case carboxyl groups are associated, can not exist with stable electric charge and are easily affected with attack from the outside. As a result, the OH groups are supposed to be easily affected with water molecules.

By adding a proper amount of an alkali metal which has a low electronegativity to the polyester resin having such charging properties, OH groups of the polyester and the alkali metal contained in the toner particle are associated and even in the sites where the OH groups are associated, electric charges can stably exist, so that the OH groups are hardly affected with water molecules and the decrease in the saturated electric charging quantity can be suppressed.

The following is the reaction mechanism of suppression of conductivity of the toner particles. A carbon black has a small particle diameter and a structure in which carbons are arranged in a net-like state, so that the carbon black has a low affinity with a toner resin and is hardly dispersed therein. However, by adding an alkali metal element just like the toner of the present invention, the alkali metal element works as a buffer between the toner resin and the carbon black and the affinity between the resin and the carbon black is heightened. Consequently, since the carbon black can exist while being surrounded with the resin and its dispersibility in the toner particle is enhanced, uneven existence of the carbon black in the surface of the toner can be suppressed and dissociation of the carbon black can also be suppressed. Moreover, even if there is carbon black existing on the toner particle surface, the carbon black is surrounded with the resin, so that electric charge leakage is inhibited and the increase in the conductivity of the toner particles can be suppressed. As a result, a toner with quick and excellent chargeability can be obtained.

Further, though detailed reasons are not clear, in the case a carbon black and a specified organometallic compound are added together with an alkali metal element to a toner, the dispersibility of both of the organometallic compound and the carbon black is improved and not only the coloring force and the chargeability are improved as described before but also the transferring property and flowability of the toner are found improved.

Consequently, excellent and even charging of the toner with a charging member is enabled to be carried out and color images with excellent reproducibility of halftone can be obtained.

As described before, a carbon black is a pigment difficult to be dispersed as compared with other pigments. Especially in the case of producing a toner by the polymerization method, since sufficient shearing force can not be applied, it has been extremely difficult to suppress liberation of the carbon black or uneven dispersion, e.g. uneven existence, of the carbon black on the toner surface. Since a carbon black with a low DBP oil absorption just like the carbon black to be employed preferably for the present invention especially intensely has such a tendency and hardly satisfies the coloring force improvement compatibly with the charging property of a toner, the carbon black is scarcely employed for a toner for electrophotography.

In the present invention, by properly adding a specified organometallic compound and an alkali metal element, the dispersibility of carbon black is improved and by properly adding further a polyester resin and an alkali metal element, leakage of electric charges of a toner attributable to a carbon black is successfully suppressed sufficiently.

Regarding a preferable carbon black to be employed for the present invention, its average primary particle diameter is 13 to 55 nm, pH is 7 or higher, the content of volatile matters is 1% or less, DBP oil absorption is 20 to 100 ml/100 g, the ratio to be extracted with toluene is 0.1 or less, the residue on sieve is 250 ppm or lower, and the bulk density is 650 g/l or lower.

As described before, the carbon black of the present invention, the average primary particle diameter is preferably 13 to 55 nm, more preferably 25 to 50 nm. If the average primary particle diameter is smaller than 13 nm, even in the case a specified organometallic compound to be employed for the present invention is used, uniform dispersion is hardly achieved and dissociation of the carbon black to the toner surface easily occurs. On the contrary, if the average primary particle diameter of the carbon black is larger than 55 nm, the coloring force is insufficient even in the case the carbon black is excellently dispersed and if a large amount of the carbon black is used in order to increase the coloring force, the charge quantity of the toner is decreased.

The carbon black for the present invention preferably has pH of 7 or higher, more preferably, 7.5 to 10.5. That pH is lower than 7 means a large amount of functional groups such as carboxyl groups remain and in that case, association of carboxyl groups becomes firm and the carbon black tends easily to exist on the toner surface and solid image uniformity in high humidity is deteriorated. On the contrary, the pH is extremely too high, the carbon black tends to be easily dissociated to the toner surface and therefore, pH is preferably 10.5 or lower.

The carbon black for the present invention preferably contains volatile matters in an amount not higher than 1%, more preferably, not higher than 0.8%. That the amount of volatile matters exceed 1% means many functional groups exist on the surface of the carbon black. In the case such a carbon black is used, not only polymerization is inhibited at the time of producing a toner by the polymerization method but also the carbon black tends to easily exist unevenly on the toner surface, so that solid image uniformity in high humidity is easily deteriorated.

The carbon black for the present invention preferably has a DBP oil absorption of 20 to 100 ml/100 g, more preferably, 30 to 60 ml/100 g. In the case the oil absorption exceeds 100 ml/100 g, the carbon black tends to easily exist on the toner surface, so that especially the transferring property of the toner is deteriorated and the coloring force is hardly improved. On the contrary, in the case the oil absorption is less then 20 ml/100 g, the dispersibility of the carbon black in the toner particles is insufficient, so that coloring force and the charging quantity of the toner are easily decreased.

Further, it is preferable for the carbon black to be employed for the present invention to have a small specific surface area and to be less extracted with toluene as compared with one commonly used for the conventional toner. Since the carbon black which has a small specific surface area and is less extracted with toluene contains polymerization-inhibiting functional groups in a small number, the polymerization inhibition is low and even in the case of producing a toner by the polymerization method, a toner with sharp particle diameter distribution can be obtained.

Consequently, regarding the carbon black to be employed for the present invention, the specific surface area measured by nitrogen absorption is preferably 100 $m^2/g$ or smaller and more preferably 30 to 90 $m^2/g$ and furthermore preferably 40 to 90 $M^2/g$, and the amount of toluene extration is preferably 0.1% or less and more preferably 0.05% or less.

In the case the specific surface area of the carbon black measured by nitrogen adsorption exceeds 100 $m^2/g$, the polymerization is easily inhibited. Further, in the case the extraction amount of the carbon black with toluene exceeds 0.1%, a large number of polymerization-inhibiting functional groups exist on the carbon black surfaces so that when the toner is produced by the polymerization method, a toner with a sharp particle diameter distribution is hardly obtained and the carbon black tends to unevenly exist on the toner surface to result in inferior transfer of image in highly humid environments.

The residue on sieve of the carbon black of the present invention is preferably 250 ppm or less, more preferably 100 ppm or less, and furthermore preferably 50 ppm or less. That the residue on sieve exceeds 250 ppm means existence of a large amount of agglomerated carbon black and the agglomerated carbon black is not only hard to be finely dispersed in a toner but also easy to get in dissociated state in the toner surface. In that case, the charge quantity of toner is easily decreased in high humidity and solid image uniformity is easily deteriorated.

The bulk density of the carbon black of the present invention is preferably 650 g/liter or smaller and further preferably 500 g/liter or smaller. If the bulk density exceeds 650 g/liter, uniform dispersion of the carbon black is hardly achieved and the dissociation to the toner surface is easily caused. In that case, charging quantity is easily decreased in high humidity.

In order to compatibly obtain the high image density and charging stability in the present invention, the content of the carbon black in the toner particle is preferably 0.8 to 20% by weight and more preferably 2 to 15% by weight.

In the case the content of the carbon black is less than 0.8% by weight, the coloring force as a toner is low and it becomes difficult to obtain high image density. In the case the content exceeds 20% by weight, uniform dispersion of the carbon black is hardly achieved even if the carbon black is added together with an alkali metal element, a specified organometallic compound, and further a polyester resin of the present invention and the conductivity of the resultant toner can not sufficiently be suppressed to result in insufficient satisfaction to the purposes of the present invention.

As an alkali metal element relevant to the present invention, potassium and sodium are preferable, and from the viewpoint of the electronegativity in relation to the association state of a polyester resin and a carbon black and the atom size in relation to the dispersibility of an organometallic compound and a carbon black, potassium is most preferable.

The content of an alkali metal element in the toner particle to be employed for the present invention is 10 to 200 ppm and preferably 20 to 170 ppm. If the content of the alkali metal element is less than 10 ppm, sufficient effects such as dispersibility improvement and conductivity suppression of a carbon black can not be obtained to result in low charging quantity and broad distribution and to cause undesirable phenomena such as fogging, scattering, and transferring property deterioration. On the contrary, if the content of the alkali metal element is higher than 200 ppm, the ratio of an alkali metal existing as an alkali metal hydroxide in high humidity is increased, so that the toner becomes susceptible of moisture, the charging quantity is decreased, and undesirable phenomena such as fogging, scattering, and transferring property deterioration are caused just like the case of a low content of an alkali metal element.

The ratio A/B wherein A (ppm) stands for the content of an alkali metal element based on the weight of the toner particle and B (% by weight) for the content of a carbon black is preferably 1 to 45 and more preferably 2 to 30.

Means for adding the alkali metal element to a toner particle are not specifically limited, and the means wherein the alkali metal element is added at first to the carbon black and then to a toner is effective to achieve desirable effects in the present invention. By adding the alkali metal element to the carbon black, the flowability of the carbon black with high agglomerating tendency is heightened, so that the dispersibility of the carbon black in the toner can be improved. That is, the improvement of the dispersibility of the carbon black in the toner is presumably owing to ionization of the alkali metal to be cationic at the time of firing the carbon black and suppression of agglomeration of the carbon black itself by repulsion of the electric charge of the alkali metal. In the case an alkali metal element is added to a carbon black, the content of the alkali metal element in the carbon black is preferably controlled to be 50 to 1,000 ppm based on the weight of the carbon black. By controlling the content within the defined range, the content of the alkali metal element in the toner particle is easily kept within 10 to 200 ppm and the dispersibility of the carbon black can be especially desirable. In the case the content of the alkali metal element in the carbon black gets out of the range from 50 to 1,000 ppm, undesirable phenomena similar to those caused in the case the content of the alkali metal element in the toner particle is out of the range from 10 to 200 ppm are easily caused. In other words, if the alkali metal content in the carbon black is less than 50 ppm, dispersibility improvement of the carbon black, which is a main purpose of the present invention, can not properly be achieved. On the contrary, if the content is more than 1,000 ppm, the charging property of the carbon black is increased too much and that may inhibit polymerization especially in the case of producing a toner by the polymerization method, may increase the existence ratio of a toner bearing the opposite charge in the case of employing such a carbon black for a negative charge toner, or may cause fogging and scattering of a toner.

The organometallic compound to be employed for the present invention is necessarily either one of an organoiron compound, an organoaluminum compound, an organochromium compound, an organozinc compound, an organoboron compound, and an organozirconium compound from the viewpoint of properties of an electron donor, and an organoiron compound, an organoaluminum compound, or an organozinc compound is especially preferable. In the present invention, for example, the organoiron compound means an organic compound containing iron element and may be a compound compounded with another metal, and regarding other organometal compounds, the same in those points.

As the organometallic compound to be employed for the present invention, one capable of playing a role as a charge controlling agent is preferable and an azo type metal compound or hydroxycarboxylic acid metal compound is preferable from a viewpoint of providing a toner with high and even electric charge.

Even and high charging properties are hardly obtained with an organometallic compound besides the azo type metal compound and the hydroxycarboxylic acid metal compound, and thin image density and fog due to charge up and fogging, scattering, and transferring property deterioration due to low charge may easily be caused.

The content of an organometallic compound to a toner particle in the present invention is preferably 0.1 to 8.0% by weight and more preferably 0.3 to 6.0% by weight. Within the ranges, the dispersibillity of a carbon black is kept excellent and even and high charging up can be achieved.

The ratio A/C wherein A (ppm) stands for the content of an alkali metal element based on the weight of a toner particle and C (% by weight) for the content of an organometallic compound is preferably 5 to 200 and more preferably 7 to 160.

As an azo type metal compound to be employed for the present invention, the compound having a structure defined as the following structural formula (1) is preferably employed.

Formula (1)

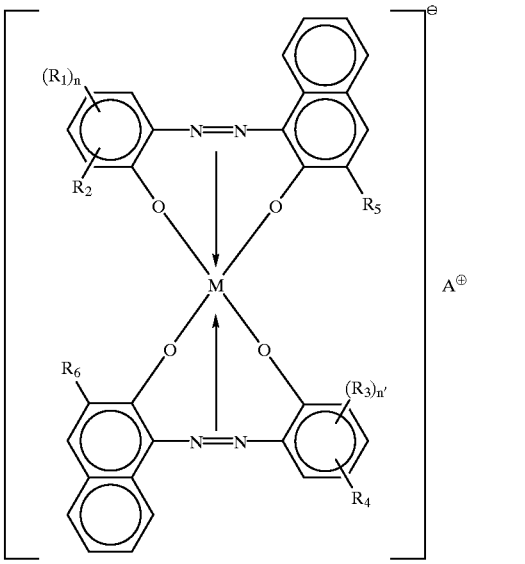

wherein M is a metal element; $R_1$ and $R_3$ represent a hydrogen atom, $C_1$–$C_{18}$ alkyl group, $C_2$–$C_{18}$ alkenyl group, sulfonazide group, mesyl group, sulfonic acid group, carboxyester group, hydroxyl group, $C_1$–$C_{18}$ alkoxyl group, acetylamino group, benzoylamino group, or a halogen atom; $R_1$ and $R_3$ may be the same or different; n and n' is an integer of 1 to 3; $R_2$ and $R_4$ represent a hydrogen atom or nitro group; $R_2$ and $R_4$ may be the same or different; $R_5$ and $R_6$ represent a hydrogen atom, a halogen atom, nitro group, carboxyl group, anilide group, $C_1$–$C_{18}$ alkyl group, alkenyl group, aralkyl group, alkoxyl group, aryl group, carboxyester group, or the following

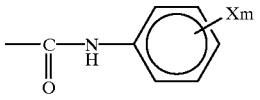

(wherein X is a hydrogen atom, $C_1$–$C_{18}$ alkyl group, $C_1$–$C_{18}$ alkoxyl group, nitro group, or a halogen atom; m is an integer of 1 to 3;) $R_5$ and $R_6$ may be the same or different; $A^+$ is a cation such as hydrogen ion and ammonium ion or their mixture).

Next, the hydroxycarboxylic acid metal compound to be employed for the present invention is described. Malic acid, dimethylolbutanoic acid, tartaric acid, citric acid, salicylic acid, and hydroxynaphthoic acid are examples of the hydroxycarboxylic acid to be employed. Among them, alkylsalicylic acid and dialkylsalicylic acid having an alkyl group with 5 carbons or less are preferable and 3,5-dialkylsalicylic acid is especially preferable. As the alkyl group, tert-butyl group is most preferable to be used.

Further, 2-hydroxyl-3-naphthoic acid, ≦5C alkyl-2-hydroxyl-3-naphthoic acid, and 5,6,7,8-tetrahalo-2-hydroxyl-3-naphthoic acid are examples as other compounds.

The metal atom contained in the hydroxycarboxylic acid metal compound is aluminum, zinc, chromium, or iron and according to the examinations of the inventors, aluminum and zinc are more preferable.

Further, it is preferable to use the hydroxycarboxyllc acid metal compound and the above described azo type metal compound at the same time, and in this case, a hydroxycarboxylic acid metal compound containing cobalt, nickel, copper, or zirconium in addition to the metal atoms may be used. In the case the hydroxycarboxylic acid metal compound and the above described azo type metal compound are used simultaneously, the dispersion effect of a carbon black is further heightened.

As a binder resin for the present invention, not only solely a polyester resin but also together with a polyester resin, the following resins may be used. The resins to be employed together with a polyester resin include, for example, styrenic copolymers such as polystyrene, styrene-butadiene copolymer, and styrene-acrylic acid copolymer; polyethylene-vinyl ethyleneacetate copolymer, phenolic resin, epoxy resin, acryl phthalate resin, polyamide resin, polyester resin, and maleic acid type resin.

At first, polyester resin is described in detail.

As a bivalent acid component forming the polyester resin to be preferably used for the present invention, for example, aromatic dicarboxylic acids such as terephthalic acid, isophthalic acid, phthalic acid, diphenyl-p,p'-dicarboxylic acid, naphthalene-2,7-dicarboxylic acid, naphthalene-2,6-dicarboxylic acid, diphenylmethane-p,p'-dicarboxylic acid, benzophenone-4,4'-dicarboxylic acid, and 1,2-diphenoxyethane-p,p'-dicarboxylic acid may be used and besides these acids, maleic acid, fumaric acid, glutarlc acid, cyclohexanedicarboxylic acid, succinic acid, malonic acid, adipic acid, mesaconic acid, itaconic acid, citraconic acid, sebasic acid, and their anhydrides or their lower alkyl esters may be used.

As a dihydro alcohol, diols having the following formula (3) are examples.

Formula (3)

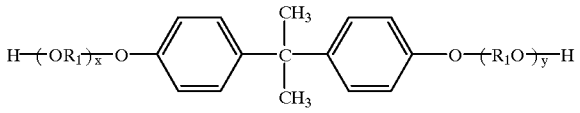

wherein $R_1$ is $C_2$–$C_8$ alkylene group; X and Y are positive numbers; and $2 \leqq X+Y \leqq 6$. For examples, polyoxypropylene (2.2)-2,2-bis(4-hydroxyphenyl)propane, polyoxyethylene (2.0)-2,2-bis(4-hydroxyphenyl)propane, polyoxypropylene (6.0)-2,2-bis(4-hydroxyphenyl)propane, polyoxypropylene (1.3)-2,2-bis(4-hydroxyphenyl)propane are among the usable diols.

As other dihydric alcohol, the following are examples; diols such as ethylene glycol, diethylene glycol, triethylene glycol, 1,2-propylene glycol, 1,3-propylene glycol, 1,4-butanediol, neopentyl glycol, and 1,4-butenediol; 1,4-bis (hydroxymethyl)cyclohexane, and bisphenol A and hydrogenated bisphenol A.

The polyester resin may be cross-liked by using tri- or higher carboxylic acid component. As the cross-linking components, trimellitic acid, tri-n-ethyl 1,2,4-tricarboxylate, tri-n-butyl 1,2,4-tricarboxylate, tri-n-hexyl 1,2,4-tricarboxylate, tri-isobutyl 1,2,4-benzene tricarboxylate, tri-n-octyl 1,2,4-benzene tricarboxylate, tri-2-ethylhexyl 1,2,4-benzene tricarboxylate may be employed. However, the crosslinking components are not limited to them and other tri- or higher carboxylic acid components or alcohol components may be employed.

As the production method for obtaining the polyester resin used for the present invention, the following production methods may be employed.

At first, a linear condensate is produced and during the production, the molecular weight is controlled as to keep the acid value and the hydroxyl value as 1.5 to 3 times as high as those aiming values and at the same time the condensation reaction is so slowly and gradually carried out as to make the molecular weight uniform, for example, the reaction is controlled by the following manner; (i) by carrying out the reaction at low temperature for a long duration, (ii) by decreasing an esterifying agent, (iii) by using an esterifying agent with a low reactivity, or (iv) by combining those methods. After that, under the conditions as they are, a crosslinking acid component and, if necessary, an esterifying agent are further added to carry out the reaction to produce a three-dimensional condensate. Further, the temperature is increased and the reaction is so slowly carried out for a long duration as to make the molecular weight distribution uniform and as to promote the crosslinking reaction, and at the time when the hydroxyl value or the acid value or the MI value is decreased to its aiming value, the reaction is finished to obtain a polyester resin.

The polyester resin to be employed for the present invention preferably has an acid value of 5 to 30 mgKOH/g and a hydroxyl value of 40 mgKOH/g or lower. If the acid value of the polyester resin is smaller than 5 mgKOH/g, quick and high charging property can not be obtained and on the contrary, if the acid value is higher than 30 mgKOH/g, charging up is easily caused and fogging and image density deterioration are easily caused in low humidity. On the other hand, if the hydroxyl value is higher than 40 mgKOH/g, the toner becomes susceptible of moisture in high humidity and undesirable phenomena such as fogging, scattering of the toner, or the like due to a drop in electrostatic charge quantity tend to be easily caused.

In the case a resin component besides the polyester resin is used as a main component and the polyester resin as an auxiliary component for a binder resin of a toner, the acid value of the polyester resin is preferably controlled to be 5 to 40 mgKOH/g and preferably so controlled as to keep the acid value of the obtained toner be 5 to 30 mgKOH/g.

In the case a polyester resin is added in the production of a toner by the polymerization method, if the acid value of the polyester resin exceeds 30 mgKOH/g, the affinity of polyester molecules for one another is too high to be dissolved in a polymerizable monomer and it, therefore, takes a long time to produce a uniform polymerizable monomer composition and consequently, that is undesirable.

In the present invention, the weight-average molecular weight (Mw) of a resin component of a toner is preferably 5,000 to 1,000,000 and more preferably 7,000 to 500,000 in molecular weight distribution by GPC (gel permeation chromatography). If the ratio (Mw/Mn) of the weight-average molecular weight (Mw) to the number average molecular weight (Mn) is preferably 2 to 100 and more preferably 3 to 50, a wide fixing latitude can be obtained and contamination of a member such as a toner charge providing member can be suppressed and that is, therefore, desirable.

In the case the weight-average molecular weight (Mw) of a resin component of a toner is less than 5,000, the non-offset region on a high temperature side is narrowed and at the same time, contamination of a member such as a toner charge providing member is easily caused to result in inferior charging of a toner. In the case the weight-average molecular weight (Mw) exceeds 1,000,000, the fixing property of a toner is deteriorated.

Further, if the Mw/Mn ratio of a resin component of a toner is less than 2, a fixing-enabling temperature region is significantly narrowed. If the Mw/Mn exceeds 100, the black color part gives dull tone impression of an image in the case the toner is used as a black toner for full-color image formation and seems incompatible in a full-color image and that is, therefore, undesirable.

In the present invention, for the purpose of improving the release property from a fixing member at the time of heat fixation, a wax component may be added. As the wax component, for example, the following are usable; aliphatic hydrocarbon type wax, oxides of aliphatic hydrocarbon type wax, ester wax, fatty acid esters, saturated straight chain fatty acids, unsaturated fatty acids, saturated alcohols, polyhydric alcohols, fatty acid asides, saturated fatty acid bisamides, unsaturated fatty acid amides, and aromatic bisamides. Among them, the compounds to be preferably employed for the wax component are ester wax having a long chain alkyl group and its modified products (e.g. oxides and graft products), aliphatic hydrocarbon type wax, and oxides of aliphatic hydrocarbon type wax. As the compounds, those having a softening point of 40 to 130° C., preferably, 50 to 120° C. by a ring and ball method (JIS K 2531) are desirable. In the case the softening point is lower than 40° C., the blocking resistance and the shape retaining property of a toner are insufficient and in the case the softening point exceeds 130° C., the effect of improving the release property is insufficient.

The content of the wax component in a toner is preferably 1 to 30% by weight and more preferably 2 to 20% by weight. In the case the content of the wax component is less than 1% by weight, the effect of the wax component addition for improving the release property from a fixing member is insufficient. In the case the content exceeds 30% by weight, the amount of the wax component existing on the toner surface is increased and a member such as a toner charge providing member tends to be easily contaminated and that is, therefore, undesirable.

More specifically, an ester wax having the following general formula is suitably used as the ester wax having long chain alkyl groups;

$$R_1—COO—R_2$$

wherein $R_1$ and $R_2$ represent $C_{15}$–$C_{45}$ alkyl, respectively.

The ester wax especially desirably used for the ester wax having long chain alkyls and defined as the above described general formula is generally synthesized from a higher alcohol component and a higher carboxylic acid component. The higher alcohol component and the higher carboxylic acid component are usually derived from natural products and generally consist of mixtures with carbons in even numbers. If the mixtures are esterified as they are, various types of byproducts with similar structure are auxiliary produced besides the aiming ester compound, so that the properties of a toner may adversely be influenced. For that, an ester wax obtained by refining the raw materials and the produced products by solvent extraction and vacuum distillation operation is desirable to be used.

Further, in the present invention, a wax component comprising an aster wax which contains ester compounds of the above described formula and in which ester compounds having the same number of carbons in total are contained in an amount of 50 to 95% by weight is especially desirable to be used.

If the content of the aster compounds with the same number of carbons in total is less than 50% by weight, complicated crystal polymorphism is caused and the solidifying point is decreased and consequently, in the case of adding the ester wax to a toner, the ester wax may give rise to undesirable phenomena such as deterioration of blocking resistance of a toner and inferior developing property. Further, in the present invention, in the case the above described ester comnpounds are used, a disired flowability of a toner is hardly obtained and filming on carrier particles and a photosensitive iuember surface attributable to the ester wax is easily caused to result in decrease of the quantity of triboelectric charges on the toner and difficulty of continuously obtaining the sufficient quantity of the triboalectric charges.

Further, the content of the ester compounds with the same number of carbons in total is more preferably 55 to 95% by weight and further more preferably 60 to 95% by weight. In the present invention, it is desirable to use ester wax containing preferably 80 to 95% by weight and more preferably 90 to 95% by weight as the total content of ester compounds which include ones having the same number of total carbons as that of the ester compound contained most and others having the number of total carbons within 2 from the number of total carbons of the one contained most.

In the present invention, the content of the ester compounds having the same number of total carbons is measured by the following gas chromatography (GC method) described below.

In the present invention, the gas chromatogram is measured by GC-17A (made by Shimadzu Corporation). In that case, a solution produced by dissolving 1% by weight of ester wax in toluene is used as a sample for measurement and one micro liter of the sample is injected into the GC apparatus provided with an on-column injector. Ultra Alloy −1 (HT) with 0.5 mm-diameter×10 m-length size is used as a column. The column is kept at an initial temperature of 40° C., heated from the temperature to 200° C. at a temperature rise rate of 40° C./min, then raised to 350° C. at 15° C./min, and further to 450° C. at 7° C./min. As the carrier gas, He gas is passed in 50 kPa pressure condition. In the case of identifying the types of compounds, an alkane with a known number of carbons is separately injected and measurement is carried out in the same flowing out time and by comparing obtained gas chromatogram, introducing the gasified components to a weight spectrographic apparatus, or the like, the structures are identified. The content ratio of ester compounds with the same number of carbons is calculated by determining the ratios of respective surface areas of respective peaks to the total surface area of all of the peaks of the obtained chromatogram.

In the present invention, the most preferable ester wax for composing a toner is one having 44 carbons in total in the above described general formula and containing 50–95% by weight of ester components of the general formula wherein $R^1$ and $R^2$ are straight chain type long chain alkyl groups.

As the ester compounds defined by the above described general formula, concretely, the following compounds are mentioned;

| | | Total number of carbons |
|---|---|---|
| (1) | $CH_3—(CH_2)_{16}—COO—(CH_2)_{17}—CH_3$ | 36 |
| (2) | $CH_3—(CH_2)_{18}—COO—(CH_2)_{17}—CH_3$ | 38 |
| (3) | $CH_3—(CH_2)_{16}—COO—(CH_2)_{19}—CH_3$ | 38 |
| (4) | $CH_3—(CH_2)_{18}—COO—(CH_2)_{19}—CH_3$ | 40 |
| (5) | $CH_3—(CH_2)_{20}—COO—(CH_2)_{17}—CH_3$ | 40 |
| (6) | $CH_3—(CH_2)_{16}—COO—(CH_2)_{21}—CH_3$ | 40 |
| (7) | $CH_3—(CH_2)_{22}—COO—(CH_2)_{17}—CH_3$ | 42 |
| (8) | $CH_3—(CH_2)_{18}—COO—(CH_2)_{21}—CH_3$ | 42 |
| (9) | $CH_3—(CH_2)_{20}—COO—(CH_2)_{19}—CH_3$ | 42 |
| (10) | $CH_3—(CH_2)_{22}—COO—(CH_2)_{19}—CH_3$ | 44 |
| (11) | $CH_3—(CH_2)_{22}—COO—(CH_2)_{19}—CH_3$ | 44 |
| (12) | $CH_3—(CH_2)_{20}—COO—(CH_2)_{21}—CH_3$ | 44 |
| (13) | $CH_3—(CH_2)_{22}—COO—(CH_2)_{21}—CH_3$ | 46 |
| (14) | $CH_3—(CH_2)_{14}—COO—(CH_2)_{43}—CH_3$ | 60 |
| (15) | $CH_3—(CH_2)_{27}—COO—(CH_2)_{20}—CH_3$ | 50 |
| (16) | $CH_3—(CH_2)_{43}—COO—(CH_2)_{22}—CH_3$ | 68 |

As the ester wax containing the above described ester compounds, the preferable ester wax has a temperature of the main maximum peak (main peak) value (hereafter called "melting point") in an endothermic curve ranging from 40 to 90° C. and preferably from 55 to 85° C. in the case the endothermic curve is measured according to ASTM D 3418-8. It is preferable for improvement in the low temperature fixing property and anti-offset property of the toner.

That is, if the melting point of ester wax is lower than 40° C., the self coagulation force of the ester wax is weak, so that the resistance to high temperature offset property of the toner tends to be deteriorated. On the other hand, if the melting point exceeds 90° C., the ester wax may be deposited at the time of granulation in an aqueous solvent in the case toner particles are directly produced by the polymerization method and consequently, it may be difficult to granulate the toner with a sharp particle diameter distribution.

In the present invention, the measurement according to ASTM D3418-8 was carried out by the apparatus DSC-7 made by Parkin Elmer. The temperature calibration of the apparatus detection part is carried out by employing the melting points of indium and zinc and the heat quantity calibration is carried out by employing the fusion heat of indium. A pan made of aluminum is used for the sample and an empty pan for reference is set and the measurement is carried out at 10° C./min heating rate.

Further, the ester wax to be used for the present invention preferably has a hardness of 0.5 to 5.0. The hardness of the ester wax is the value measured by producing a cylindrical sample with 20 mm diameter and 5 mm thickness and then measuring Vickers' hardness by employing a dynamic ultrafine hardness meter (DUH-200) made by Shimadzu Corporation. The measurement is carried out in the condition controlled to be at loading velocity of 9.67 mm/second with 0.5 g load and after 10 μm displacement is done in the sample, the sample is kept still for 15 seconds and the formed nick shape is measured to obtain the Vickers hardness. Based on the examinations by the inventors of the present invention, in the case ester wax with hardness less than 0.5 measured by the above described method is used, the pressure dependence and the process speed dependence of a fixing apparatus are high and the resistance effect to high temperature offset tends to be easily deteriorated. On the other hand, in the case the hardness exceeds 5.0, the storage stability of a toner is decreased and also the self coagulation force of the ester wax itself is weak, so that the resistance property to high temperature offset tends to be deteriorated.

The ester waste to be used for the present invention preferably has a weight-average molecular weight (Mw) from 200 to 2,000 and a number average molecular weight (Mn) from 150 to 2,000 and more preferably Mw from 300 to 1,000 and Mn from 250 to 1,000. That is, if an ester wax with Mw less than 200 and Mn less than 150 is used, the blocking resistance of a toner is deteriorated and at the same time low molecular weight components can easily exist on the surface to result in decrease of the flowability of the toner. On the other hand, if an ester wax with Mw higher than 2,000 and Mn higher than 2,000 is used, toner granulation is inhibited and toner coalescence is easily caused in the case the toner is produced by the polymerization method.

In the present invention, the molecular weight distribution of the wax is measured by GPC under the following conditions.

(GPC measurement conditions)

Apparatus: PC-150C (made by Waters Corporation)

Columns: GMH-HT 30 cm double-column type (made by Tosoh Corporation)

Temperature: 135° C.

Solvent: o-dichlorobenmene (0.1% ionol added)

Flow rate: 1.0 ml/min

Sample: 0.4 ml injection of 0.15% sample

Measurement is carried out under the above described conditions and in order to calculate the molecular weight of the sample, a molecular weight calibration curve produced by using a monodisperse system polystyrene standard sample is employed. The calculation is completed by further polyethylene conversion based on a conversion equation derived from Mark-Houwink viscosity equation.

The weight-average particle diameter of a non-metallic black toner of the present invention is 4 to 11 μm (preferably 6 to 9 μm). If the weight-average particle diameter of a toner is smaller than 4 μm, overcharging is caused to result in undesirable phenomena such as fogging and image density decrease. On the contrary, if the weight-average particle diameter of a toner is higher than 11 μm, faithful reproduction of a minute latent image on a drum is made difficult and the image quality of developed images tends to be inferior.

From the viewpoint of evenly charging a toner with electrostatic charge, the particle diameter distribution of the toner of the present invention consists of toner particles with a diameter of 4 μm or smaller preferably in 20% by number or lower and more preferably in 5 to 15% by number and toner particles with a diameter of 12.7 μm or larger preferably in 3.5% by volume or lower and more preferably in 0.1 to 2.0% by volume.

If the 4 μm or smaller toner exceeds 20% by number, fogging tends to easily occur especially in the case the toner of the present invention is employed for a cleaner-less system.

On the other hand, if the 12.7 μm or larger toner exceeds 3.5% by volume, toner scattering easily occurs especially in the case the toner is employed for an image forming apparatus comprising an intermediate transfer member.

The non-metallic black toner of the present invention is characterized by excellent dispersibility of carbon black and high flowability of toner.

As an index for indicating the degree of the dispersibility of a carbon black, a loss tangent tan δ can be used which is defined as the ratio of dielectric loss factor $\in''$ and dielectric constant $\in'$ as described at page 241 of "Characteristics of Carbon Black, Optimum Mixing, and Utilization Technique" (published by Technology Information Association). The smaller the loss tangent tan δ value is, the more excellent the dispersibility of the carbon black is.

The non-metallic black toner of the present invention has tan δ ($5\times10^4$ Hz) at frequency of $5\times10^4$ Hz of 0.0125 or lower and tan δ ($10^5$ Hz) at $10^5$ Hz of 0.0105 or lower and preferably tan δ ($5\times10^4$ Hz) at $5\times10^4$ Hz of 0.0110, or lower and tan δ ($10^5$ Hz) at $10^5$ Hz of 0.0090 or lower.

In the case tan δ($5\times10^4$ Hz) at frequency of $5\times10^4$ Hz is higher than 0.0125 and tan δ ($10^5$ Hz) at $10^5$ Hz is higher than 0.0105, the dispersibility of the carbon black is deteriorated and uneven dispersion occurs, so that the distribution of the electrostatic charge quantity of a toner becomes broad to result in occurrence of undesirable phenomena such as thin image density and fog due to charge up in low humidity and fog, toner scattering, deterioration of transferring property, or the like attributable to insufficient electrostatic charge quantity in high humidity.

Regarding the non-metallic black toner of the present invention, in order to obtain the desirable effects of the present invention, it is necessary to have a Carr's flowability index not lower than 50, preferably, not lower than 60 and a Carr's floodability index not lower than 65, preferably, not lower than 75. In the case the Carr's flowability index is lower than 50 and the Carr's floodability index is lower than 65, sufficient electrostatic charge quantity of a toner is not achieved to result in inferior image quality and especially deterioration of reproducibility of halftone images.

It is preferable for the non-metallic black toner of the present invention to have a contact angle to water of 110 degree or higher. Especially, in the case a latent image holding member having high wettability to a toner and a contact angle to water 105 degree or smaller is employed, it is important for the black toner to have the contact angle to water of 110 degree or higher and not only the transferring property is improved but also occurrence of toner fusion adhesion and filming to the latent image holding member can be suppressed.

Further, in the present invention, the desirable dispersion state of a carbon black in a toner particle is that the carbon black in a binder resin exists much in the center part of the toner and less exists in the toner surface layer in the case the toner cross-section is observed by a trans ission microscope.

In the present invention, the volume intrinsic electric resistivity value of the non-metallic toner is preferably $10^{10}$ to $10^{16}$ Ωcm, more preferably $10^{12}$ to $10^{16}$ Ωcm, and further more preferably $10^{13}$ to $10^{16}$ Ωcm in order to stabilize the electrostatic charge of the toner for a long duration.

In the case the volume intrinsic electric resistivity value of the non-metallic toner is lower than $10^{10}$ Ωcm, the electrostatic charge of the toner tends to be decreased especially in high humidity and in the case the volume intrinsic electric resistivity value exceeds $10^{16}$ Ωcm, the image density tends to be decreased especially when original script with 2% or lower image surface area ratio is continuously printed out in low humidity and that is therefore undesirable.

To the toner of the present invention, various types of fine powders are added to improve the electrostatic charge stability, developing property, flowability, and the durability.

For example, as a fine powder for improving the flowability, fine powders of silica, alumina, and titanium oxide are mentioned. The powders with a specific surface area of 30 $m^2/g$ or higher (more preferably 50 to 400 $m^2/g$) as determined by nitrogen adsorption measured by BET method provide desirable results. The addition amount of the fine powder for improving the flowability is preferably 0.01 to 8 parts by weight and more preferably 0.1 to 5 parts by weight to 100 parts by weight of toner particles.

For the purpose of improving the hydrophobicity and electrostatic charging property, the above described powder for improving the flowability is preferably treated with either solely a treatment agent such as silicone varnish, various types of denatured silicone varnish, silicone oils, various types of denatured silicone oils, silane coupling agents, and other orgenosilicon compounds or in combination of these agents.

As other additives, for examples, there are a lubricating agent such as Teflon, zinc stearate, and poly(vinylidene fluoride) [among them, poly(vinylidene fluoride) is preferable]; a polishing agent such as cerium oxide, silicon carbide, and strontium titanate (among them, strontium titanate is preferable); a caking preventing agent; a conductivity providing agent such as zinc oxide, antimony oxide, and tin oxide; and a developing property improving agent. The amount of the additives is preferably 0.01 to 10 parts by weight and more preferably 0.1 to 8 parts by parts to 100 parts by weight of the toner particles.

In the case the toner of the present invention is mixed with a carrier and used as a two compound-developer, as the carrier, the following are mentioned; a magnetic powder such as an iron powder, a ferrite powder, and a nickel powder; a powder containing a magnetic material dispersed in a resin; and a material powder having core particles the surface of which is treated with a resin.

As the carrier to be used for the present invention, a carrier comprising core particles composed of a magnetic material or a mixture of a magnetic material and a non-magnetic material and a coating of a resin and/or a silane compound formed on the core particles is preferable. Especially, in the case the carrier is mixed with a negatively chargeable toner, it is preferable to incorporate an aminosilans compound into the coating layer.

Since the toner having the defined particle diameter distribution of the present invention tends to pollute the surface of the carrier particle, a carrier produced by coating the, core particle surface with a resin is preferable in order to inhibit the tendency.

The carrier bearing a resin coating on the surface has an advantageous point in the durability when used for a high speed copying machine and also has an advantage that it can control the charge of the toner.

As the resin for forming a coating layer on the carrier, for example, fluororesin, silicone type resin, and silicone type compounds are preferable to be used.

As the fluororesin for forming a coating layer on the carrier, the following are mentioned: halofluoropolymers such as poly(vinyl fluoride), poly(vinylidene fluoride), poly (trifluoroethylene), and poly(chlorotrifluoroethylune); poly (tetrafluoroethylens); poly(perfluoropropylene); copolymers of vinylidene fluoride and acrylic monomer; vinylidene fluoride-chlorotrifluoroethylene copolymer; tetrafluoroethylene-hexafluoropropylone copolymer; vinyl fluoride-vinylidene fluoride copolymer, vinylidene fluorlde-tetrafluoroethylene copolymer; vinylidene fluoride-hexafluoropropylene copolymer; and fluoroterpolymers such as copolymers of terpolymers consisting of tetrafluoroethylene, vinylidene fluoride, and a non-fluoro monomer.

The weight-average molecular weight of the fluororesin is preferably 50,000 to 400,000 (more preferably 100,000 to 250,000).

As the resin for forming the coating layer on the carrier, those fluororesins may solely be used or be blended. Further, a non-fluoro type polymer may be blended with the resins.

As the non-fluoro type polymer, homopolymers or copolymers of the following monomers may be used:

styrene; styrene derivatives such as α-methylstyrene, p-methylstyrene, p-tert-butylstyrene, and p-chlorostyrene; vinyl type monomer having one vinyl group in one molecule such as methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydlethylene glycol methacrylate, ethoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyethyl methacrylate, N-vinyl-2-pyrrolidone methacrylate, methacrylonitrile, methacrylamide, N-methylolmethacrylamide, ethylmorpholinyl methacrylate, diacetonacrylamide, methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, methoxyethyl acrylate, propoxyethyl acrylate, butoxyethyl acrylate, methoxydiethylene glycol acrylate, ethoxydiethylene glycol acrylate, methoxyethylens glycol acrylate, butoxytriethylene glycol acrylate, methoxydipropylene glycol acrylate, phenoxyethyl acrylate, phanoxytetraethylene glycol acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, acrylonitrile, acrylamide, N-methylolacrylamide, diacetonacrylamide, ethylmorpholinyl acrylate, and vinylpyridine; divinylbenzene; reaction products of glycol with either methacrylic acid or acrylic acld; vinyl type monomers having two or more vinyl groups in one molecule such as ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentylglycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane trimethacrylate, trimethylolpropane trimethacrylate, pentaerithritol tetramethacrylate, trismethacryloxyethyl phosphate, tris(methacryloyloxyethyl) isocyanurate, ethylene glycol diacrylate, 1,3-butylene glycol diacrylate, 1,4-butanediol diacrylate, 1,5-pentanediol diacrylate, 1,6-hexanediol diacrylate, neopentylglycol diacrylate, diethylene glycol diacrylate, triethylene glycol diacrylate, polyethylene glycol diacrylate, tripropylene glycol diacrylate, hydroxypivalic acid neopentyl glycol ester diacrylate, trimethylolethane triacrylate, trimethylolpropane triacrylate, pentaerithritol tetraacrylate, trisacryloxyethyl phosphate, tris(acryloyloxyethyl)isocyanurate, half esterified products of glycidyl methacrylate and either methacrylic acid or acrylic acid, half eaterified products of bisphenol type epoxy resin and either methacrylic acid or acrylic acid, and half esterified products of glycidyl acrylate and either methacrylic acid or acrylic acid; and vinyl type monomers having a hydroxyl group such as 2-hydroxyethyl acrylate, 2-hyroxypropyl acrylate, hydroxybutyl acrylate, 2-hydroxy-3-phenyloxypropyl acrylate, 2-hydroxyethyl methacrylate, 2-hyroxypropyl methacrylate, hydroxybutyl methacrylate, and 2-hydroxy-3-phenyloxypropyl methacrylate.

Those monomers are copolymerized by a known method such as suspension polymerization, emulsion polymerization, solution polymerization or the like. The copolymers having weight-average molecular weight of 10,000 to 70,000 are preferable. The copolymers may be cross-linked by malamine aldehyde cross-linking or isocyanate cross-linking.

The blending ratio by weight of the fluororesin to other polymers is preferably (20-80):(80-20) and especially preferably (40-60):(60-40).

As the silicone type resin or silicone type compounds for forming a coating layer on the carrier, the following compounds may be used; polysiloxanes such as dimethyl polysiloxanes and phenylmethyl polysiloxanes. Further, the following denatured silicone resins may also be used; alkyd-denatured silicone, epoxy-denatured silicone, polyester-denatured silicone, urethane-denatured silicone, and acrylic-denatured silicone. The denatured forms include block copolymers, graft copolymers, and comb structure graft copolymers.

At the time of application to the core particle surface, the following methods may be employed; a method wherein a magnetic particle is dispersed in the fluororesin, silicone type resin, or silicone type compounds kept in a varnish state or a method wherein the varnish is sprayed to a magnetic particle.

The amount of the coating resin for treatment is preferably 0.1 to 30% by weight (preferably 0.5 to 20% by weight) to the carrier core material from the viewpoint of film formability and durability of the coating material.

From the viewpoint of matching with a toner with a small particle diameter, the volume average particle diameter of the carrier is preferably 4 to 100 $\mu$m (preferably 10 to 80 $\mu$m and more preferably 20 to 60 $\mu$m) If the volume average particle diameter of the carrier is smaller than 4 $\mu$m, together with the toner, the carrier is easily transferred to a latent image holding member in the development process and tends to cause damages on the latent image holding member and cleaning blades. On the contrary, if the volume average particle diameter of the carrier is larger than 100 $\mu$m, the toner holding capability of the carrier is deteriorated and solid image is made uneven and toner scattering and fogging or the like easily occur.

In the present invention, the carrier and the toner are preferably mixed as to control the toner concentration to be 5 to 10% by weight (more preferably 6 to 9% by weight).

The method for producing a non-metallic black toner in accordance with the present invention is described below.

In the case a non-metallic black toner in accordance with the present invention is produced by the pulverization method, for example, the toner can practically be produced by the method described below.

As a method for producing a non-metallic black toner by a pulverization method, the following is one method comprising steps of adding a binder resin, a carbon black, an organometallic compound, an alkali metal salt, and other additives, evenly mixing the resultant mixture by a mixing apparatus such as a Henschel mixer, melting and kneading the mixture by a heating kneader such as heating rolls, a kneader, and an extruder to compatibly dispersing one another, cooling and solidifying the mixture, followed by pulverizing and strictly classifying to produce aiming black toner particles with a prescribed viscosity. The melting and kneading temperature is preferably 120 to 170° C.

In the production of a toner by the pulverization method, the following method is also applicable; wherein a carbon black and other components based on the necessity are previously added to and dispersed in a part of a binder resin, the rest of the binder resin, an organometallic compound, an alkali metal salt, and other additives based on the necessity are added to the obtained dispersed mixture, the resultant mixture is then melted and kneaded, cooled, pulverized, and classified. For the process of previously dispersing the carbon black in the binder resin, a conventionally known master batch method and flushing treatment method are employed.

As a method for adding the alkali metal element to a toner, as described before, a method by adding an alkali metal salt, for example potassium carbonate and sodium carbonate to the toner formulation is applicable and a method by using a carbon black previously mixed with an alkali metal element to introduce the alkali metal element into the toner is also applicable. In that case, it is no need to add an alkali metal salt additionally in the toner formulation. As is described later, that is the same in the production of a toner by the polymerization method and an alkali metal salt may be added to a polymerizable monomer composition to introduce the alkali metal element into the toner and also a carbon black previously mixed with an alkali metal element may be used for introduction.

In the case of producing a non-metallic black toner in accordance with the present invention, for example, the black toner can practically be produced by a production method described below.

A polymerizable monomer composition is produced by adding an alkali metal salt, a carbon black, a polyester resin, and an organometallic compound, and if necessary an initiator and other additives to polymerizable monomers and evenly dissolving or dispersing the resultant mixture by a mixing apparatus such as a homogenizer or a media-dispersing apparatus. The produced polymerizable monomer composition is dispersed in water phase containing a dispersant by a common stirring apparatus or a mixing apparatus such as a homomixer or a homogenizer. Preferably, the stirring speed and duration is controlled as to give liquid drops of the polymerizable monomer composition with a desired toner particle size, and granulation is carried out. After that, stirring sufficient to maintain the particle state owing to the function of the dispersant and to prevent precipitation of the particle may be carried out. The polymerization temperature is set at 40° C. or higher, generally 50 to 90° C., to carry out polymerization. The temperature may be increased in the latter half of the polymerization reaction and, further, for the purpose of improving the durability in an image formation method employing a toner of the present invention, a part of an aqueous medium may be removed by distillation in the latter half of the polymerization reaction or on the completion of the polymerization reaction to remove unreacted polymerizable monomers and byproducts. On completion of the polymerization reaction, the produced toner particle is washed and recovered by filtration and then dried. In a suspension polymerization, it is usually preferable to use 300 to 3,000 parts by weight of water to 100 parts by weight of the polymerizable monomer composition.

In the case of producing a non-metallic black toner of the present invention by the polymerization method, it is preferable to produce the polymerizable monomer composition through a master batch process in order to improve the dispersibility of the carbon black in the toner particle.

The viscosity of a master batch dispersion liquid containing a first polymerizable monomer, a carbon black, an alkali metal salt, an organometallic compound, and, if necessary, a polyester, a wax component, and a charge controlling agent is preferably 100 to 2,000 mN·sec/$m^2$ (cP), more preferably 150 to 1,600 mN/·sec/$M^2$ (cP).

In the case the viscosity of the dispersion liquid is within a range of 100 to 2,000 mN·sec/$m^2$ (cP), the viscosity of the master batch dispersion liquid is proper and mixing can be done well, so that uniform dispersion of the carbon black can be promoted. In the case the viscosity of the dispersion liquid exceeds 2,000 mN·sec/$M^2$ (cP), the discharging property of the dispersion liquid is deteriorated to result in productivity decrease.

A polymerizable monomer composition is produced by mixing the obtained dispersion liquid with a second polymerizable monomer, a wax component, and, if necessary, a polyester, a charge controlling agent, an initiator, and other additives.

The mixing amount of the second polymerizable monomer to 100 parts by weight of the master batch dispersion liquid is preferably 20 to 100 parts by weight, more preferably 30 to 70 parts by weight to evenly disperse the master batch dispersion liquid in the second polymerizable monomer.

In the case the mixing amount of the second polymerizable monomer is less than 20 parts by weight, it takes time to carry out even dispersion and in the case the amount exceeds 100 parts by weight, recoagulation of the carbon black tends to occur and it also takes time to carry out even dispersion.

Polymerizing monomers that are used when the toner of the present invention is produced include styrene type monomers such as styrene, o(m-,p-)-methyl styrene and m(p-)-ethyl styrene; (meta)acrylate type monomers such as methyl (meth)acrylate, ethyl (meth)acrylate, propyl (meth) acrylate, butyl (meth)acrylate, octyl (meth)acrylate, dodecyl (meth)acrylate, stearyl (meth)acrylate, behenyl (meth) acrylate, 2-ethylhexyl (meth)acrylate, dimetylaminoethyl (meth)acrylate and diethylaminoethyl (meth)acrylate; butadiene; isoprene; cyclohexene; (meth)acrylonitrile; and amide acrylate. They can be used alone or in mixture. In the case where they are used in mixture, these monomers are combined as appropriate for use so that the theoretical glass transition temperature (Tg) described in Polymer Handbook, second edition III, pp. 139–192 (issued by John Wiley&Sons) ranges from 40° C. to 75° C. If the theoretical glass transition temperature is less than 40° C., it is not preferable in terms of storage stability of toner and endurance stability of developers, and if the temperature is above 75° C. the fixation point arises, and especially when used as black toner for forming full color images, color mixing with other toners such as magenta toner, cyan toner and yellow toner is inadequately implemented, the reproducibility of color worsens and transparency decreases in case of OHP image, which is not preferable.

In a polymerizing monomer composition, other resin components can be contained in addition to the polymerizable monomer and polyester resin.

For example, when the polymerizable monomer component containing a hydrophilic functional group such as amino group, carboxylic group, hydroxyl group, sulfonic acid group, glycizyl group and nitrile group which can not be used since they are water soluble and therefore are dissolved in an aqueous suspension to cause emulsion polymerization is incorporated in toner particles, they can be used in the form of copolymers such as random copolymers, block copolymers or graft copolymers formed by copolymerization of these monomer components with vinyl compounds such as styrene and ethylene, or in the form of polycondensation products such as polyester and polyamide and polyaddition products such as polyether and polyimine. If high molecular polymers containing these polar functional groups are made to coexist in toner particles, the phase separation of the wax component and the polymerizable monomer contained in the polymerizable monomer composition is clarified in an aqueous medium, thus making it possible to enhance the performance of toner intended by the present invention.

As polymerization initiators to be used for producing toner particles by polymerization in the present invention, for example, azo type or diazo type polymerization initiators such as 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile and azobisisobutylonitrile; and peroxide type polymerization initiators such as benzoyl peroxide, methyl ethyl ketone peroxide, diisopropyl peroxycarbonate, cumene hydroperoxide, 2,4-dichlorobenzoylperoxide and lauroyl peroxide are used.

The amount of these polymerization initiators to be added varies depending on the intended polymerization degree, but in general, it preferably ranges from 0.5% to 20% by weight on the basis the polymerizable monomer for controlling the molecular weight distribution of toner and enlarging the latitude of reaction condition. the type of polymerization initiators varies slightly depending on polymerization methods, and they are used alone or in mixture referring to the temperature of a half life of ten hours.

When toner particles are produced by polymerization, in order to control the polymerization degree, known cross linking agents, chain transfer agents and polymerization inhibitors can be further added for producing toner particles.

In the present invention, dispersants for use in the polymerization process include, for example, tricalcium phosphate, magnesium phosphate, aluminum phosphate, zinc phosphate, hydroxy apatite, calcium carbonate, magnesium carbonate, calcium hydroxide, magnesium hydroxide, aluminum hydroxide, calcium metasilicate, calcium sulfate, barium sulfate, bentonite, silica, alumina, magnetic substance and ferrite as inorganic dispersants. As organic dispersants, for example, polyvinyl alcohol, gelatin, methyl cellulose, methyl hydroxypropyl cellulose, ethyl cellulose, sodium salts of carboxyl methyl cellulose and starch are used. These dispersants are preferably used in an amount of 0.2 to 10 parts by weight based on 100 parts of the polymerizing monomer for achieving sharper distribution of particle size and making toner particles coalesce.

For these dispersants, commercially available dispersants may be used directly, but such inorganic compounds may also be produced in dispersing media under rapid agitation in order to obtain dispersed particles with fine and uniform size. For example, in case of tricalcium phosphate, dispersants preferable for suspension polymerization can be obtained by mixing an aqueous solution of sodium phosphate and an aqueous solution of calcium chloride under rapid agitation. For making these dispersants minute, 0.001 to 0.1 parts by weight of surfactant may also be used in combination with the aforesaid compounds. Specifically, commercially available nonionic, anionic and cationic surfactants can be used, and for example, sodium dodecyl sulfate, sodium tetradecyl sulfate, sodium pentadecyl sulfate, sodium octyl sulfate, sodium oleate, sodium laurylate, potassium stearate and calcium oleate are preferably used.

The measurement used in the present invention will be now described.

(1) Measurement of DBT Oil Absorption of Carbon Black

The measurement is carried out in accordance with DIN 53601.

(2) Measurement of Specific Surface Area by Nitrogen Absorption of Carbon Black

The measurement is carried out in accordance with ASTM D 3037

(3) Measurement of Volatile Component of Carbon Black

The measurement is carried out in accordance with DIN 53552.

(4) Measurement of Average Primary Particle Diameters of Carbon Black

The cross section of the toner is photographed in magnification of 40,000 factor using a transmittance electronic microscope, 100 of primary particles are selected at random, and the average primary particle diameter is calculated.

(5) Measurement of Toluene Extracts of Carbon Black

The measurement is carried out in accordance with DIN 53553.

(6) Measurement of Residues-On-Sieve of Carbon Black

The measurement is carried out in accordance with DIN ISO 787/18.

(7) Measurement of pH of Carbon Black

The measurement is carried out in accordance with DIN ISO 787/9.

(8) Measurement of Bulk Density of Carbon Black

The measurement is carried out in accordance with DIN ISO 787/11.

(9) Measurement of Weight-average Particle Diameters ($D_4$) and Particle Size Distribution of Toner The average particle diameter and particle size distribution of toner can be measured using Caulter Counter TA-II or Caulter Multithizer II (manufactured by Caulter, Ltd.), but in the present invention, they were measured by using Caulter Multhitizer II (manufactured by Caulter, Ltd.) and connecting the interface (manufactured by Nikkaki) which outputs number distribution and volume distribution and the PC 9801 personal computer (manufactured by NEC) thereto. For an electrolytic solution, first class sodium chloride is used to prepare 1% NaCl solution. For example, ISOTON R-II (manufactured by Caulter Scientific Japan) can be used. For measurement, 0.1 to 5 ml of surfactant, preferably alkyl benzenesulfonate is added as a dlspersant in 100 to 150 ml of the above described electrolytic solution, to which 2 to 20 mg of measurement sample is further added. The electrolytic solution with the sample being suspended therein was treated for dispersion for 1 to 3 minutes by an ultrasonic disperser, and the volume and the number of toner of 2 $\mu$m or more were measured by the above described Caulter Multithizer using 100 $\mu$m aperture as an aperture, thereby calculating the volume and number distributions. Using these values, the weight-average particle diameters ($D_4$) on weight basis (the representative value of respective channel is made the representative value for each channel), % by number of toner of 4.0 $\mu$m or less and % by volume of toner of 10.1 $\mu$m or more were determined.

(10) Measurement of Molecular Weight Distribution of Resin Components of Toner

As a specific method of measuring GPC of resin components of toner, the toner is treated in advance with toluene solvent for extraction for 20 hours using a Soxhlet extractor followed by evaporating the toluene using a rotary evaporator. As necessary, an organic solvent such as chloroform that can dissolve wax contained in the toner but cannot dissolve the resin component is then added followed by washing sufficiently. After that, it is dissolved in THF (tetrahydrofuran), and the resulting solution is filtered with a solvent resistant membrane filter with pore size of 0.3 $\mu$m in diameter for use as a sample for measurement. 150C manufactured by Waters is used, A-801, 802, 803, 804, 805, 806 and 807 manufactured by Showa Denko are connected for column configuration, and the molecular weight distribution is measured using a calibration curve for standard polystyrene resin.

From the obtained molecular weight distribution, the weight-average molecular weight (Mw) and the number average molecular weight (Mn) are calculated.

(11) Measurement of Dielectric Constant and Dielectric Loss Tangent of Toner

After calibration is performed at frequencies of 1 KHz and 1 MHz using 4284A Precision LCR Meter (manufactured by Hewlett-Packard, Ltd.), the dielectric loss tangent (tan $\delta$) is determined from the measured value of dielectric constants at frequencies of $5\times10^4$ Hz and $10^5$ Hz.

0.5 to 0.7 g of toner is weighed and left for two minutes under the load of 34300 kPa (350 kgf/cm$^2$), and is then formed into a disc of 25 mm in diameter and 1 mm or less (preferably 0.5 to 0.9 mm) in thickness for use as a sample for measurement. This sample is installed in ARES (manufactured by Rheometric-Scientific-F-E, Ltd.) equipped with a dielectric constant measuring jig (electrode) of 25 mm in diameter, and is then fixed. After that, measurement is carried out three times under the load of 3.43 N (350 g) and at a frequency between 100 and $10^6$ Hz, and their average is calculated.

(12) Measurement of Contact Angle 5 g of toner is placed in a hallow aluminum ring of 5 cm in diameter and 0.5 cm in height and is left for two minutes under the pressure of 2,000 N/cm$^2$ for pressure forming. It is then polished in succession using abrasive materials of #800 to #1,500 to prepare a plane sample for measurement. This sample is set horizontally in a contact angle meter, CONTACT-ANGLE METER TYPE01 (Kyowa Kaimenkagaku Co., Ltd), ion exchanged water with of 1 mm in diameter is dropped onto the surface of the sample, and the contact angle after 15 minutes is measured. Same measurement is carried out 5 times while a portion to be measured is changed for each measurement, followed by calculating an average value, and this average value is specified as the contact angle.

(13) Measurement of Content of Alkali Metal Elements

Toner particles are treated with sulfuric acid or nitric acid for wet decomposition, followed by adding hydrochloric acid, heating and leaving for cooling for use as a sample for measurement. This is quantified by inductive coupling plasma emission spectrometry (ICP-AES). In the case where toner in which an external additive is added is used as a sample, the toner from which the external additive is removed according to the following process shall be used as a sample for measurement 10 g of toner is added in 100 ml of a solution of water/methanol (70/30) and is dispersed for 20 to 30 minutes using a supersonic disperser. After that, 50 ml of the resulting solution is taken, and is centrifuged for 30 minutes at 3,500 rpm using a centrifugal separator (H-18 manufactured by Kokusan) to remove supernatant liquid. 50 ml of distilled water is added to the powder after the removal, and the same centrifuge separation is performed again and toner particles are collected.

(14) Measurement of Acid Value and Hydroxyl Value of Toner

Basic operation is carried out in accordance with JIS-K0070.

<Acid value>

The mg number of potassium hydroxide required for neutralizing free fatty acid, resin acid and the like contained in 1 g of the sample is called acid value.

1) Reagents (a) Solvent: Mixture of ethyl ether and ethyl alcohol (1+1 or 2+1) or mixture of benzene and ethyl alcohol (1+1 or 2+1), which is to be neutralized with 0.1 mol/liter potassium hydroxide ethyl alcohol solution using phenolphthalein as an indicator immediately before use.

(b) Phenolphthalein solution: 1 g of phenolphthalein is dissolved in 100 ml of ethyl alcohol (95% by volume).

(c) 0.1 mol/liter potassium hydroxide-ethyl alcohol solution: 7.0 g of potassium hydroxide is dissolved in a least amount of water, to which ethyl alcohol (95% by volume) is added so that the total amount is one liter, and the resulting solution is left for 2 to 3 days and is filtrated. Standardization is carried out in accordance with JIS K 8006 (basic items on titration during content testing of reagents).

2) Procedures

A sample of 1 to 20 g is accurately measured, to which 100 ml of the solvent and a few drops of phenolphthalein as an indicator are added, and the resulting solution is shaken sufficiently until the sample is dissolved completely. In case of a solid sample, the solution is heated on a water bath until the sample is dissolved. After the solution is cooled down, it is titrated with 0.1 mol/liter potassium hydroxide ethyl alcohol solution, and the end point of neutralization is reached when the pink color of the indicator is maintained for 30 seconds.

3) Equation for calculation

The acid value is calculated according to the following equation.

$$A = \frac{B \times f \times 5.611}{S}$$

where A: acid value (mg KOH/g),

B: the amount of 0.1 mol/liter potassium hydroxide ethyl alcohol solution used (ml), f: the factor of 0.1 mol/liter potassium hydroxide ethyl alcohol solution, S: sample (g).

<Hydroxyl value>

The mg number of potassium hydroxide required for neutralizing acetic acid bonding to the hydroxyl group when 1 g of sample is acetylated according to a prescribed method is called hydroxyl value, for which testing is carried out using the following reagents, procedures and equation.

1) Reagents (a) Acetylating agent: 25 g of acetic anhydride is placed in a 100 ml measuring flask, and pyridine is added thereto so that the total amount is 100 ml, followed by shaking sufficiently.

(b) Phenolphthalein solution: 1 g of phenolphthalein is dissolved in 100 ml of ethyl alcohol (95% by weight).

(c) 0.5 mol/liter potassium hydroxide-ethyl alcohol solution: 35 g of potassium hydroxide is dissolved in a least amount of water, to which ethyl alcohol (95% by volume) is added so that the total amount is one liter, and the resulting solution is left for 2 to 3 days and is filtrated. Standardization is carried out in accordance with JIS K 8006

2) Procedures

A sample of 0.5 to 2.0 g is accurately measured and placed in a round bottom flask, and 5 ml of the acetylating agent is added thereto. A small funnel is put on the mouth of the flask, and the flask is put up to 1 cm from the bottom in a glycerol bath at 95 to 100° C. At this time, in order to prevent the neck of the flask from absorbing heat of the bath and rising in temperature, the neck joint of the flask is covered with a cardboard disk having a round hole. After one hour, the flask is taken from the bath and then allowed to cool, and thereafter 1 ml of water is added through the fennel, followed by shaking to decompose the acetic anhydride. Furthermore, the flask is heated in the glycerol bath again for ten minutes in order to complete the decomposition, the funnel and the wall of the flask are washed with 5 ml of ethyl alcohol after cooling down, and the solution is titrated with 0.5 mol/liter potassium hydroxide ethyl alcohol using phenolphthalein as an indicator.

Furthermore, the blank test is carried out in parallel with the principal test.

3) Hydroxyl value is calculated according to the following equation $$A = \frac{(B - C) \times f \times 28.05}{S} + D$$

where A: hydroxyl value (mgKOH/g),

B: the amount of 0.5 mol/liter potassium hydroxide-ethyl alcohol solution used (ml) in the blank test, C: the amount of 0.5 mol/liter potassium hydroxide-ethyl alcohol solution used (ml) in the principal test, f: the factor of 0.5 mol/liter potassium hydroxide-ethyl alcohol solution, S: sample (g), D: acid value.

(15) Carr's Flowability Index and Carr's Floodability Index

Carr's flowability Index and Carr's floodability index are measured in accordance with "Illustration about Physical Properties of Powder", a revised and enlarged edition (edited by Powder Engineering Association, Japan Powder Industry Technology Association)" pp. 151–155, using Powder Tester PT-R (manufactured by Hosokawa Micron Co., Ltd.), and specifically, it is calculated according to the following method.

[Measurement of Carr's flowability Index]

Measurement is carried out regarding the four items described below, and each index is calculated based on Conversion Table 1. The total value obtained by summing each index is the flowability index.

A) Angle of repose

B) Condensation

C) Angle of spatula

D) Cohesiveness

A) Measurement of Angle of Repose

Toner is made to fall onto a disk with a diameter of 8 cm through a funnel, and the angle of the conic deposit formed thereby is directly measured using a protractor. For supplying toner in this case, a sieve with an opening of 608 μm (24 meshes) is placed over the funnel, and the toner is put thereon, and are supplied to the funnel by vibrating the sieve.

B) Measurement of Condensation

The condensation C is calculated according to the following equation.

$$C=[(\rho_P-\rho_A)/\rho_P]\times 100$$

wherein $\rho_A$ is bulk density, and toner is uniformly supplied downward through a sieve with an opening of 608 μm (24 meshes) to a cylindrical container with a diameter of 5.03 cm and height of 5.03 cm, and the top face is cut away for weighing, thereby obtaining $\rho_A$.

$\rho_P$ is tapping density, a cylindrical cap is fitted in the container after measuring the above $\rho_A$, powder is added up to the upper edge of the cap, and tapping with tap height of 1.8 cm is.carried out 180 times. After the tapping is completed, the cap is removed and the powder above the top face of the container is cut away for weighing, and the density under this condition is specified as $\rho_P$.

C) Measurement of Angle of Spatula

A 22×120 mm metal spatula is horizontally set just above a catch pan moving up and down, and powder passed through a sieve with a mesh size of 608 μm (24 meshes) is deposited thereon. After a sufficient amount of powder is deposited, the pan is carefully moved down, and the angle of the side of the powder deposited on the spatula at this time is specified as (1). Then, the angle which is measured again after an impact is given once on the arm supporting the spatula by means of weight drop is specified as (2). The average of the aforesaid (1) and (2) is specified as angle of spatula.

D) Measurement of Cohesiveness

As for measurement, three sieves with different mesh sizes are respectively laid on upper, middle, and lower tier in the order of decreasing mesh size, the largest mesh first, above which 2 g of powder is set, and after applying vibrations with amplitude of 1 mm thereto, the cohesiveness is calculated from the residual amount of the powder on the sieves. Sieves for use are determined according to the value of bulk density.

Sieves with mesh sizes of 355 μm (40 meshes), 263 μm (60 meshes) and 154 μm (100 meshes) are used when the bulk density is less than 0.4 g/cm$^3$, sieves with mesh sizes of 263 μm (60 meshes), 154 μm (100 meshes) and 77 μm (200 meshes) are used when the bulk density is 0.4 g/cm$^3$ or more and less than 0.9 g/cm$^3$, and sieves with mesh sizes of 154 μm (100 meshes), 77 μm (200 meshes) and 43 μm (325 meshes) are used when the bulk density is 0.9 g/m$^3$ or more.

Vibration time T (sec) at that time is determined according to the following equation.

$$T=20+\{(1.6-\rho_w)/0.016\}$$

$$\rho_w=(\rho_P-\rho_A)\times(C/100)+\rho_A$$

The cohesiveness is obtained by measuring the amounts of powder $w_1$, $w_2$ and $w_3$ on the upper, middle and lower stages remaining after vibration and performing calculation according to the following equation.

$$C_0=w_1\times 100\times(1/2)+w_2\times 100\times(1/2)\times(3/5)+w_3\times 100\times(1/2)\times(1/5)$$

TABLE 1

Flowability Index Conversion Table

| Angle of repose | | Condensation | | Angle of spatula | | Cohesiveness | |
|---|---|---|---|---|---|---|---|
| Degree | Index | % | Index | Degree | Index | % | Index |
| <25 | 25 | <5 | 25 | <25 | 25 | | |
| 26–29 | 24 | 6–9 | 23 | 26–30 | 24 | | |
| 30 | 22.5 | 10 | 22.5 | 31 | 22.5 | | |
| 31 | 22 | 11 | 22 | 32 | 22 | | |
| 32–34 | 21 | 12–14 | 21 | 33–37 | 21 | | |
| 35 | 20 | 15 | 20 | 38 | 20 | | |
| 36 | 19.5 | 16 | 19.5 | 39 | 19.5 | | |
| 37–39 | 18 | 17–19 | 18 | 40–44 | 18 | | |
| 40 | 17.5 | 20 | 17.5 | 45 | 17.5 | | |
| 41 | 17 | 21 | 17 | 46 | 17 | | |
| 42–44 | 16 | 22–24 | 16 | 47–59 | 16 | | |
| 45 | 15 | 25 | 15 | 60 | 15 | <6 | 15 |
| 46 | 14.5 | 26 | 14.5 | 61 | 14.5 | 6–9 | 14.5 |
| 47–54 | 12 | 27–30 | 12 | 62–74 | 12 | 10–29 | 12 |
| 55 | 10 | 31 | 10 | 75 | 10 | 30 | 10 |
| 56 | 9.5 | 32 | 9.5 | 76 | 9.5 | 31 | 9.5 |
| 57–64 | 7 | 33–36 | 7 | 77–89 | 7 | 32–54 | 7 |
| 65 | 5 | 37 | 5 | 90 | 5 | 55 | 5 |
| 66 | 4.5 | 38 | 4.5 | 91 | 4.5 | 56 | 4.5 |
| 67–59 | 2 | 39–45 | 2 | 92–99 | 2 | 57–79 | 2 |
| 90 | 0 | <45 | 0 | <99 | 0 | >79 | 0 |

[Measurement of Carr's floodability index]

Measurement is carried out regarding the four items described below, and each index is calculated based on Conversion Table 2. The total value obtained by summing each index is the floodabllity index.

E) Flowability

F) Angle of collapse

G) Differential angle

H) Degree of dispersion

E) Flowability

For flowability, the flowability index is directly used.

F) Angle of Collapse

For the angle of collapse, after the angle of repose is measured, a certain impact by weight drop is given to a rectangle bat carrying an injection repose angle base to collapse the deposit layer, and the angle of the slope after collapse of the layer is specified as the angle of collapse.

G) Differential Angle

Difference between angle of repose and angle of collapse is specified as differential angle.

H) Degree of Dispersion

Figure 8:
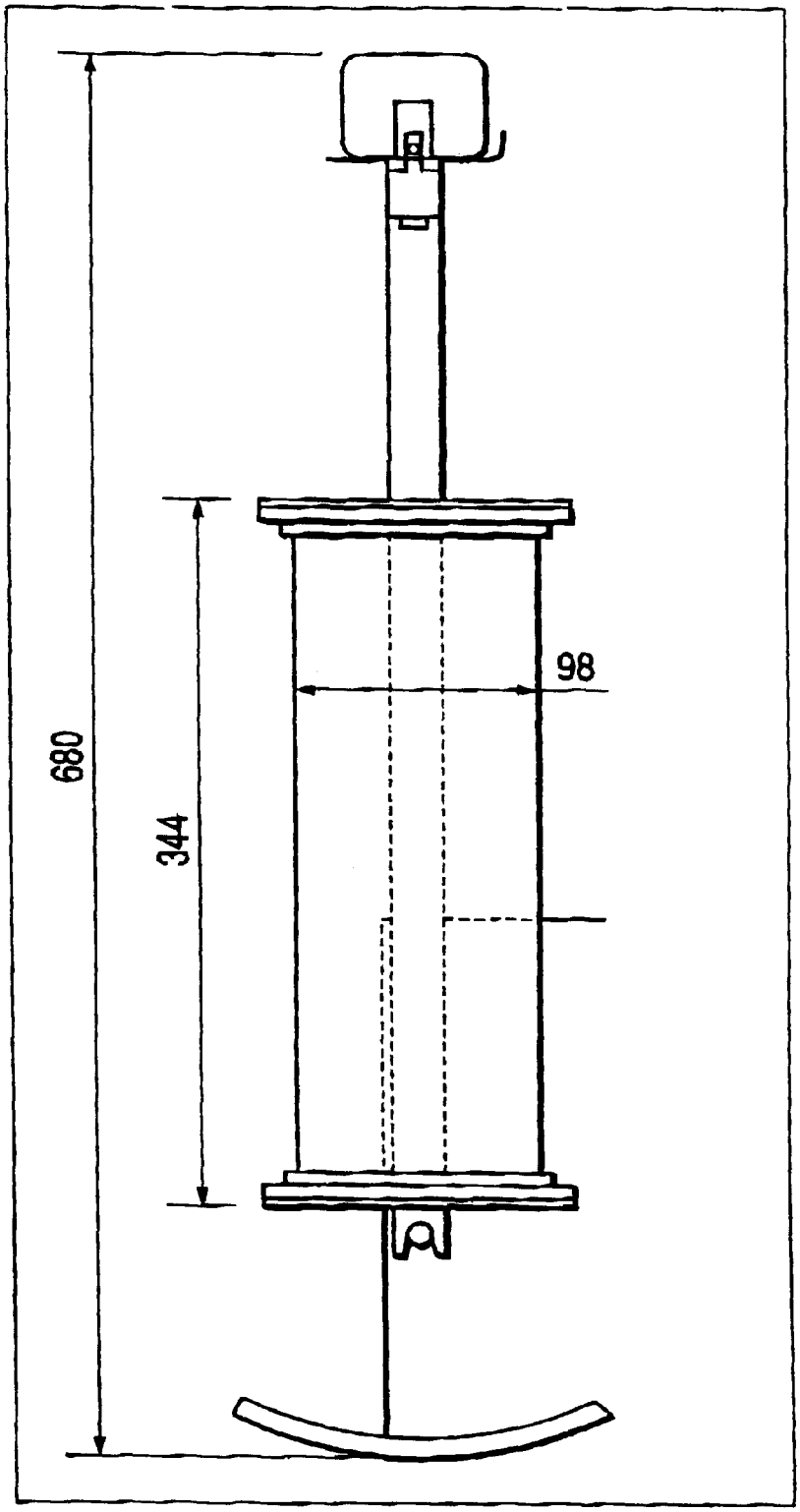
FIG. 8 is a schematic illustration of a dispersity measuring unit.

As shown in FIG. 8, 10 g of powder is made to fall at once from the above through a glass cylinder with an internal diameter of 98 mm and length of 344 mm, and the amount of powder (w) deposited on a watch glass is measured, followed by calculating the degree of dispersion according to the following equation.

$$\text{Degree of dispersion (\%)}=(10-w)\times 100/10$$

TABLE 2

Floodability Index Conversion Table

| Flowability | | Angle of collapse | | Differential angle | | Degree of dispersion | |
|---|---|---|---|---|---|---|---|
| Flowability Index | Index | Degree | Index | Degree | Index | % | Index |
| >60 | 25 | 10 | 25 | >30 | 25 | >50 | 25 |
| 59–56 | 24 | 11–19 | 24 | 29–28 | 24 | 49–44 | 24 |
| 55 | 22.5 | 20 | 22.5 | 27 | 22.5 | 43 | 22.5 |
| 54 | 22 | 21 | 22 | 26 | 22 | 42 | 22 |
| 53–50 | 21 | 22–24 | 21 | 25 | 21 | 41–36 | 21 |
| 49 | 20 | 25 | 20 | 24 | 20 | 35 | 20 |
| 48 | 19.5 | 26 | 19.5 | 23 | 19.5 | 34 | 19.5 |
| 47–45 | 18 | 27–29 | 18 | 22–20 | 18 | 33–29 | 18 |
| 44 | 17.5 | 30 | 17.5 | 19 | 17.5 | 28 | 17.5 |
| 43 | 17 | 31 | 17 | 18 | 17 | 27 | 17 |
| 42–40 | 16 | 32–39 | 16 | 17–16 | 16 | 26–21 | 16 |
| 39 | 15 | 40 | 15 | 15 | 15 | 20 | 15 |
| 38 | 14.5 | 41 | 14.5 | 14 | 14.5 | 19 | 14.5 |
| 37–34 | 12 | 42–49 | 12 | 13–11 | 12 | 18–11 | 12 |
| 33 | 10 | 50 | 10 | 10 | 10 | 10 | 10 |
| 32 | 9.5 | 51 | 9.5 | 9 | 9.5 | 9 | 9.5 |
| 31–29 | 8 | 52–56 | 8 | 8 | 8 | 8 | 8 |
| 28 | 6.25 | 57 | 6.25 | 7 | 6.25 | 7 | 6.25 |
| 27 | 6 | 58 | 6 | 6 | 6 | 6 | 6 |
| 26–23 | 3 | 59–64 | 3 | 5–1 | 3 | 5–1 | 3 |
| <23 | 0 | >64 | 0 | 0 | 0 | 0 | 0 |

One example of methods for forming images using the toner of the present invention will be now described referring to attached drawings.

Methods for development by using the toner of the present invention include, for example, a method for development that uses two-component developers having a toner and carrier, as shown in FIG. 1. In such a method for development, development is preferably carried out under the condition that a magnetic brush contacts an electrostatic image carrier, for example, photosensitive drum 1 while alternating electrical field is applied. The distance B between a carrier" of developer (development sleeve) and the photosensitive drum 1 (distance between S and D) ranges preferably from 100 to 800 $\mu$m so that the depositing of the carrier is avoided and the dot reproducibility is improved. If the distance is less than 100 $\mu$m, the developer cannot be sufficiently supplied and the optical density of image may decrease, and if the distance is more than 800 $\mu$m, the density of the magnetic brush may decrease since magnetic force lines from the magnetic pole $S_1$ are extended, the dot reproducibility may be poor, and the depositing of carrier may be easily caused since the force constraining the magnetic carrier is reduced.

The voltage between peaks of the alternating electrical field preferably ranges from 300 to 3,000 V, and the frequency preferably ranges from 500 to 10,000 Hz, more preferably from 1,000 to 7,000 Hz, from which selection can be made for use as appropriate in accordance with a process. In this case, a waveform can be selected for use from a triangular wave, a rectangular wave, a sine wave or waveforms of different Duty ratios, and intermittent alternating superimposing electrical field.

If the applied voltage is less than 300 V, it is difficult to achieve sufficient image density and fogging toner in a non-image portion may not be satisfactorily recovered. Also, if it is more than 5,000 V, a latent image may be disturbed through the magnetic brush, which may cause image quality degradation.

Furthermore, if the frequency is less than 500 Hz, depending on process speed, adequate vibration may not given when toner that comes to contact with an electrostatic image carrier is returned back to the development sleeve, thus causing fogging more easily. If it is more than 10,000 Hz, toner cannot follow the electrical field, which may result in image quality degradation.

By using two-component developers having satisfactorily charged toner, fogging removing voltage (Vback) can be reduced, and the primary charging of photosensitive member can be reduced, thereby making it possible to prolong the life of photosensitive member. Vback, depending on development systems, is preferably 350 V or less, and more preferably 300 V or less.

For contrast potential, voltage for use preferably ranges from 100 V to 500 V so that adequate image density is provided.

In order to perform development that provides adequate image density and good dot reproducibility and causes no carrier deposition, the contact width (development touch and contact width C) of the magnetic brush on the development sleeve 11 and the photosensitive drum 1 preferably ranges from 3 mm to 8 mm. If the development touch and contact width C is less than 3 mm, it is difficult to ensure adequate image density and satisfactory dot reproducibility, and if it is more than 8 mm, the packing of developers occurs to stop the operation of a machine, and it is difficult to sufficiently reduce carrier deposition. As a method of adjusting the development touch and contact width, the distance A between a developer controlling member 15 and the development sleeve 11 can be adjusted, or the distance B between the development sleeve 11 and the photosensitive drum 1 can be adjusted.

In the method of forming images of the present invention, since there is no influence of electric charge injection through toner and development can be carried out without disturbing the latent image by using a developer containing the toner of the present invention and particularly combining therewith the development system in which digital latent images are formed, development faithful to the dot latent image is achieved. Furthermore, high transfer rate can be achieved also in a transferring process by using toner with sharp particle size distribution after fine powder is cut away, and therefore image formation providing good reproducibility of the halftone area and good uniformity of the solid area can be achieved.

Furthermore, developers containing the toner of the present invention, due to small change in electric charge of the toner in the development device, helps to control degradation of image quality even after copying many times, together with promoting high image quality in the initial stage, and satisfactory image formation for long period is therefore achieved.

Furthermore, in the case where the black toner of the present invention is used when full color images are formed, for obtaining tighter full color images, development using other color toner to be used in combination therewith, for example magenta toner, cyan toner and yellow toner is performed first and development using black toner is performed last, thereby making it possible to obtain tight images.

The method of forming images of the present invention will be further described referring to attached drawings.

In FIG. 1, a magnetic brush configured by magnetic particles 23 is formed on the surface of a transporting sleeve 22 by the magnetic force which a magnetic roller 21 has, and this magnetic brush is made to contact the surface of the electrostatic image carrier (photosensitive drum) 1, and the photosensitive drum 1 is then charged. Charging bias is already applied to the transport sleeve 22 by a bias applying mean not shown in the figure. A digital electrostatic image is formed by irradiating the charged photosensitive drum 1 with a laser beam 24 by light exposing equipment not shown in the figure. The electrostatic image formed on the photosensitive drum 1 is developed with toner 19*a* in a developer 19 carried by the development sleeve 11 which includes a magnet roller 12 therein and to which the development bias is applied by bias applying equipment not shown in the figure.

The developing device 4 is partitioned with a partition wall 17 into a developer chamber $R_1$ and an agitation chamber $R_2$ in which developer transport screws 13, 14 are placed respectively. Above the agitation chamber $R_2$ is placed a toner storage chamber $R_3$ containing toner 18 for replenishment, and a replenishment inlet 20 is provided below the storage chamber $R_3$.

A developer transport screw 13, by rotary motion, stirs and transfers the developer in the developer chamber $R_1$ in one direction along the longitudinal direction of the development sleeve 11. On the partition wall 17 is provided openings (not shown) at the front and back of the drawing, and the developer transported to one side of the development chamber $R_1$ by the screw 13 is sent to the agitation chamber $R_2$ through the opening of the partition wall 17 on this side and is delivered to the developer transport screw 14. The screw 14 whose direction of rotation is reverse to that of the screw 13 transfers through the agitation chamber $R_2$ in the reverse direction of rotation of the screw 13 and sends to the developer chamber $R_1$ through the other opening of the partition 17, the developer in the agitation chamber $R_2$ the developer delivered from the developer chamber $R_1$ and the toner supplied from the toner storage chamber $R_3$ while stirring and mixing them.

The developer 19 in the development chamber $R_1$ is drawn up by the magnetic force of the magnet roller 12 and carried on the surface of the development sleeve 11. The developer carried on the development sleeve 11 is transported to a adjustment blade 15 with the rotation of the development sleeve 11 where it is adjusted to a developer thin layer of a proper thickness, and is then sent to the development region where the development sleeve 11 and the photosensitive drum 1 are placed in opposition. A magnetic pole (development pole) $N_1$ is located in the portion corresponding to the development region of the magnet roller 12 and forms a development magnetic field in the development region. The developer is then grown by this development magnetic field to produce an ear, so that a magnetic brush for the developer is produced in the development region. The magnetic brush contacts the photosensitive drum 1, the toner deposited on the magnetic brush and the toner deposited on the surface of the development sleeve 11 are transferred to and deposited on the region of the electrostatic image on the photosensitive drum 1 by the reversal development, and the electrostatic image is then developed to form a toner image.

The developer passing through the development region is sent back into the developing device 4 with the rotation of the development sleeve 11, and is stripped off the development sleeve 11 by a repulsing magnetic field between magnetic poles $S_1$ and $S_2$, and falls into the developer chamber $R_1$ and the agitation chamber $R_2$ for recovery.

If the T/C ratio (a mixture ratio of the toner 19*a* and the carrier 19*b*, or the concentration of toner in the developer) of the developer 19 in the developing device 4 decreases due to repetition of the aforesaid development, toner 18 is supplied from the toner storage chamber $R_3$ to the agitation chamber $R_2$ in amounts consistent with the amount of toner spent for the development, and the T/C ratio of the developer 19 is therefore maintained at the predetersuined level. For detecting the T/C ratio of the developer 19 in the container 4, a toner concentration detecting sensor 28 which measures changes in magnetic permeability of the developer using the inductance of a coil is used. Such a toner concentration detecting sensor has a coil (not shown) therein.

The adjustment blade 15 which is placed below the development sleeve 11 and adjusts the layer thickness of the developer 19 on the development sleeve 11 is a non-magnetic blade that is made from a non-magnetic material such am aluminum or SUS 316. The distance between its edge and the surface of the development sleeve 11 preferably ranges from 150 $\mu$m to 1,000 $\mu$m, more preferably from 250 $\mu$m to 900 $\mu$m. If the distance is less than 150 $\mu$m, this space may be clogged with magnetic carriers to develop unevenness in the developer layer, and it is difficult to apply a developer required for performing satisfactory development and low density and uneven development images may be formed. For avoiding uneven coating (so called blade clogging) caused by unnecessary particles that coexist in the developer, this distance is preferably 250 $\mu$m or more Furthermore, if the distance is more than 1,000 $\mu$m, the amount of the developer that is applied on the development sleeve 11 increases, thus promoting the deposition of magnetic carrier particles on the photosensitive drum 1, and the triboelectric charge of toner may decrease to facilitate fogging due to inadequate circulation of the developer and weakened friction against the adjustment blade 15.

Furthermore, the developed toner image is transferred onto a transferring material (a recording material) 25 that is being carried, by a transfer blade 27, that is a transferring means to which a transfer bias is applied by a bias applying means 26, the toner image transferred onto the transferring material is fixed to the transferring material by a fixing equipment not shown in the figure. In a transferring process, transfer residual toner that remains on the photosensitive drum 1 without being transferred to the transferring material is adjusted for electric charge in a electric charging process and is recovered during development.

Figure 3:
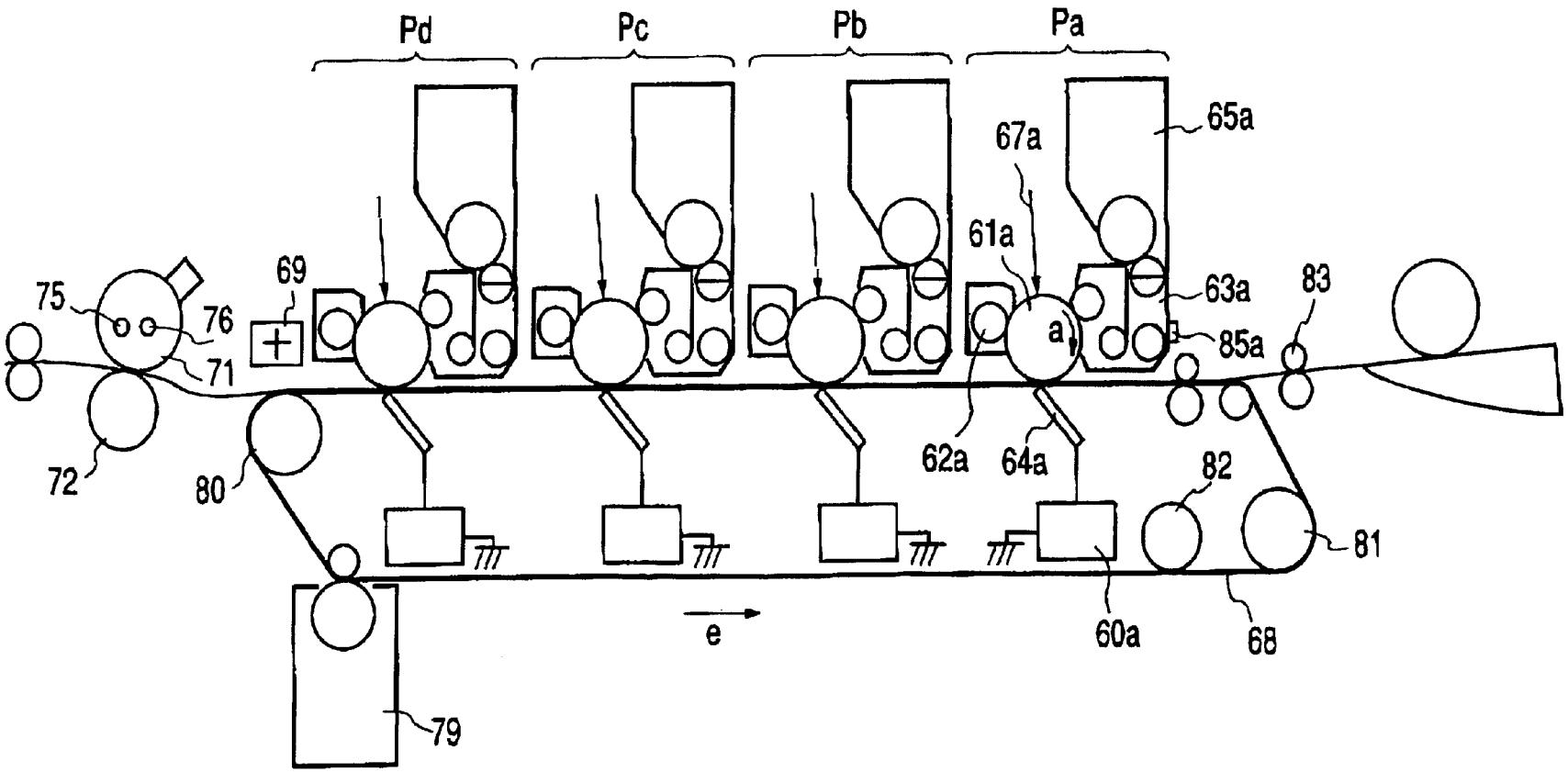
FIG. 3 is a schematic illustration showing a full-color image forming method.

FIG. 3 is a schematic diagram of a full color image forming equipment, and the case where a method of forming images of the present invention is applied to full color image formation will be described below.

To the main body of the full color image forming equipment, a first image forming unit Pa, a second image forming unit Pb, a third image forming unit Pc and forth image forming unit Pd are attached, and images of different color are formed respectively on the transferring material through latent image forming, developing and transferring processes.

The configuration of each image forming unit that is attached to the image forming equipment will be described taking the first image forming unit Pa as an example.

The first image forming unit Pa has an electrophotosensitive drum 61*a* with a diameter of 30 mm as an electrostatic image carrier, and this photosensitive drum 61*a* rotates in the direction of arrow a. 62*a* is a primary charger as a charging means, and a magnetic brush formed on the surface of a sleeve with diameter of 16 mm is placed such that it contacts the surface of the photosensitive drum 61*a*. 67*a* is a laser beam for forming an electrostatic image on the photosensitive drum 61*a* of which surface is uniformly charged by the primary charger 62*a*, and is applied by light exposing equipment not shown in the figure. 63*a* is a developing device as a developing means for developing the electrostatic image carried on the photosensitive drum 61*a* and forming a toner image, and holds the toner. 64*a* is a transfer blade as a transferring means for transferring the toner image formed on the surface of the photosensitive drum 61*a* onto the surface of the transferring material (recording material) which is carried thereto by a belt-shaped transferring material carrier 68, wherein a transfer bias is applied to the 64*a* by a transfer bias applying means 60*a*.

If the toner is consumed through the developing process and the T/C ratio decreases, this change is detected by a toner concentration detecting sensor 85*a* which measures changes in magnetic permeability of the developer using the inductance of the coil, toner 65*a* for replenishment is supplied consistent with the amount of toner consumed. Furthermore, the toner concentration detecting sensor 85*a* has a coil (not shown) therein.

The present image forming equipment has four image forming units attached thereto, namely the first image forming unit Pa as well as the second image forming unit Pb, the third image forming unit Pc and the fourth image forminig unit Pd which have same configurations as the first image forming unit Pa and are different in color of color toner held by the developing device. For example, yellow toner, magenta toner, cyan toner and black toner are used for the first image forming unit Pa, the second image forming unit Pb, the third image forming unit Pc and the fourth image forming unit Pd, respectively, and each color toner is transferred onto the transferring material in succession in the transferring area of each image forming unit. In this process, while registration is matched, each color toner is superimposed on the same transferring material by one transference of the transferring material, and upon completion, the transferring material is separated from a transferring material carrier 68 by a separation charger 69 and is sent to fixing equipment by a conveying mean such as a belt conveyer, and a final full color image is obtained by only one fixation.

The fixing equipment has a pair of fixing rollers 71 with diameter of 40 mm and pressure rollers 72 with diameter of 30 mm, and the fixing roller 71 has heating means 75 and 76 therein.

A not-yet-fixed color toner image that is transferred onto the transferring material passes through the pressed area between the fixing roller 71 and the pressure roller 72 of this fixing equipment 70 and is fixed on the transferring material by the action of heat and pressure.

In FIG. 3, the transferring material carrier 68 is a non edged belt-like member, and this belt-like member is moved in the direction of arrow e by a drive roller 80. 79 is transferring belt cleaning equipment, 81 is a belt driven roller and 82 is belt static eliminator. 83 are a pair of resist rollers for conveying the transferring material in a transferring material holder to the transferring material carrier 68.

As transferring means, it is possible to use a transferring means abutting to the backside of a roller-like transferring material carrier such as a transferring roller and directly applying a transfer bias, other than a transfer blade. Furthermore, instead of such contact transferring means, a non contact transferring means for applying a transferring bias from a corona charger placed in non contact manner on the backside of a transferring material carrier generally used for making transfer can be also used.

However, a contact transferring means is more preferably used in that emission of ozone can be controlled when the transferring bias is applied.

Figure 4:
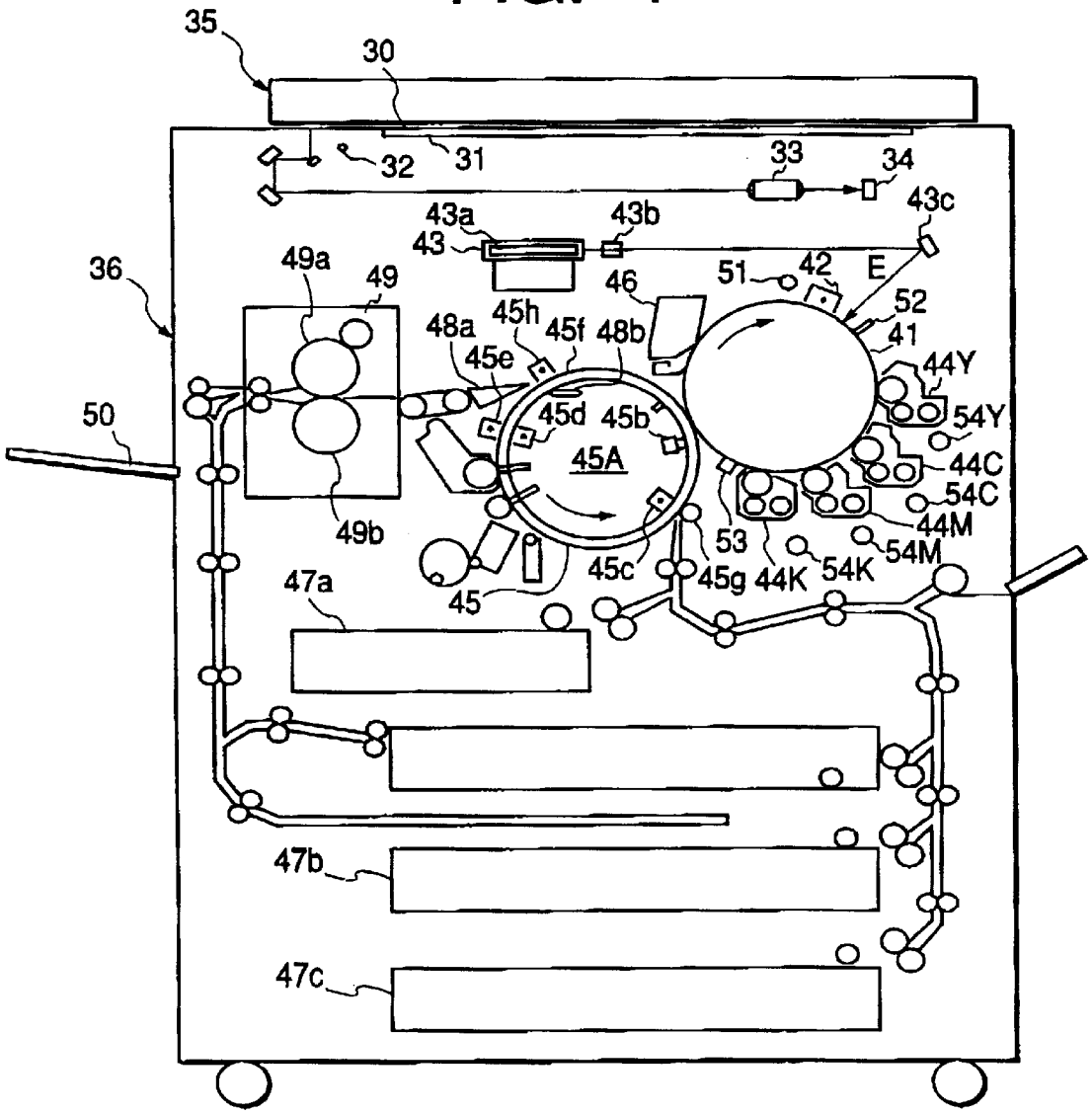
FIG. 4 is a schematic illustration sowing another image forming apparatus for embodying an image forming method of the present invention.

An example of another method of forming images of the present invention will be now described referring to FIG. 4.

FIG. 4 is a schematic block diagram of a example of another image forming equipment which can implement a method of forming images of the present invention.

This image forming equipment is configured for full color copiers. A full color copier has a digital color image reader element 35 at the top thereof and a digital color image printer element 36 at the lower part thereof.

In the image reader element, a document 30 is placed on a document glass 31 and light exposure scanning is made using a light exposure lamp 32, thereby gathering reflected light from the document 30 to a full color sensor 34 by a lens 33 to obtain a color resolving image signal. The color resolving image signal, passing through an amplifier circuit (not shown), is treated in a video treating unit (not shown), and is sent to the digital image printer element.

In the image printer element, the photosensitive drum 41 which is an electrostatic image carrier is a photosensitive member, using for example an organic photoconductor, and is carried rotatably in the direction of arrow. Around the photosensitive drum 41, a pre-exposure lamp 51, a corona charger 42 as a primary charging member, a laser exposure optical system 43 as a latent image forming means, a potential sensor 52, four development devices with different colors, 44Y, 44C, 44M and 44K, a on-drum light amount detecting means 53, transferring equipment 45A and a cleaning device 46 are placed.

In the laser light exposure optical system 43, the image signal from the reader element is converted into a light signal of image scanning exposure at a laser outputting element (not shown), and a converted laser beam is reflected by a polygon mirror 43*a* and is focused onto the surface of the photosensitive drum 41 through a lens 43*b* and a mirror 43*c*.

The printer element, when forming an image, rotates the photosensitive drum 41 in the direction of arrow, has the photosensitive drum 41 negatively charged uniformly by the charger 42 after eliminating electrostatic charges by the pre-exposure lamp 51, applies a light image E for each resolved color, and forms a latent image on the photosensitive drum 41.

A predetermined development device is then made to operate for developing a latent image on the photosensitive drum 41, and a visible image, that is a toner image based on negatively charged toner using resin as base substance is formed on the photosensitive drum 41. Development devices, 44Y, 44C, 44M and 44K selectively approaches the photosensitive drum 41 in accordance with each resolved color to perform development, through the operation of respective eccentric cams, 54Y, 54C, 54M and 54K.

The transferring equipment 45A has a transferring drum 45, a transferring charger 45*b*, an adsorption charger 45*c* to adsorb electrostatic charges of the recording material and an adsorption roller 45*g* placed in opposition to the adsorption charger, and has inside thereof a charger 45*d*, an external charger 45*e* and a separate charger 45*h*. The transferring drum 45 is pivotally supported to be rotatably driven, and in an opened area around it, transferring sheet 45*f* being a recording material carrier for carrying a recording material (transferring material) is integrally controlled to be in a cylindrical form. For the transferring sheet 45*f*, films such as polycarbonate film are used.

The recording material is conveyed from a recording material cassette 47*a*, 47*b* or 47*c* through the recording material carriage system to the transferring drum 45, and is carried on its transferring sheet 45*f*. The recording material carried on the transferring drum 45 is repeatedly carried to a transfer location in opposition to the photosensitive drum 41 with the rotation of the transferring drum 45, and in the process of passing the location for transfer, a toner image on the photosensitive drum 41 is transferred to the recording material by the action of transferring charger 45*b*.

The aforesaid image forming process is repeated for yellow (Y), magenta (M), syan (C) and black (B) toner, thus obtaining a color image produced by superimposing four color toner images and transferring the same onto the recording material on the transferring drum 45.

In case of single-sided image formation, the recording material onto which four toner images are transferred in this way is separated from the transferring drum 45 by the action of a separation claw 48*a*, a separation lifting roller 48*b* and a separation charger 45*h*, and is sent to heating fixation equipment 49. This heating fixation equipment 49 is configured by a heating fixation roller 49*a* having a heating means therein and a pressure roller 49*b*. The recording material passes through the pressed area between this heating fixation roller 49*a* as a heating member and the pressure roller 49*b*, thereby fixing a full color image carried on the recording material to the recording material. That is, thorough this fixation process, color mixture, coloring and fixation to the recording material of toner are carried out and a permanent image of full color is produced followed by dropping the paper into a tray 50 and completing a full color copy. The photosensitive drum 41, on the other hand, is made to serve again in the image forming process after residual toner on the surface is cleaned and removed by a cleaner 46.

In the present invention, the toner image produced by developing the electrostatic image formed on the latent image holding member can also be transferred onto the recording material via intermediate transferring medium to perform image formation.

That is, this image forming method comprises a process of transferring the toner image formed by developing the electrostatic image formed on the electrostatic image carrier onto the intermediate transferring medium, and a process of transferring the toner image transferred onto the intermediate transferring medium onto the recording material.

An example of image forming methods using intermediate substance will be described in detail referring to FIG. 5.

Figure 5:
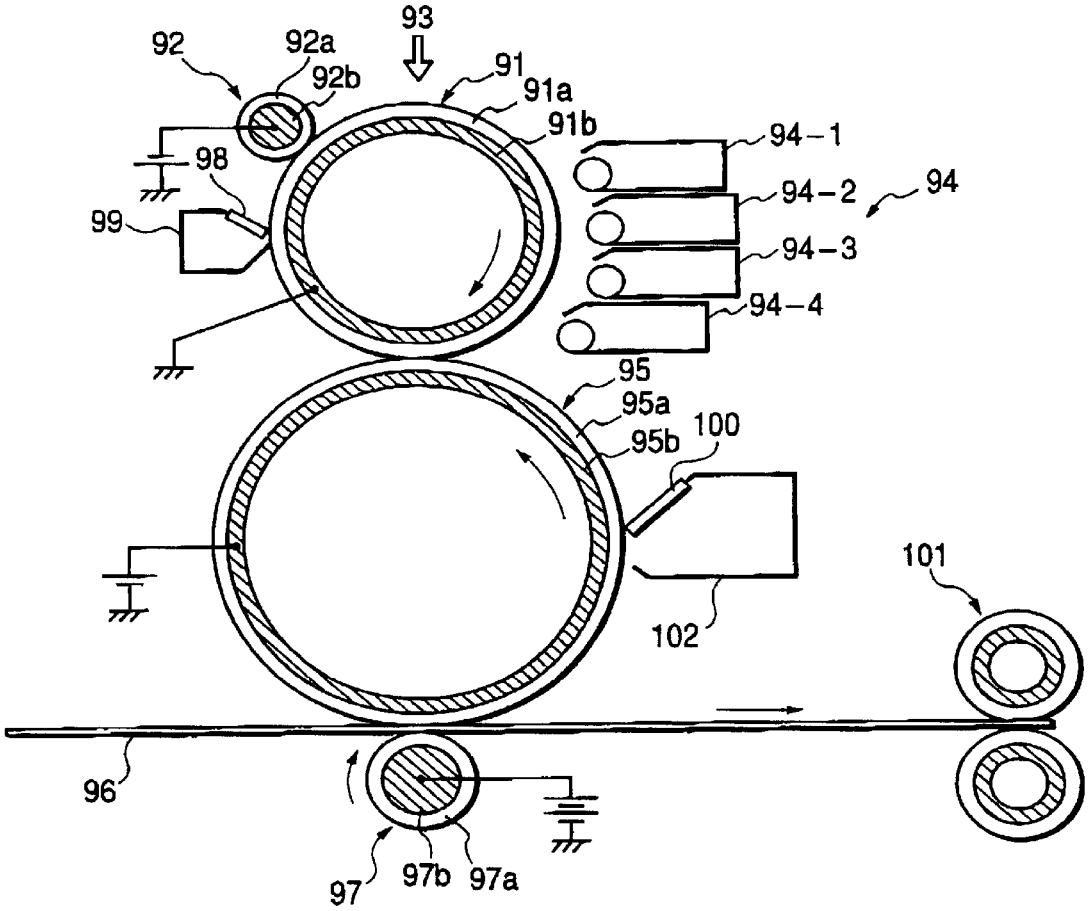
FIG. 5 is a schematic illustration showing still another image forming apparatus for embodying an image forming method of the present invention.

In the equipment system shown in FIG. 5, a cyan developer having cyan toner, a magenta developer having magenta toner, yellow developer having yellow toner and black developer having black toner are introduced in a cyan development device 94-1, a magenta development device 94-2, a yellow development device 94-3 and black development device 94-4, respectively. An electrostatic latent image is formed on a photosensitive member 91 as an electrostatic latent image holding member by a latent image forming means 93 such as a laser beam. The electrostatic image formed on the photosensitive member 91 is developed using these developers by development systems such as a magnetic brush development system, a non-magnetic non-component development system or a magnetic jumping development system, and a toner image of each color is formed on the photosensitive member 91. The photosensitive member 91 is a conductive substrate 91*b* and a photosensitive drum or a photosensitive belt having a photoconductive insulating material layer 91*a* such as amorphous selenium, cadmium sulfide, zinc oxide, organic photoconductor and amorphous silicon formed on the conductive substrate. The photosensitive member 91 is rotated in the direction of arrow by a drive unit not shown in the figure. As for the photosensitive member 91, photosensitive members having an amorphous silicon photosensitive layer or an organic photosensitive layer are preferably used.

The organic photosensitive layer may be a single layer type where the photosensitive layer contains in a single layer an electric charge generating material and a charge transporting material, or a function separation type layer having charge transporting layer and charge generating layer as its components. A laminated photosensitive layer which is configured by placing the charge generating layer on the conductive substrate and then the charge transporting layer thereon is one of preferable examples.

As for binding resin of the organic photosensitive layer, polycarbonate resin, polyester resin and acrylic resin are suitable in views of the cleaning property and are resistant to cleaning defectiveness, fusion of toner to the photosensitive member and filming of external additives.

In the charging process, the photosensitive member 91 using a corona charger includes a non-contact type system and a contact type system using contact charging members such as rollers, either of which is used. A contact type system as shown in FIG. 5 is preferably used for efficient uniform charging, simplification and low ozone generation.

A charging roller 92 as a primary charging member is configured basically by a central core bar 92*b* and a conductive elastic layer 92*a* forming the outer region thereof. The charging roller 92 is made to abut against the surface of the photosensitive member 91 by pressing force and rotates dependently with the rotation of the photosensitive member 91.

As for preferable process conditions when a charging roller is used, the abutting pressure of the roller ranges from 4.9 N/m to 490 N/m (from 5 g/cm to 500 g/cm), and when a roller with alternating current voltage superimposed on direct current voltage, the alternating voltage is 0.5 to 5 kVpp, the alternating frequency ranges from 50 Hz to 5,000 Hz, and the magnitude of the direct current voltage ranges from 0.2 kV to 5 kV.

Other contact charging members include those having a charging blade or a conductive brush. These contact charging members have the effect of eliminating needs for high voltage and reducing emissions of ozone.

The material of charging roller and charging biblade as the contact charging member is preferably conductive rubber, and a release coating may be provided on its surface. As for the release coating, nylon resin, PVDC (polyvinylidene fluoride), PVDC (polyvinylidene chloride) and fluoro-containing acrylic resin can be applied.

The toner image on the photosensitive member is transferred onto an intermediate transferring medium 95 to which voltage (for example, ranging from 0.1 kV to 5 kV in absolute value) is applied. The intermediate transferring medium 95 is configured by a pipe-like conductive core bar 95*b* and an elastic material layer 95*a* of medium resistance formed on the surface of its outer region. The core bar 95*b* may be configured by providing a conductive layer (for example, conductive plating) on the surface of plastics.

The elastic material layer 95*a* of medium resistance is a solid or foam layer configured by mixing and dispersing conductivity providing materials such as carbon black, zinc oxide, tin oxide and silicon carbide in elastic materials such as silicone rubber, Teflon rubber, chloroprene rubber, urethane rubber and EPDM (ethylene-propylene-diene ternary copolymer) and adjusting the electrical resistivity (volume resistivity) to medium resistance of $10^5$ to $10^{11}$ Ωcm.

The intermediate transferring medium 95 is placed such that it is borne in parallel to the photosensitive member 91 and is made to contact the lower face of the photosensitive member 91, and rotates in the direction of arrow at the same peripheral speed of the photosensitive member 91.

A first color toner image formed and carried on the surface of the photosensitive member 91 is intermediate-transferred in succession onto the outer face of the intermediate transferring medium 95 by an application transferring bias for the intermediate transferring medium 95 in the process of passing through the transferring pressed area where the photosensitive member 91 contacts the intermediate transferring medium 95.

Residual toner on the photosensitive member 91 which has not been transferred onto the intermediate transferring medium 95 is cleaned by a cleaning member 98 for photosensitive member and is then collected in a cleaning container 99 for photosensitive member.

A transferring means is placed such that it is borne in parallel to the intermediate transferring medium 95 and is made to contact the lower face of the intermediate transferring medium 95, and the transferring means 97 is for example a transferring roller or a transferring belt. The transferring means 97 may be placed such that it contacts the intermediate transferring medium 95 directly, and may be placed such that a belt, etc. contacts the intermediate transferring medium 95 and the transferring means 97 between them.

The transferring roller is configured basically by the central core bar 97*b* and the conductive elastic layer 97*a* forming the outer region of it.

For the intermediate transferring medium and the transferring roller, common materials can be used. By setting the volume resistivity of the elastic layer of the transferring roller to be lower than the volume resistivity of the elastic layer of the intermediate transferring medium, voltage applied to the transferring roller can be reduced, a satisfactory toner image can be formed on the transferring material, and the winding of the transferring material around the intermediate transferring medium can be prevented. Particularly, the volume resistivity of the elastic layer of the intermediate transferring medium is preferably more than ten times as high as the volume resistivity of the elastic layer of the transferring roller.

The hardness of the intermediate transferring medium and the transferring roller is measured in accordance with JIS K-6301. The intermediate transferring medium for use in the present invention is preferably configured by the elastic layer of which hardness is in the range of 10 to 40 degrees, while the hardness of elastic layer of the transferring roller is higher than the hardness of the elastic layer of the intermediate transferring medium, and is preferably in the range of 41 to 80 degrees for preventing the transferring material from winding around the intermediate transferring medium. If the values of hardness of the intermediate transferring medium and the transferring roller are inverted, recesses are formed on the transferring roller, and the transferring material is likely to wind around the intermediate transferring medium.

The transferring means 97 is rotated at the peripheral speed equal to or different from that of the intermediate transferring medium 95. The transferring material 96 is carried between the intermediate transferring medium 95 and the transferring means 97, and the toner image on the intermediate transferring medium 95 is transferred onto the surface of the transferring material 96 by applying a bias opposite in polarity to the frictional charge held by toner from the transferring bias means to the transferring means 97.

The residual toner on the intermediate transferring medium which has not been transferred onto the transferring material 96 is cleaned with a cleaning member 100 and is then collected in a cleaning container 102 for intermediate transferring medium. The toner image transferred onto the transferring material 96 is fixed to the transferring material 96 by heating fixation equipment 101.

As for the material of the transferring roller, same material as the charging roller can be used, and as for preferable process conditions, the abutting pressure of the roller ranges from 2.94 N/m to 490 N/m (from 0.3 kg/m to 50 kg/m), more preferably from 19.6 N/m to 294 N/m, and the magnitude of direct current voltage ranges from 0.2 kV to 10 kV in absolute value.

If the line pressure as abutting pressure is less than 2.94 N/m, carriage drift of transferring material and transfer defectiveness are likely to occur.

Figure 6:
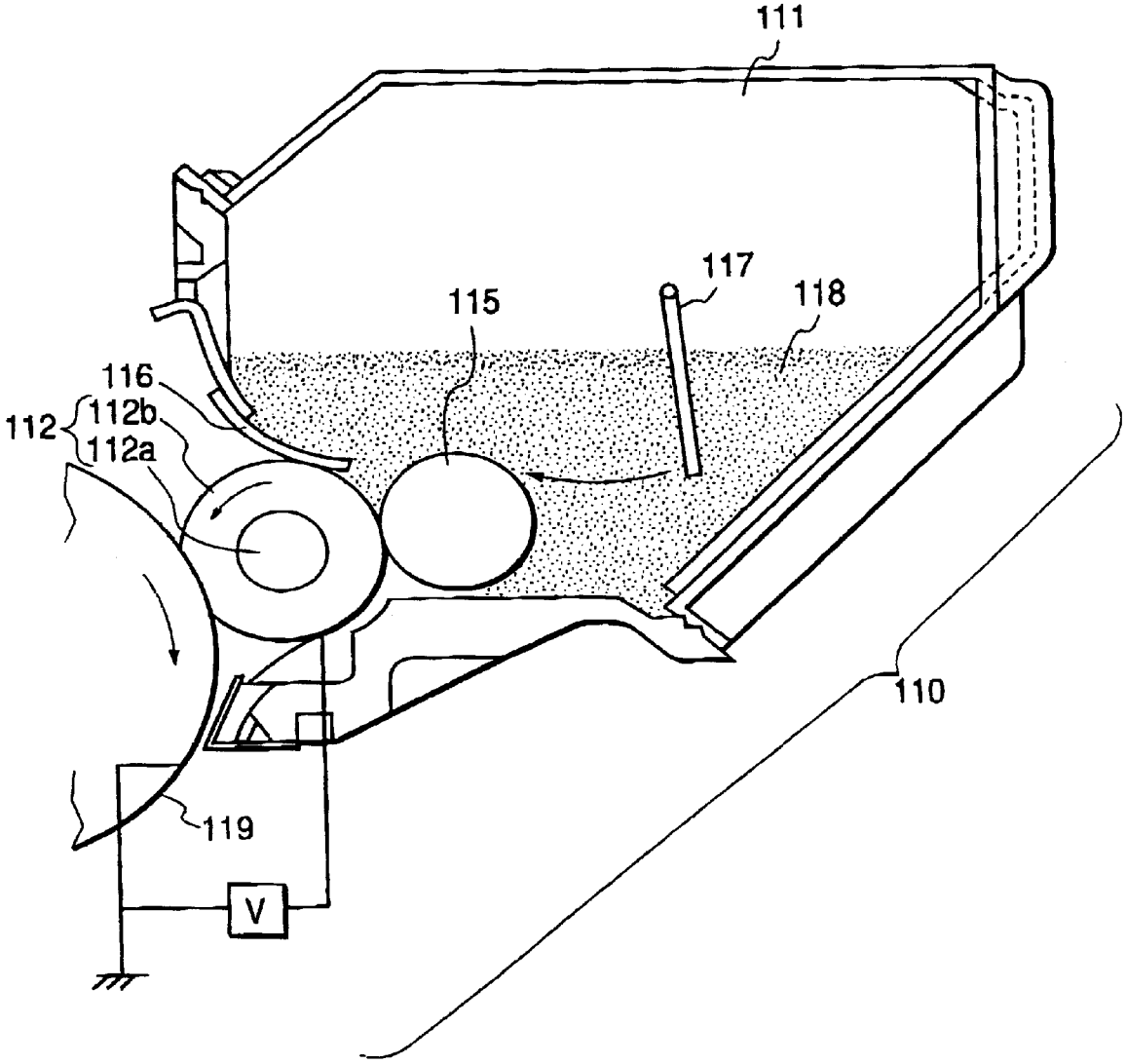
FIG. 6 is a schematic illustration showing still another image forming apparatus for embodying an image forming method of the present invention.

As for contact single component developing method, for example, a development device shown in FIG. 6 can be used to perform development using non-magnetic toner.

A development device 110 carries a development container 111 containing a single component developer 118 having the toner of the present invention, and the single component developer 118 contained in the development container 111, and has a developer carrier 112 for carrying the developer to the development region, a supply roller 115 for supplying the developer onto the developer carrier, an elastic blade 116 as a developer layer thickness control member for controlling the thickness of the developer layer on the developer carrier, and a stirring member 117 for stirring the developer 118 in the development container 111.

For the developer carrier 112, an elastic roller having an elastic layer 112*b* formed by an elastic member such as rubber having elasticity such as silicone rubber foam or resin on a roller substrate 112*a* is preferably used.

This elastic roller 112 abuts against the surface of the photosensitive drum 119 as an electrostatic image holding member to develop the electrostatic latent image formed on the photosensitive member with the single component developer 118 with which the surface of the elastic roller is coated, and collects the undesired single component developer 118 which exists on the photosensitive member after transferring.

In the contact single component development method, the developer carrier substantially contacts the surface of the photosensitive member This means that the developer carrier contacts the photosensitive member when the developer is removed from the developer carrier. At this time, an image free from edge effect is provided by an electric field acting between the photosensitive member and the developer carrier via the developer, and simultaneously cleaning is carried out. It is required that the surface of the elastic roller as the developer carrier or the vicinity thereof has an electric potential, and an electric field is held between the surface of the photosensitive member and the surface of the elastic roller. For this, the method in which the elastic rubber of the elastic roller is adjusted in resistance to within the range of medium resistance to prevent conduction with the surface of the photosensitive member, thereby maintaining the electric field, or the method in which a thin dielectric layer is provided on the surface layer of the conductive roller may be used. Furthermore, configurations by providing on the conductive roller an conductive resin sleeve with the side to contact the surface of the photosensitive member covered with insulating material, or an insulating sleeve with the side not to contact the photosensitive member provided with a conductive layer may also be used.

The elastic roller carrying the single component developer and the photosensitive drum may rotate either in the same direction or in the reverse direction. In the case where they rotate in the same direction, the peripheral speed of the elastic roller is preferably more than 100% (further preferably 103%) of that of the photosensitive drum. If it is 100% or less, problems concerning image quality such as impaired line definition are like to arise. The larger the difference in peripheral speed, the larger amount of developer is supplied to the development section and more frequently the developer is attached to and detached from the electrostatic latent image, and the developer is let fall from the unnecessary part and is added to the necessary part repeatedly, thereby providing images faithful to the electrostatic latent image.

If the developer layer thickness control member 116 abuts against the surface of the developer carrier 112 with elasticity, not only elastic blades but elastic rollers can be used.

For elastic blades and elastic rollers, elastic rubbers such as silicone rubber and urethane rubber and NBR, elastic synthetic resin such as polyethylene terephthalate, and elastic metals such as stainless and steel may be used. Furthermore, combinations thereof may also be used.

In case of elastic blades, the base part, which is the upper edge part of the elastic blade is fixed to the developer container to be held, and the lower edge part is bent against the elasticity of the blade in the normal or reverse direction of the development sleeve and the inside (the outside in case of reverse direction) of the blade is made to abut against the surface of the sleeve with appropriate elastic pressure.

The supply roller 115 which is composed of foam material such as polyurethane foam and rotates in the normal or reverse direction of the developer carrier at the relative speed other than zero, not only supplies the single component developer but strips off the developer on the developer carrier after development (unused developer).

When the static latent image is developed using the single component developer on the developer carrier in the development region, a direct and/or alternating current development bias is preferably applied between the developer carrier and the photosensitive drum to perform development.

Figure 7:
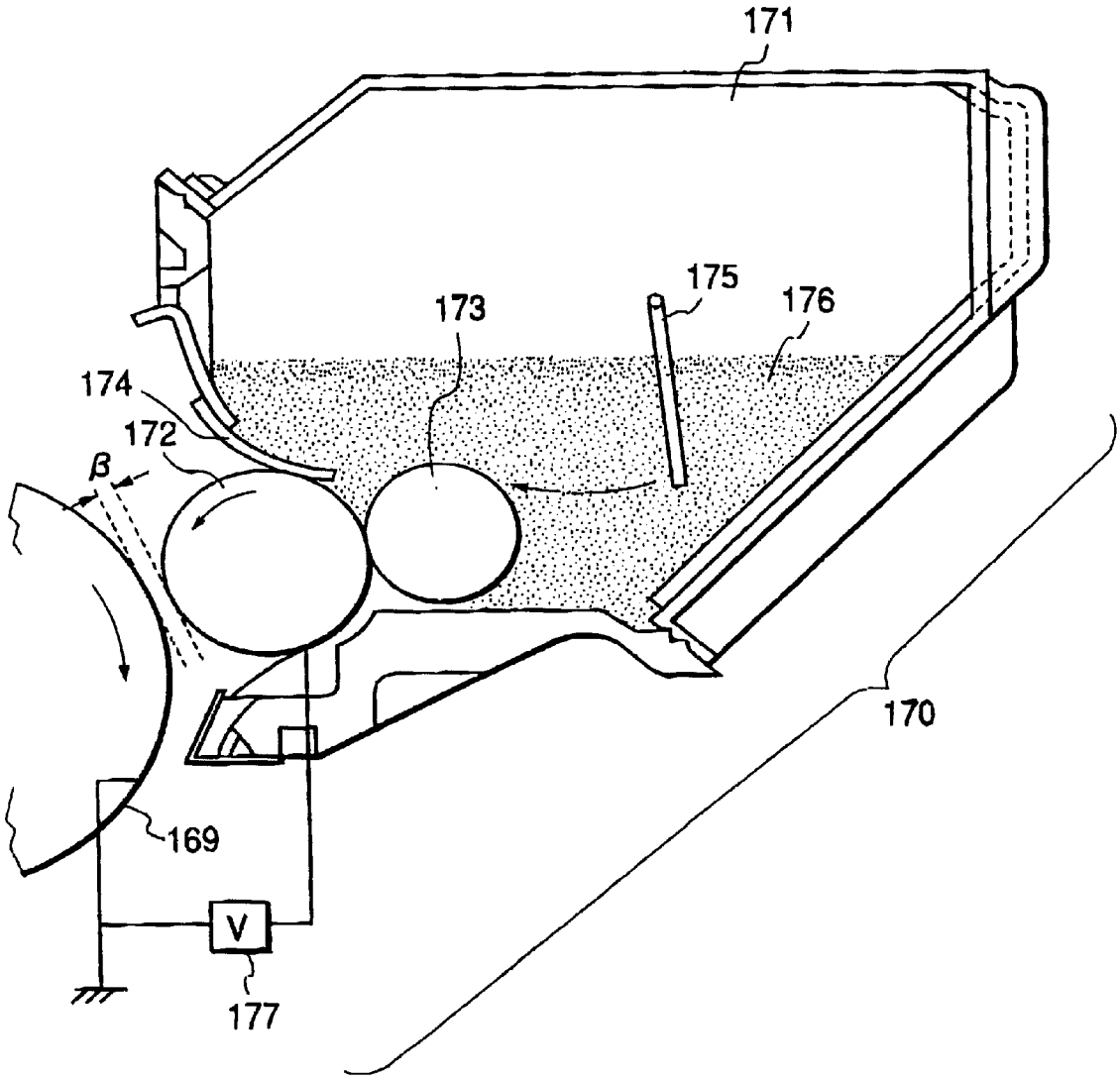
FIG. 7 is a schematic illustration showing still another image forming apparatus for embodying an image forming method of the present invention.

A non-contact jumping development system using a single component non-magnetic developer will be now described based on a schematic block diagram shown in FIG. 7.

A development device 170 carries a development container 171 containing a non-magnetic single component developer 176 having non-magnetic toner, and the non-magnetic single component developer 176 contained in the development container 171, and has a developer carrier 172 for carrying the developer to the development region, a supply roller 173 for supplying the non-magnetic single component developer onto the developer carrier, an elastic blade 174 as a developer layer thickness control member for controlling the thickness of the developer layer on the developer carrier, and a stirring member 175 for stirring the non-magnetic single component developer 176 in the development container 171.

Reference numeral 169 is an electrostatic image holding member, and latent image formation is performed by an electrophotography process means or an electrostatic recording means not shown in the figure. 172 is a development sleeve such as a developer carrier, and its composed of a non-magnetic sleeve made from aluminum or stainless steel.

For the development sleeve, a crude pipe of aluminum or stainless steel may be used as it is, but a pipe with a surface that is sprayed with glass beads and is uniformly roughed, that is treated with a mirror finish, or that is covered with resin, is preferable.

The non-magnetic single component developer 176 is stored in the developer container 171 and is supplied by the supply roller 173 onto the developer carrier 172. The supply roller 173 which is composed of foam material such as polyurethane foam and rotates in the normal or reverse direction of the developer carrier at the relative speed other than zero, not only supplies the developer but strips off the developer on the developer carrier 172 after development (unused developer). The non-magnetic single component developer supplied onto the developer carrier 172 is applied uniformly and lightly by the elastic blade 174 as a developer layer thickness control member.

The pressure from the elastic coating blade and the developer carrier abutting against each other ranges from 2.94 to 245 N/m (from 0.3 to 25 kg/m) as line pressure in the direction of the bus line of the development sleeve, and preferably from 4.90 to 118 N/m (from 0.5 to 12 kg/m)). If the contact pressure is less than 2.94 N/m, it is difficult to apply the non-magnetic single component developer and the distribution of the amount of electrostatic charge on the non-magnetic single component developer becomes broad, thus causing fogging and scatter. If the contact pressure is more than 245 N/m, the non-magnetic single component developer receives high pressure and the developer is deteriorated, thus causing among other things the cohesiveness of the developer, which is not preferable. Furthermore, high torque is required for driving the developer carrier, which is not preferable. That is, by adjusting contact pressure to within the range of 2.94 to 245 N/m, the cohesiveness of the non-magnetic single component developer using the toner of the present invention can be loosened effectively, and also the electric charge of the non-magnetic single component developer can be activated instantaneously.

For the developer layer thickness control member, the elastic blade and the elastic roller can be used, and frictional charging type materials suitable for charging the developer into desired polarity are preferably used for these members.

In the present invention, preferable are silicone rubber, urethane rubber and styrene butadiene rubber. Furthermore, organic resin layers such as polyamide, polyimide, nylon, melamine, melamine cross-linked nylon, phenol resin, fluorine contained resin, silicone resin, polyester resin, urethane resin and styrene resin may also be provided. Furthermore, when fillers and charge control agents such as metal oxide, carbon black, inorganic whisker and inorganic fiber are dispersed in a conductive rubber layer or resin, moderate level conductivity and charge providing property can be obtained, and the non-magnetic single component developer can be moderately charged, which is preferable.

In the system of applying the non-magnetic single component developer lightly on the development sleeve by the blade in this non-magnetic single component development method, in order to obtain adequate image density, preferably the thickness of the developer layer on the development sleeve is smaller than a gap $\beta$ between the development sleeve and the electrostatic image carrier, and an alternating electric field is applied to this gap. That is, by applying an alternating electric field or a development bias with a direct current electric field on the alternating electric field to the gap between the development sleeve 172 and the electrostatic image carrier 169 by a bias supply shown in FIG. 7, the travel of the non-magnetic single component developer from the development sleeve to the electrostatic image carrier is facilitated, and still better quality images can be obtained.

EXAMPLES

The present invention will be described more concretely by Production Examples and Examples, which by no means limit the present invention. "Part(s)" described in Examples means "part(s) by weight" in all cases.

Toner Production Example 1

A master batch dispersion was prepared by milling 100 parts of styrene monomer, 20 parts of carbon black (1) (average primary particle diameter: 32 nm, pH: 9.1, specific surface area: 64 $m^2/g$, volatile matter: 0.4%, DBP oil absorption: 41 ml/100 g, toluene extraction: 0.02%, residue on slave: 32 ppm, and bulk density: 400 g/l), 1.0 part of an azo-based iron compound (1) shown below, 2.0 parts of an aluminum compound of di-t-butylsalicyllc acid, and 0.07 parts of potassium carbonate by an attritor (Mitui Mining) with zirconia beads (2 mm in diameter) under the conditions of 200 rpm, 25° C. and 180 min.

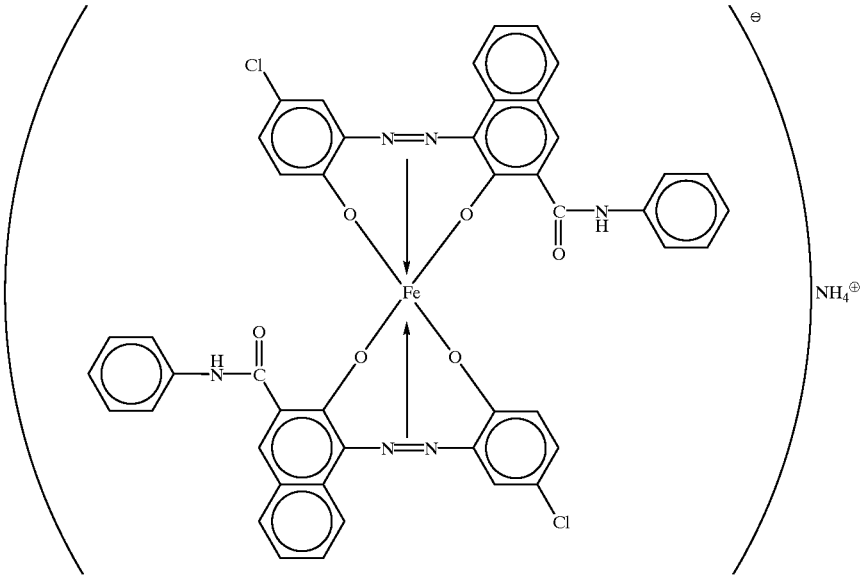

A mixture of 710 parts of ion-exchanged water and 450 parts of a 0.1 mol/l aqueous solution of $Na_3PO_4$ was heated to 60° C. and agitated by a clear mixer (manufactured by Emtechnik Company) at 12,000 rpm, to which 68 parts of a 1.0 mol/l aqueous solution of $CaCl_2$ was slowly added, to prepare an aqueous medium containing calcium phosphate compound.

Next, a mixture of

| | |
|---|---|
| master batch dispersion | 123 parts |
| styrene monomer | 66 parts |
| n-butyl acrylate monomer | 34 parts |
| ester wax (total carbon number: 36) | 25 parts |
| saturated polyester resin (Mw: 12,000, Mw/Mn: 2.0, Tg: 70° C., acid value: 11.0, and hydroxyl value: 23.0) | 10 parts |
| unsaturated polyester resin (Mw: 17,000, Mw/Mn: 4.5, Tg: 54° C., acid value: 19.9, and hydroxyl value: 7.5) | 0.5 parts |
| divinyl benzene | 0.3 parts |

was heated to 60° C. to agitate uniformly dissolve and disperse the solutes, in which 5 parts of 2,2'-azobis(2,4-dimethylvaleronitrile) as a polymerization initiator was dissolved, to prepare a polymerizable monomer composition.

The above polymerizable monomer composition was added into the above aqueous medium, kept at pH 6, and the mixture was agitated by a clear mixer (manufactured by Emtechnik Company) at 60° C., 10,000 rpm in a nitrogen atmosphere for 10 min., to granulate the polymerizable monomer composition. It was then transferred to a reactor, where it was agitated by a paddle agitating element with the aqueous medium kept at pH 6, and heated to 60° C., at which the monomers are polymerized for 5 hours. A water-soluble initiator was added to the reaction system, which was heated at 80° C. for 5 hours, for further polymerization. On completion of the polymerization, the effluent was distilled under a vacuum to remove the residual monomers, and cooled. The effluent was treated with hydrochloric acid, to dissolve the calcium phosphate compound, and filtered, washed with water, dried under a vacuum, and classified by a multi-division classifier, to prepare black toner particles.

The above black toner particles (100 parts) were mixed with 0.7 parts of hydrophobic titanium oxide (specific surface area: 98 $M^2/g$, determined by the BET method) and 0.7 parts of hydrophobic silica (specific surface area: 43 $m^2/g$, determined by the BET method) by a Henschel mixer, and the mixture was treated by a turbo screener to remove the coarse particles, to prepare a non-magnetic black toner 1 having a weight-average particle diameter of 7.9 $\mu$m (4 $\mu$m or less: 6% by number, and 12.7 $\mu$m or more: 1.5% by volume). It contained potassium at 113 ppm, and had following properties, tan $\delta$ ($5\times10^4$ Hz): 0.00736 and tan $\delta$ ($10^5$ Hz): 0.00548, as determined by measurement of dielectric constant, Carr's flowability index: 75, Carr's floodability index: 85, and contact angle with water: 129°.

Toner Production Example 2

A master batch dispersion was prepared by milling 100 parts of styrene monomer, 20 parts of carbon black (1), 10 parts of a saturated polyester resin(Mw: 12,000, Mw/Mn: 2.0, Tg: 70° C., acid value: 11.0, and hydroxyl value: 23.0), 0.5 parts of an unsaturated polyester resin (Mw: 17,000, Mw/Mn: 4.5, Tg: 54° C., acid value: 19.9, and hydroxyl value: 7.5), 1.0 part of the azo-based iron compound (1), 2.0 parts of an aluminum compound of di-t-butylsalicylic acid, and 0.07 parts of potassium carbonate by an attritor (Mitui Mining) with zirconia beads (2 mm in diameter) under the conditions of 200 rpm, 25° C. and 180 min.

A mixture of 710 parts of ion-exchanged water and 450 parts of a 0.1 mol/l aqueous solution of $Na_3PO_4$ was heated to 60° C. and agitated by a clear mixer (manufactured by Emtecnnk Company) at 12,000 rpm, to which 68 parts of a 1.0 mol/l aqueous solution of $CaCl_2$ was slowly added, to prepare an aqueous medium containing calcium phosphate compound.

Next, a mixture of

| | |
|---|---|
| master batch dispersion | 136 parts |
| styrene monomer | 66 parts |
| n-butyl acrylate monomer | 34 parts |
| ester wax (total carbon number: 36) | 25 parts |
| divinyl benzene | 0.3 parts |

was heated to 60° C. to agitate uniformly dissolve and disperse the solutes, in which 5 parts of 2,2'-azobis(2,4-dimethylvaleronitrile) as a polymerization initiator was dissolved, to prepare a polymerizable monomer composition. The same procedure as used for Toner Production Example 1 was repeated, except the above, to prepare black toner particles.

The above black toner particles (100 parts) were mixed with 0.7 parts of hydrophobic titanium oxide (specific surface area: 98 $m^2/g$, determined by the BET method) and 0.7 parts of hydrophobic silica (specific surface area: 43 $m^2/g$, determined by the BET method) by a Henschel mixer, and the mixture was treated by a turbo screener to remove the coarse particles, to prepare a non-magnetic black toner 2 having a weight-average particle diameter of 7.9 μm (4 μm or less: 8% by number, and 12.7 μm or more: 1.9% by volume). It contained potassium at 125 ppm, and had following properties, tan δ ($5\times10^4$ Hz): 0.00701 and tan δ ($10^5$ Hz): 0.00517, as determined by measurement of dielectric constant, Carr's flowability index: 72, and Carr's floodability index: 82.

Toner Production Comparative Example 1

The same procedure as that for Toner Production Example 1 was repeated, except potassium carbonate was not used, to prepare a comparative, non-magnetic black toner 1 having a weight-average particle diameter of 7.9 μm.

Toner Production Comparative Example 2

The same procedure as that for Toner Production Example 2 was repeated, except potassium carbonate was not used, to prepare a comparative, non-magnetic black toner 2 having a weight-average particle diameter of 7.8 μm.

Toner Production Example 3

The same procedure as that for Toner Production Example 1 was repeated, except quantity of potassium carbonate was changed to 0.011 parts, to prepare a non-magnetic black toner 3 having a weight-average particle diameter of 7.6 μm. It contained potassium at 14 ppm.

Toner Production Comparative Example 3

The same procedure as that for Toner Production Example 1 was repeated, except quantity of potassium carbonate was changed to 0.006 parts, to prepare a comparative, non-magnetic black toner 3 having a weight-average particle diameter of 7.7 μm. It contained potassium at 5.5 ppm.

Toner Production Example 4

The same procedure as that for Toner Production Example 1 was repeated, except quantity of potassium carbonate was changed to 0.10 parts, to prepare a non-magnetic black toner 4 having a weight-average particle diameter of 7.7 μm. It contained potassium at 190 ppm.

Toner Production Comparative Example 4

The same procedure as that for Toner Production Example 1 was repeated, except quantity of potassium carbonate was changed to 0.14 parts, to prepare a comparative, non-magnetic black toner 4 having a weight-average particle diameter of 7.7 μm. It contained potassium at 240 ppm.

Toner Production Example 5

The same procedure as that for Toner Production Example 1 was repeated, except the azo-based iron compound was not used and the aluminum compound of di-t-butylsalicylic acid was replaced by a zinc compound of di-t-butylsalicylic acid, to prepare a non-magnetic black toner 5 having a weight-average particle diameter of 7.8 μm Toner Production Example 6

The same procedure as that for Toner Production Example 1 was repeated, except the azo-based iron compound was not used and the aluminum compound of di-t-butylsalicylic acid was replaced by a chromium compound of di-t-butylsalicylic acid, to prepare a non-magnetic black toner 6 having a weight-average particle diameter of 7.8 μm.

Toner Production Example 7

The same procedure as that for Toner Production Example 1 was repeated, except the azo-based iron compound was not used and the aluminum compound of di-t-butylsalicylic acid was replaced by a zirconium compound of di-t-butylsalicylic acid, to prepare a non-magnetic black toner 7 having a weight-average particle diameter of 7.8 μm.

Toner Production Example 8

The same procedure as that for Toner Production Example 1 was repeated, except the azo-based iron compound was not used and the aluminum compound of di-t-butylsalicylic acid was replaced by a boron compound of benzilic acid, to prepare a non-magnetic black toner 8 having a weight-average particle diameter of 7.8 μm.

Toner Production Comparative Example 5

The same procedure as that for Toner Production Example 1 was repeated, except the azo-based iron compound was not used and the aluminum compound of di-t-butylsalicylic acid was replaced by a cobalt compound of di-t-butylsalicylic acid, to prepare a comparative, non-magnetic black toner 5 having a weight-average particle diameter of 7.9 μm.

Toner Production Comparative Example 6

The same procedure as that for Toner Production Example 1 was repeated, except the organometallic compound was not used, to prepare a comparative, non-magnetic black toner 6 having a weight-average particle diameter of 7.8 μm.

Toner Production Example 9

The same procedure as that for Toner Production Example 1 was repeated, except quantity of the 0.1 mol/l aqueous solution of $Na_3PO_4$ was changed to 530 parts, rotational speed of the clear mixer was changed to 12,000 rpm, and classification conditions at the multi-stage, divided type classifier were changed, to prepare a non-magnetic black toner 9 having a weight-average particle diameter of 5.4 μm (4 μm or less: 23% by number, and 12.7 μm or more: 0% by volume).

Toner Production Example 10

The same procedure as that for Toner Production Example 1 was repeated, except quantity of the 0.1 mol/l aqueous solution of $Na_3PO_4$ was changed to 280 parts, rotational speed of the clear mixer was changed to 5,550 rpm, and classification conditions at the multi-stage, divided type classifier were changed, to prepare a non-magnetic black toner 10 having a weight-average particle diameter of 9.5 μm (4 μm or less: 3% by number, and 12.7 μm or more: 2.7% by volume).

Toner Production Comparative Example 7

The same procedure as that for Toner Production Example 1 was repeated, except quantity of the 0.1 mol/l aqueous solution of $Na_3PO_4$ was changed to 600 parts, rotational speed of the clear mixer was changed to 13,000 rpm, and classification conditions at the multi-stage, divided type classifier were changed, to prepare a comparative, non-magnetic black toner 7 having a weight-average particle diameter of 3.9 μm (4 μm or less: 29% by number, and 12.7 μm or more; 0% by volume).

Toner Production Comparative Example 8

The same procedure as that for Toner Production Example 1 was repeated, except quantity of the 0.1 mol/l aqueous solution of $Na_3PO_4$ was changed to 190 parts, rotational speed of the clear mixer was changed to 4,300 rpm, and classification conditions at the multi-division classifier were changed, to prepare a comparative, non-magnetic black toner 8 having a weight-average particle diameter of 11.5 μm (4 μm or less: 2.7% by number, and 12.7 μm or more: 2.7% by volume).

Toner Production Example 11

The same procedure as that for Toner Production Example 1 was repeated, except the conditions of milling by the attritor for preparation of the master batch dispersion were changed to 150 rpm, 25° C. and 120 min., and quantities of carbon black and potassium carbonate were changed to 30 and 0.018 parts, respectively, to prepare a non-magnetic black toner 11 having a weight-average particle diameter of 7.3 μm. It had a tan δ ($5\times10^4$ Hz) of 0.0115 and tan δ ($10^5$ Hz) of 0.0102, as determined by measurement of dielectric constant.

Toner Production Comparative Example 9

The same procedure as that for Toner Production Example 1 was repeated, except the conditions of milling by the attritor for preparation of the master batch dispersion were changed to 80 rpm, 25° C. and 40 min., and quantities of carbon black and potassium carbonate were changed to 32 and 0.012 parts, respectively, to prepare a comparative, non-magnetic black toner 9 having a weight-average particle diameter of 7.1 μm. It had a tan δ ($5\times10^4$ Hz) of 0.0131 and tan δ ($10^5$ Hz) of 0.0111, as determined by measurement of dielectric constant.

Toner Production Example 12

The same procedure as that for Toner Production Example 1 was repeated, except the classification conditions were changed to prepare toner particles having an average diameter of 6.5 μm, and quantities of the hydrophobic titanium oxide and hydrophobic silica to be mixed with the black toner particles were changed to 0.3 and 0.3 parts, respectively, to prepare a non-magnetic black toner 12. It had a Carr's flowability index of 55 and Carr's floodability index of 70.

Toner Production Comparative Example 10

The same procedure as that for Toner Production Example 1 was repeated, except the classification conditions were changed to prepare toner particles having an average diameter of 6.2 μm, and quantities of the hydrophobic titanium oxide and hydrophobic silica to be mixed with the toner particles were changed to 0.2 and 0.2 parts, respectively, to prepare a comparative, non-magnetic black toner 10. It had a Carr's flowability index of 48 and Carr's floodability index of 60.

Toner Production Example 13

The same procedure as that for Toner Production Example 1 was repeated, except potassium carbonate was replaced by 0.09 g parts of sodium carbonate, to prepare a non-magnetic black toner 13 having a weight-average particle diameter of 7.8 μm.

Toner Production Example 14

The same procedure as that for Toner Production Example 1 was repeated, except the carbon black (1) was replaced by carbon black (20) containing potassium at 300 ppm, produced by burning the stock oil incorporated with an aqueous solution of potassium carbonate, and potassium carbonate was not added separately, to prepare a non-magnetic black toner 14 having a weight-average particle diameter of 7.7 μm. It contained potassium at 100 ppm.

Toner Production Comparative Example 11

The same procedure as that for Toner Production Example 14 was repeated, except the carbon black (20) was replaced by carbon black (21) containing potassium at 1100 ppm, to prepare a comparative, non-magnetic black toner 11 having a weight-average particle diameter of 7.8 μm. It contained potassium at 230 ppm.

Toner Production Comparative Example 12

The ssme procedure as that for Toner Production Example 14 was repeated, except the carbon black (20) was replaced by carbon black (22) containing potassium at 30 ppm, to prepare a comparative, non-magnetic black toner 12 having a weight-average particle diameter of 7.7 μm. It contained potassium at 7 ppm.

Toner Production Example 15

The same procedure as that for Toner Production Example 1 was repeated, except the saturated and unsaturated polyester resins were replaced by a saturated polyester resin having an acid value of 4.0 and hydroxyl value of 9.0 and unsaturated polyester resin having an acid value of 3.0 and hydroxyl value of 8.0, to prepare a non-magnetic black toner 15 having a weight-average particle diameter of 7.8 μm.

Toner Production Example 16

The same procedure as that for Toner Production Example 1 was repeated, except the saturated and unsaturated polyester resins were replaced by a saturated polyester resin having an acid value of 33.0 and hydroxyl value of 42.0 and unsaturated polyester resin having an acid value of 31.0 and hydroxyl value of 41.0, to prepare a non-magnetic black toner 16 having a weight-average particle diameter of 7.8 μm.

Toner Production Example 17

The same procedure as that for Toner Production Example 1 was repeated, except the hydrophobic silicon oxide was replaced by the one not hydrophoqized, to prepare a non-magnetic black toner 17 having a weight-average particle diameter of 7.8 μm. It had a contact angle of 105° with water.

Toner Production Examples 18 to 35

The same procedure as that for Toner Production Example 1 was repeated, except the carbon black (1) was replaced by carbon black (2) to (19), shown in Table 3, to prepare non-magnetic black toners 18 to 35.

Toner Production Example 36

The same procedure as that for Toner Production Example 1 was repeated, except quantities of the organometallic compound and alkali metal element to be added to the non-magnetic black toner were changed, to prepare a non-magnetic black toner 36. It contained the organometalllc compound and alkali metal element at 4.48 wt. % and 21 ppm, respectively.

Toner Production Example 37

The same procedure as that for Toner Production Example 1 was repeated, except quantities of the organometallic compound and alkali metal element to be added to the non-magnetic black toner were changed, to prepare a non-magnetic black toner 37. It contained the organometallic compound and alkali metal element at 2.97 wt. % and 21 ppm, respectively.

Toner Production Example 38

The same procedure as that for Toner Production Example 1 was repeated, except the azo-based iron compound was not used, to prepare a non-magnetic black toner 38 having a weight-average particle diameter of 7.8 μm.

Toner Production Example 39

The same procedure as that for Toner Production Example 1 was repeated, except the unsaturated polyester was not used, to prepare a non-magnetic black toner 39 having a weight-average particle diameter of 7.9 μm.

Toner Production Examples 40 to 42

The same procedure as that for Toner Production Example 1 was repeated, except neither the unsaturated polyester nor potassium carbonate was used, and the carbon black was replaced by 16 parts of a quinacridon pigment, to prepare a magenta toner 40. Similarly, it was replaced by 13 parts of a phthalocyanine pigment to prepare a cyan toner 41, and by 16 parts of pigment yellow 93 to prepare a yellow toner 42.

Toner Production Example 43

The following compounds

| | |
|---|---|
| polyoxypropylene(2,2)-2,2-bis(4-hydroxyphenyl)propane | 15 mol % |
| polyoxyethylene(2,2)-2,2-bis(4-hydroxyphenyl)propane | 34 mol % |
| terephthalic acid | 1.5 mol % |
| fumaric acid | 36 mol % |
| trimellitic acid | 0.1 mol % |

were condensed/polymerized in a four-necked flask, equipped with a reflux condenser, water separator, nitrogen gas charging tube, thermometer and agitator in a nitrogen atmosphere, to prepare a polyester resin (A), having an acid value of 10.5 mgKOH/g, Tg of 56° C., Mn of 4,000, and Mw of 10,500.

The above polyester resin (A) (100 parts), 6 parts of the carbon black (1), 5 parts of an aluminum compound of di-t-butylsalicylic acid, 2 parts of an ester wax (total carbon number: 36), and 0.02 parts of potassium carbonate were preliminarily mixed by a 75E Henschel mixer at 1,800 rpm for 8 min, and the molten mixture was kneaded by a twin-screw extruder kept at 120° C. It was cooled, crushed by a hammer mill into coarse particles of about 1 to 2 mm in diameter, and milled by an air-jet type mill into fine particles of 40 μm or less in diameter. The fine particles were then classified into black toner particles.

The above black toner particles (100 parts) were mixed with 1.1 parts of hydrophobic titanium oxide (specific surface area; 98 $m^2/g$, determined by the BET method) and 0.2 parts of strontium titanate (weight-average particle diameter: 0.7 μm) by a Henschel mixer, and the mixture was treated by a turbo screener to remove the coarse particles, to prepare a non-magnetic black toner 44 having a weight-average particle diameter of 7.7 μm. It contained potassium at 130 ppm, and had following properties, tan δ ($5\times10^4$ Hz); 0.00528 and tan δ ($10^5$ Hz): 0.00618, as determined by measurement of dielectric constant, Carrts flowability index: 83, Carr's floodability index: 90, and contact angle with water: 128°.

Toner Production Comparative Example 13

The same procedure as that for Toner Production Example 43 was repeated, except potassium carbonate was not used, to prepare a comparative, non-magnetic black toner 13 having a weight-average particle diameter of 7.7 μm.

Toner Production Example 44

The same procedure as that for Toner Production Example 43 was repeated, except quantity of potassium carbonate was changed to 0.611 parts, to prepare a non-magnetic black toner 44 having a weight-average particle diameter of 7.8 μm. It contained potassium at 14.2 ppm.

Toner Production Comparative Example 14

The same procedure as that for Toner Production Example 43 was repeated, except quantity of potassium carbonate was changed to 0.004 parts, to prepare a comparative, non-magnetic black toner 14 having a weight-average particle diameter of 7.7 μm. It contained potassium at 5.1 ppm.

Toner Production Example 45

The same procedure as that for Toner Production Example 43 was repeated, except quantity of potassium carbonate was changed to 0.09 parts, to prepare a non-magnetic black toner 45 having a weight-average particle diameter of 7.8 μm. It contained potassium at 198 ppm.

Toner Production Comparative Example 15

The same procedure as that for Toner Production Example 43 was repeated, except quantity of potassium carbonate was changed to 0.12 parts, to prepare a comparative, non-magnetic black toner 15 having a weight-average particle diameter of 7.7 μm. It contained potassium at 290 ppm.

Toner Production Comparative Example 16

The same procedure as that for Toner Production Example 43 was repeated, except the organometallic compound was not used, to prepare a comparative, non-magnetic black toner 16 having a weight-average particle diameter of 7.8 μm.

Toner Production Example 46

The same procedure as that for Toner Production Example 43 was repeated, except the milling conditions and classification conditions at the multi-division classifier were changed, to prepare a non-magnetic black toner 46 having a weight-average particle diameter of 5.4 μm (4 μm or less: 24% by number, and 12.7 μm or more: 0% by volume).

Toner Production Example 47

The same procedure as that for Toner Production Example 43 was repeated, except the milling conditions and classification conditions at the multi-division classifier were changed, to prepare a non-magnetic black toner 47 having a weight-average particle diameter of 9.5 μm (4 μm or less: 4.5% by number, and 12.7 μm or more: 2.4% by volume).

Toner Production Example 48

The same procedure as that for Toner Production Example 43 was repeated, except rotation time for the preliminary mixing was changed to 1 min, and quantities of the carbon black and potassium were changed to 7 and 0.01 parts, respectively, to prepare a non-magnetic black toner 48 having a weight-average particle diameter of 7.7 μm. It had a tan δ ($5\times10^4$ Hz) of 0.0102 and tan δ ($10^5$ Hz) of 0.0104, as determined by measurement of dielectric constant.

Toner Production Comparative Example 17

The same procedure as that for Toner Production Example 43 was repeated, except rotation time for the preliminary mixing was changed to 0.5 min, and quantities of the carbon black and potassium were changed to 8 and 0.008 parts, respectively, to prepare a comparative, non-magnetic black toner 17 having a weight-average particle diameter of 7.8 μm. It had a tan δ ($5\times10^4$ Hz) of 0.0134 and tan δ ($10^5$ Hz) of 0.0155, as determined by measurement of dielectric constant.

Toner Production Example 49

The same procedure as that for Toner Production Example 43 was repeated, except the classification conditions were changed to prepare toner particles having an average diameter of 6.5 μm, and quantity of the hydrophobic titanium oxide to be mixed with the toner particles was changed to 0.3 parts, to prepare a non-magnetic black toner 49. It had a Carr's flowability index of 57 and Carr's floodability index of 72.

Toner Production Comparative Example 18

The same procedure as that for Toner Production Example 43 was repeated, except the classification conditions were changed to prepare toner particles having an average diameter of 6.2 μm, and quantity of the hydrophobic titanium oxide to be mixed with the toner particles was changed to 0.2 parts, to prepare a comparative, non-magnetic black toner 18. It had a Carr's flowability index of 49 and Carr's floodability index of 63.

Toner Production Example 50

The same procedure as that for Toner Production Example 43 was repeated, except the carbon black (1) was replaced by carbon black (20) containing potassium at 300 ppm, produced by burning the stock oil incorporated with an aqueous solution of potassium carbonate, to prepare a non-magnetic black toner 50 having a weight-average particle diameter of 7.7 μm. It contained potassium at 65 ppm.

Toner Production Comparative Example 19

The same procedure as that for Toner Production Example 43 was repeated, except the milling conditions and classification conditions at the multi-division classification were changed, to prepare a comparative, non-magnetic black toner 19 having a weight-average particle diameter of 3.4 μm (4 μm or less: 29% by number, and 12.7 μm or more: 0% by volume).

Toner Production Comparative Example 20

The same procedure as that for Toner Production Example 43 was repeated, except the milling conditions and classification conditions at the multi-division classifier were changed, to prepare a comparative, non-magnetic black toner 20 having a weight-average particle diameter of 11.4 μm (4 μm or less: 2.8% by number, and 12.7 μm or more: 2.9% by volume).

The properties of the toners prepared by Examples and Comparative Examples are summarized in Tables 4 to 9.

Next, the carrier production examples are described.

Magnetic Carrier Production Example 1

The following compounds

| | |
|---|---|
| phenol | 50 parts |
| 37 wt. % aqueous solution of formalin | 80 parts |
| water | 50 parts |
| fine particles of alumina-containing magnetite (number average particle diameter: 0.24 μm, and specific resistivity: $5 \times 10^5$ Ωcm), surface-treated with a silane-based coupling agent having epoxy group (Shin-Etu Chemical, KBM403) | 280 parts |
| $\alpha$-$Fe_2O_3$ fine particles which is surface-treated by KBM403 (number average particle diameter: 0.40 μm, and specific resistivity: $8 \times 10^9$ Ω · cm) | 120 parts |
| 25 wt. % ammonia water | 15 parts |

were put in a four-necked flask, heated with agitation and mixing to 85° C. in 60 min, at which they were reacted for 120 min with each other and hardened. Then, 500 parts of water was added to the effluent after it was cooled to 30° C., the supernatant liquor was removed, and the precipitates were washed with water and dried by air. The precipitates were then dried at 150 to 180° C. under a vacuum (5 mmHg) for 24 hours, to prepare a magnetic carrier core (A) with phenolic resin as the binder resin. The magnetic carrier core (A) held 0.4 wt. % of adsorbed water, after it was allowed to stand at 30° C. and 80% RH for 24 hours.

The magnetic carrier core (A) was coated with a 5 wt. % toluene solution of γ-aminopropyltrimethoxysilane, shown by the following formula:

$$NH_2—CH_2CH_2CH_2—Si(OCH_3)_3$$

A shear stress was continuously applied to the magnetic carrier core (A), while it was coated, to evaporate toluene during the coating process.

It was confirmed that the coated magnetic carrier core (A) had 0.2 wt. % of the following structure on the surface:

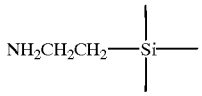

The magnetic carrier core (A) treated with the silane coupling agent was coated with a resin at 70° C. with agitation under a vacuum in the vessel in which the magnetic carrier core (A) was treated with the toluene solution, where the coating resin was of silicone resin (Shin-Etu Chemicals KR-221) incorporated with 3% (based on the silicone resin solid) of γ-aminopropyltrimethoxysilane and diluted with toluene to 20% as silicone resin solid content. Then, the treated magnetic carrier core (A) was agitated for 2 hours, thermally treated at 140° C. for 2 hours in a nitrogen gas atmosphere, and passed through a 200-mesh sieve (aperture: 77 μm), after it was treated to break the agglomerated particles, to remove the coarse particles and to prepare a magnetic carrier I.

The magnetic carrier I had a volume-average 50% particle diameter of 35 μm, electric resistivity of $7\times10^{13}$ Ωcm, magnetization intensity ($\sigma_{1000}$) of 42 A(oersted)$m^2$/kg at 79.6 kA/m, residual magnetization ($\sigma_r$) of 3.1 $Am^2$/kg, intrinsic gravity of 3.71, and bulk density of 1.87 g/$cm^3$.

Magnetic Carrier Production Example 2

The same procedure as that for Magnetic Carrier Production Example 1 was repeated, except the magnetic core was replaced by a core of Mg—Mn—Sn—Fe composition, similarly coated with silicone resin, to prepare a magnetic carrier II. It had a volume-average 50% particle diameter of 38 μm, electric resistivity of $5\times10^{11}$ Ωcm, $\sigma_{1000}$ of 45 $Am^2$/kg, $\sigma^r$ of 0.8 $Am^2$/kg, intrinsic gravity of 4.6, and bulk density of 1.98 g/$cm^3$.

Example 1

The magnetic carrier I (92 parts) was mixed with 8 parts of the nonmagnetic black toner 1 by a V-shaped mixer, to prepare a two-component developer.

Figure 2:
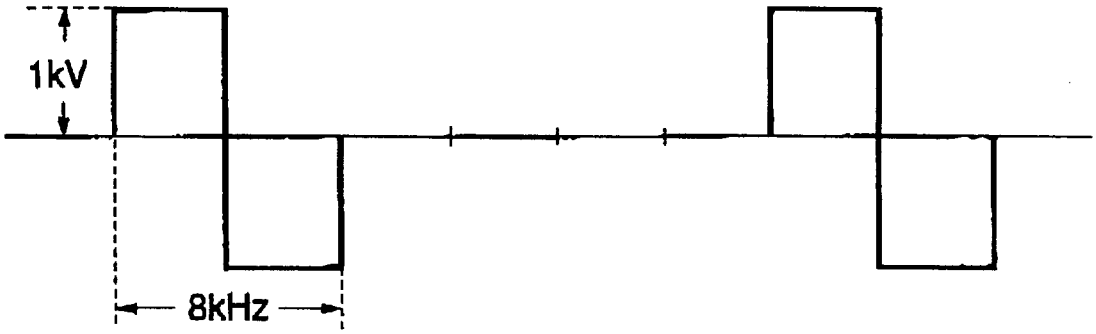
FIG. 2 is an illustration showing an alternate electric field used for embodiment 1.

A commercial digital copier (Canon, GP55) as the image forming apparatus was modified to contain a developing and electrically charging apparatuses, as shown in FIG. 1, to have a fixing apparatus comprising heating and pressurizing rolls both coated with PFA to a thickness of 1.2 μm by applying a developing bias (shown in FIG. 2), and to remove an oil coating mechanism. The photosensitive member was of an organic photosensitive member, 30 mm in diameter, coated with a surface layer of $3\times10^{12}$ Ωcm in volume resistivity, to be easily charged.

A total of 30,000 copies of an original manuscript (having 5 circular images of 20 mm in diameter, whose concentration was 1.5 as determined by a reflection densitometer (X-Rite, model 504)) under each set of temperature/relative humidity conditions of 23° C./60% (N/N), 23° C./5% (N/L), and 32.5° C./90% (H/H) were tested for using the above two-component developer and image forming apparatus, to evaluate the developers by the following methods. The results are given in Table 10.

(1) Image density

Image density was determined by a reflection densitometer (X-Rite, model 504) as the reflection density of the image formed on the common paper.

(2) Solid Image Uniformity

Image density of the 5 circular images of 20 mm in diameter (density of which on the original manuscript was 1.5) on the copies produced by the durability tests under the H/H conditions were determined by a reflection densitometer, to evaluate solid image uniformity by the difference between the maximum and minimum densities:

A: less than 0.04

B: 0.04 to less than 0.08

C: 0.08 to less than 0.12

D: 0.12 to less than 0.16

E: 0.16 to less than 0.20

F: 0.20 or more (3) Fogging

Fogging of the durability-tested copies, produced under the N/L and H/H conditions, was measured by the following procedure: average reflectivity Dr (%) of common paper before printing was measured by a reflectometer (REFLECTOMETER MODEL TC-6DS manufactured by Tokyo Denshoku Co., Ltd.) equipped with a green filter, and reflectivity Ds (%) of a solid white image formed on the common paper was also measured, to determine fogging (%) from the following formula:

$$Fogging(\%)=Dr-Ds$$

A: less than 0.4%

B: 0.4% to less than 0.8%

C: 0.8% to less than 1.2%

D: 1.21% to less than 1.6%

E: 1.6% to less than 2.0%

F: 2.0% or more (4) Image qualities

Gradation, highlight uniformity and fine line reproducibility of the durability-tested copies, produced under the N/L and H/H conditions, were visually and comprehensively evaluated, based on those of the original manuscript.

A: Excellent

B: Good

C: Acceptable

D: Bad (5) Toner scattering

Extent of toner scattered in the machine was visually observed, after 30,000 copies were produced under the H/H conditions, and comprehensively evaluated by the following standards:

A: No toner scattering observed

B: Little toner scattering observed

C: Toner scattering slightly observed, to an extent that should cause no practical problem D: Toner scattering observed, to an extent that may contaminate the images formed during the latter half of the durability test E: toner scattering observed, to an extent that may contaminate the images formed during the former half of the durability test F: Toner scattering observed, to a noticeable extent (6) Image density stability Image density stability was evaluated by the difference between density of the image produced during the initial stage of the durability test, conducted under the H/H conditions, and that of the image on the 1000the copy.

A: less than 0.04

B: 0.04 to less than 0.08

C: 0.08 to less than 0.12

D: 0.12 to less than 0.16

E: 0.16 to less than 0.20

F: 0.20 or more

Example 2

The same developer as that for Example 1, except the non-magnetic black toner 1 was replaced by the non-magnetic black toner 2, was evaluated by the same methods. The good results were observed, similarly to those for Example 1, as shown in Table 10.

Comparative Example 1

The same developer as that for Example 1, except the non-magnetic black toner 1 was replaced by the potassium-free, comparative, non-magnetic black toner 1, was evaluated by the same methods. The developer was insufficient in all of the aspects of image density, solid image uniformity, fogging, image qualities, toner scattering and image density stability, as shown in Table 12, conceivably resulting from insufficient dispersion of the carbon black.

Comparative Example 2

The same developer as that for Example 1, except the non-magnetic black toner 1 was replaced by the potassium-free, comparative, non-magnetic black toner 2, was evaluated by the same methods. The developer was insufficient in all of the aspects of image density, solid image uniformity, fogging, image qualities, toner scattering and image density stability, as shown in Table 12, conceivably resulting from insufficient dispersion of the carbon black.

Example 3

The same developer as that for Example 1, except the non-magnetic black toner 1 was replaced by the non-magnetic black toner 3 containing potassium at 14.0 ppm, was evaluated by the same methods. The image density, solid image uniformity, fogging, toner scattering and image density stability were slightly inferior to those observed in Example 1, as shown in Table 10, although to an extent that should cause no practical problem.

Comparative Example 3

The same developer as that for Example 1, except the non-magnetic black toner 1 was replaced by the comparative, non-magnetic black toner 3 containing potassium at 5.5 ppm, was evaluated by the same methods. The Image density, solid image uniformity, fogging, toner scattering and image density stability were inferior to those observed in Example 1, as shown in Table 12.

Example 4

The same developer as that for Example 1, except the non-magnetic black toner 1 was replaced by the non-magnetic black toner 4 containing potassium at 190 ppm, was evaluated by the same methods. The fogging, toner scattering, solid image uniformity and image density stability of the images produced under the H/H conditions were slightly inferior to those observed in Example 1, as shown in Table 10, although to an extent that should cause no practical problem.

Comparative Example 4

The same developer as that for Example 1, except the non-magnetic black toner 1 was replaced by the comparative, non-magnetic black toner 4 containing potassium at 240 ppm, was evaluated by the same methods. The fogging, toner scattering, solid image uniformity and image density stability of the images produced under the H/H conditions were inferior to those observed in Example 1, as shown in Table 12.

Examples 5 to 8

The same developers as that for Example 1, except the non-magnetic black toner 1 was replaced by the non-magnetic black toners 5 to 8 each using the different organometallic compound, were evaluated by the same methods. The image density, solid image uniformity, fogging, toner scattering and image density stability were slightly inferior to those observed in Example 1, as shown in Table 10, although to an extent that should cause no practical problem.

Comparative Example 5

The same developer as that for Example 1, except the non-magnetic black toner 1 was replaced by the comparative, non-magnetic black toner 5 containing a cobalt compound of di-t-butylsalicylic acid in place of an aluminum compound of di-t-butylsalicylic acid, was evaluated by the same methods. The image density, fogging, toner scattering and image density stability of the images produced under the H/H conditions were inferior to those observed in Example 1, as shown in Table 12.

Comparative Example 6

The same developer as that for Example 1, except the non-magnetic black toner 1 was replaced by the comparative, non-magnetic black toner 6 containing no organometallic compound, was evaluated by the same methods. The developer was inferior to that for Example 1 in all of the evaluation items, as shown in Table 12.

Example 9

The same developer as that for Example 1, except the non-magnetic black toner 1 was replaced by the non-magnetic black toner 9 having a weight-average particle diameter of 5.4 $\mu$m, was evaluated by the same methods. The fogging and toner scattering were slightly inferior to those observed in Example 1, as shown in Table 10, although to an extent that should cause no practical problem.

Comparative Example 7

The same developer as that for Example 1, except the non-magnetic black toner 1 was replaced by the comparative, non-magnetic black toner 7 having a weight-average particle diameter of 3.9 $\mu$m, was evaluated by the same methods. The image density, fogging and toner scattering were inferior to those observed in Example 1 to a significant extent that should cause practical problems, as shown in Table 12, conceivably resulting from excessively small diameter of the fine toner particles, which increases reflection with the carrier and broadens the charge distribution. The low image density was mainly caused by an excessively large charge quantity under the N/L conditions, to decrease absolute quantity of the toner for covering latent image potential and excessively increase reflection of the toner with the drum, resulting in insufficient transfer. Under the H/H conditions, on the other hand, insufficient transfer was caused by moisture in the transfer paper, conceivably resulting in low image density.

Example 10

The same developer as that for Example 1, except the non-magnetic black toner 1 was replaced by the non-magnetic black toner 10 having a weight-average particle diameter of 9.5 $\mu$m, was evaluated by the same methods. The image qualities were slightly inferior to those observed in Example 1, as shown in Table 10, although to an extent that should cause no practical problem.

Comparative Example 8

The same developer as that for Example 1, except the non-magnetic black toner 1 was replaced by the comparative, non-magnetic black toner 8 having a weight-average particle diameter of 11.5 $\mu$m, was evaluated by the same methods. The image qualities were inferior to those observed in Example 1, as shown in Table 12.

Example 11

The same developer as that for Example 1, except the non-magnetic black toner 1 was replaced by the non-magnetic black toner 11 having a tan $\delta$ ($5\times10^4$ Hz) of 0.0115 and tan $\delta$ ($10^5$ Hz) of 0.0102, was evaluated by the same methods. The image density was higher than that observed in Example 1, but fogging, toner scattering, solid image uniformity and image density stability of the images produced under the H/H conditions were slightly inferior, as shown in Table 10, although to an extent that should cause no practical problem.

Comparative Example 9

The same developer as that for Example 1, except the non-magnetic black toner 1 was replaced by the comparative, non-magnetic black toner 9 having a tan $\delta$ ($5\times10^4$ Hz) of 0.0131 and tan $\delta$ ($10^5$ Hz) of 0.0111, was evaluated by the same methods. The image density was higher than that observed in Example 1, but fogging, toner scattering, solid image uniformity and image density stability of the images produced under the H/H conditions were inferior, as shown in Table 12.

Example 12

The same developer as that for Example 1, except the non-magnetic black toner 1 was replaced by the non-magnetic black toner 12 having a Carr's flowability index of 55 and Carr's floodability index of 70, was evaluated by the same methods. The image qualities, e.g., highlight reproducibility, and fogging were slightly inferior to those observed in Example 1, as shown in Table 10, although to an extent that should cause no practical problem.

Comparative Example 10

The same developer as that for Example 1, except the non-magnetic black toner 1 was replaced by the comparative, non-magnetic black toner 10 having a Carr's flowability index of 48 and Carr's floodability index of 60, was evaluated by the same methods. The image qualities, e.g., highlight reproducibility were inferior to those observed in Example 1, and fogging occurred notably, as shown in Table 12.

Example 13

The same developer as that for Example 1, except the non-magnetic black toner 1 was replaced by the non-magnetic black toner 13 containing sodium as the alkaline metal, was evaluated by the same methods. It was almost on a level with that for Example 1, as shown in Table 10, although slightly inferior in the image density and fogging.

Example 14

The same developer as that for Example 1, except the non-magnetic black toner 1 was replaced by the non-magnetic black toner 14 containing potassium-containing carbon black, was evaluated by the same methods. It was on a level with that for Example 1 in the image characteristics, as shown in Table 10.

Comparative Example 11

The same developer as that for Example 1, except the non-magnetic black toner 1 was replaced by the comparative, non-magnetic black toner 11 containing potassium-containing carbon black, was evaluated by the same methods. The fogging, toner scattering, solid image uniformity and image density stability of the images formed under the H/H conditions were inferior to those observed in Example 1, as shown in Table 12.

Comparative Example 12

The same developer as that for Example 1, except the non-magnetic black toner 1 was replaced by the comparative, non-magnetic black toner 12 containing potassium-containing carbon black, was evaluated by the same methods. The coloring power, fogging, toner scattering, solid image uniformity and image density stability were inferior to those observed in Example 1, as shown in Table 12.

Example 15

The same developer as that for Example 1, except the non-magnetic black toner 1 was replaced by the non-magnetic black toner 15 containing a saturated polyester resin having an acid value of 4.0 and hydroxyl value of 9.0 and unsaturated polyester resin having an acid value of 3.0 and hydroxyl value of 8.0, was evaluated by the same methods. The image density stability was slightly inferior to those observed in Example 1, as shown in Table 10, although to an extent that should cause no practical problem.

Example 16

The same developer as that for Example 1, except the non-magnetic black toner 1 was replaced by the non-magnetic black toner 16 containing a saturated polyester resin having an acid value of 33.0 and hydroxyl value of 42.0 and unsaturated polyester resin having an acid value of 31.0 and hydroxyl value of 41.0, was evaluated by the same methods. The fogging and toner scattering were slightly inferior to those observed in Example 1, as shown in Table 10, although to an extent that should cause no practical problem.

Example 17

The same developer as that for Example 1, except the non-magnetic black toner 1 was replaced by the non-magnetic black toner 17 containing the untreated silica, was evaluated by the same methods. The solid image uniformity and image qualities of the images formed under the H/H conditions were slightly inferior to those observed in Example 1, as shown in Table 10, although to an extent that should cause no practical problem.

Example 18

The same developer as that for Example 1, except the non-magnetic black toner 1 was replaced by the non-magnetic black toner 18 containing carbon black (2) having an average primary particle diameter of 11 nm, was evaluated by the same methods. The solid image uniformity of the images formed under the H/H conditions was lowered, as shown in Table 10, although to an extent that should cause no practical problem. The decreased uniformity conceivably resulted from excessively small average primary particle diameter of the carbon black, leaving free carbon black on the toner particle surfaces, by which the transfer charges were moved to the drum via the carbon black. It also conceivably resulted from, in addition to the above insufficient transfer, irregularity of paper and delicate difference in quantity of the toner put on the paper.

Example 19

The same developer as that for Example 1, except the non-magnetic black toner 1 was replaced by the non-magnetic black toner 19 containing carbon black (3) having an average primary particle diameter of 60 nm, was evaluated by the same methods. The image density was lowered, as shown in Table 10, although to an extent that should cause no practical problem. The decreased image density conceivably resulted from excessively large average primary particle diameter of the carbon black, causing shortage of absolute quantity of the carbon black, although the particles were well dispersed.

Example 20

The same developer as that for Example 1, except the non-magnetic black toner 1 was replaced by the non-magnetic black toner 20 containing carbon black (4) of pH 6.5, was evaluated by the same methods. The solid image uniformity and image density of the images formed under the H/H conditions were lowered, as shown in Table 10, although to an extent that should cause no practical problem. These problems conceivably caused by the polar, functional group of the carbon black, which retards the polymerization during the toner production process, making the carbon black distribution uneven on the toner surfaces. The polymerized toner had a broad particle size distribution.

Example 21

The same developer as that for Example 1, except the non-magnetic black toner 1 was replaced by the non-magnetic black toner 21 containing carbon black (5) having 1.2% of volatiles, was evaluated by the same methods. The solid image uniformity of the images formed under the H/H conditions were lowered, as shown in Table 10, although to an extent that should cause no practical problem. This conceivably resulted from uneven carbon black distribution on the toner surfaces. The toner had a broad particle size distribution during the production process.

Example 22

The same developer as that for Example 1, except the non-magnetic black toner 1 was replaced by the non-magnetic black toner 22 containing carbon black (6) having a DBP oil absorption of 19 ml/100 g, was evaluated by the same methods. The density of the images formed under all of the temperature/relative humidity conditions used in the durability tests were low from the initial stages of the tests, and varied as a result of decreased charge quantity during the tests, as shown in Table 10, although to an extent that should cause no practical problem. These problems conceivably resulted from too low a DBP oil absorption to well disperse the carbon black.

Example 23

The same developer as that for Example 1, except the non-magnetic black toner 1 was replaced by the non-magnetic black toner 23 containing carbon black (7) having a DBP oil absorption of 115 ml/100 g, was evaluated by the same methods. The solid image uniformity of the images formed under the H/H conditions were lowered, as shown in Table 10, although to an extent that should cause no practical problem. This conceivably resulted from uneven carbon black distribution on the toner surfaces.

Example 24

The same developer as that for Example 1, except the non-magnetic black toner 1 was replaced by the non-magnetic black toner 24 containing carbon black (8) having a toluene extraction of 0.13%, was evaluated by the same methods. The solid image uniformity of the images formed under the H/H conditions were lowered, as shown in Table 10, although to an extent that should cause no practical problem. This conceivably resulted from uneven carbon black distribution on the toner surfaces. The toner had a broad particle size distribution during the production process.

Example 25

The same developer as that for Example 1, except the non-magnetic black toner 1 was replaced by the non-magnetic black toner 25 containing carbon black (9) having a residue on sieve of 298 ppm, was evaluated by the same methods. The solid image uniformity and fogging of the images formed under the H/H conditions were inferior to those observed in Example 1, as shown in Table 10, although to an extent that should cause no practical problem. This conceivably resulted from carbon black freed on the toner surfaces.

Example 26

The same developer as that for Example 1, except the non-magnetic black toner 1 was replaced by the non-magnetic black toner 26 containing carbon black (10) having a bulk density of 680 g/l, was evaluated by the same methods. The solid image uniformity and image density of the images formed under the H/H conditions were inferior to those observed in Example 1, as shown in Table 10, although to an extent that should cause no practical problem. This conceivably resulted from insufficient dispersion of the carbon black.

Example 27

The same developer as that for Example 1, except the non-magnetic black toner 1 was replaced by the nonmagnetic black toner 27 containing carbon black (11) having an average primary particle diameter of 23 nm, was evaluated by the same methods. The solid image uniformity of the images formed under the H/H conditions was slightly inferior to that observed in Example 1, as shown in Table 11, although to an extent that should cause no practical problem.

Example 28

The same developer as that for Example 1, except the non-magnetic black toner 1 was replaced by the non-magnetic black toner 28 containing carbon black (12) having an average primary particle diameter of 55 nm, was evaluated by the same methods. The image density was slightly inferior to that observed in Example 1, as shown in Table 11, although to an extent that should cause no practical problem.

Example 29

The same developer as that for Example 1, except the non-magnetic black toner 1 was replaced by the non-magnetic black toner 29 containing carbon black (13) of pH 11, was evaluated by the same methods. The solid image uniformity and image density of the images formed under the H/H conditions were slightly inferior to those observed in Example 1, as shown in Table 11, although to an extent that should cause no practical problem. The polymerized toner had a slightly broad particle size distribution.

Example 30

The same developer as that for Example 1, except the non-magnetic black toner 1 was replaced by the non-magnetic black toner 30 containing carbon black (14) having volatiles of 0.9%, was evaluated by the same methods. The solid image uniformity of the images formed under the H/H conditions was slightly inferior to that observed in Example 1, as shown in Table 11, although to an extent that should cause no practical problem. The polymerized toner had a slightly broad particle size distribution.

Example 31

The same developer as that for Example 1, except the non-magnetic black toner 1 was replaced by the non-magnetic black toner 31 containing carbon black (15) having a DBP oil absorption of 27 ml/100 g, was evaluated by the same methods. The density of the images formed under all of the temperature/relative humidity conditions used in the durability tests were slightly low from the initial stages of the tests, and varsied as a result of slightly decreased charge quantity during the tests, as shown in Table 11.

Example 32

The same developer as that for Example 1, except the non-magnetic black toner 1 was replaced by the non-magnetic black toner 32 containing carbon black (16) having a DBP oil absorption of 70 ml/100 g, was evaluated by the same methods. The solid image uniformity of the images formed under the H/H conditions was slightly inferior to that observed in Example 1, as shown in Table 11, although to an extent that should cause no practical problem.

Example 33

The same developer as that for Example 1, except the non-magnetic black toner 1 was replaced by the non-magnetic black toner 33 containing carbon black (17) having a toluene extraction of 0.07%, was evaluated by the same methods. The solid image uniformity of the images formed under the H/H conditions was slightly inferior to that observed in Example 1, as shown in Table 11, and the toner had a broad particle size distribution during the production process, although both to an extent that should cause no practical problem.

Example 34

The same developer as that for Example 1, except the non-magnetic black toner 1 was replaced by the non-magnetic black toner 34 containing carbon black (18) having a residue on sieve of 130 ppm, was evaluated by the same methods. The solid image uniformity of the images formed under the H/H conditions was slightly inferior to that observed in Example 1, as shown in Table 11, although to an extent that should cause no practical problem.

Example 35

The same developer as that for Example 1, except the non-magnetic black toner 1 was replaced by the non-magnetic black toner 35 containing carbon black (19) having a bulk density of 520 g/l, was evaluated by the same methods. The solid image uniformity and image density of the images formed under the H/H conditions were inferior to those observed in Example 1, as shown in Table 11, although to an extent that should cause no practical problem.

Examples 36 and 37

The same developers as that for Example 1, except the non-magnetic black toner 1 was replaced by the non-magnetic black toner 36 having an A/C ratio=4.69 (for Example 36) and non-magnetic black toner 37 having an A/C ratio 6.93 (for Example 37), were evaluated by the same methods. These developers were inferior to the one for Example 1 in all of the evaluation items, as shown in Table 11, although to an extent that should cause no practical problem.

Examples 38 and 39

The same developers as that for Example 1, except the non-magnetic black toner 1 was replaced by the non-magnetic black toner 38 containing no azo-based iron compound (for Example 38) and non-magnetic black toner 39 containing no unsaturated polyester (for Example 39), were evaluated by the same methods. These developers gave essentially the same image characteristics as the one for Example 1, although slightly inferior in the image density, as shown in Table 11.

Example 40

A commercial full-color copier (Canon, CLC2400) as the image forming apparatus, in place of a GP55 copier, was modified to remove the cleaning unit, to have a contacting charging unit for primary charging, and to have the fixing apparatus similar to that for Example 1 as shown in FIG. 3. It was used to evaluate a developer composed of four colors by the non-magnetic black toner 1, magenta toner 40, cyan toner 41 and yellow toner 42 for the image characteristics it gave. The good results were produced, as shown in Table 11.

Example 41

A commercial image forming apparatus (Canon, CLC700) was modified to contain a developing and electrically charging apparatuses, as shown in FIG. 1, to have a fixing apparatus comprising heating and pressurizing rolls both coated with PFA to a thickness of 1.2 μm by applying a developing bias (shown in FIG 2), and to remove an oil coating mechanism.

The same procedure as that for Example 40 was repeated, except the full-color copier was replaced by the above copier, to evaluate the image characteristics. The good results were produced, as shown in Table 11.

Example 42

An image forming apparatus having an intermediate transfer drum, shown in FIG. 5, was used to evaluate a developer composed of four colors by the non-magnetic black toner 1, magenta toner 40, cyan toner 41 and yellow toner 42 for the image characteristics it gave by a developing unit (FIG. 7) for non-magnetic, one-component development. The good results were produced, as shown in Table 11.

Example 43

An image forming apparatus (GP55) as shown in FIG. 6 as the image forming apparatus, whose developing unit was modified for non-magnetic, contacting development, was used for the durability test, in which the non-magnetic black toner 1 was used to produce 15,000 copies. The good results were produced, as shown in Table 11.

Example 44

The same developer as that for Example 1, except the ferrite carrier I was replaced by the ferrite carrier II, was evaluated by the same methods. The good results were produced, although the fogging was slightly increased, as shown in Table 11.

Example 45

The ferrite carrier II (92 parts) was mixed with 8 parts of the non-magnetic black toner 43 by a V-shaped mixer, to prepare a two-component developer.

The above two-component developer was charged in the black station of a commercial color copier (Canon Inc., CLC1000) as an image forming apparatus, which was modified to have heating and pressurizing rolls both coated with PFA to a thickness of 1.2 μm and to remove an oil coating mechanism, and evaluated by the same methods as those used for Example 1. The good results were produced, as shown in Table 11.

Comparative Example 13

The same developer as that for Example 45, except the non-magnetic black toner 43 was replaced by the potassium-free, comparative, non-magnetic black toner 13, was evaluated by the same methods. The developer was insufficient in all of the aspects of image density, solid image uniformity, fogging, image qualities, toner scattering and image density stability, as shown in Table 12, resulting from insufficient dispersion of the carbon black.

Example 46

The same developer as that for Example 45, except the non-magnetic black toner 43 was replaced by the non-magnetic black toner 44 containing potassium at 16 ppm, was evaluated by the same methods. The image density, fogging, toner scattering solid image uniformity, and image density stability were slightly inferior to those observed in Example 45, as shown in Table 11, although to an extent that should cause no practical problem.

Comparative Example 14

The same developer as that for Example 45, except the non-magnetic black toner 43 was replaced by the comparative, non-magnetic black toner 14 containing potassium at 5.5 ppm, was evaluated by the same methods. The image density, fogging, toner scattering, solid image uniformity and image density stability were inferior to those observed in Example 45, as shown in Table 12.

Example 47

The same developer as that for Example 45, except the non-magnetic black toner 43 was replaced by the non-magnetic black toner 45 containing potassium at 198 ppm, was evaluated by the same methods. The fogging, toner scattering, solid image uniformity and image density stability of the images produced under the H/H conditions were slightly inferior to those observed in Example 45, as shown in Table 11, although to an extent that should cause no practical problem.

Comparative Example 15

The same developer as that for Example 45, except the non-magnetic black toner 43 was replaced by the comparative, non-magnetic black toner 15 containing potassium at 290 ppm, was evaluated by the same methods. The fogging, toner scattering, solid image uniformity and image density stability of the images produced under the H/H conditions were inferior to those observed in Example 45, as shown in Table 12.

Comparative Example 16

The same developer as that for Example 45, except the non-magnetic black toner 43 was replaced by the comparative, non-magnetic black toner 16 containing no organometallic compound, was evaluated by the same methods. The developer was inferior to that for Example 45 in all of the evaluation items, as shown in Table 12.

Example 48

The same developer as that for Example 45, except the non-magnetic black toner 43 was replaced by the non-magnetic black toner 46 having a particle diameter of 5.4 μm, was evaluated by the same methods. The fogging and toner scattering were slightly inferior to those observed in Example 45, as shown in Table 11, although to an extent that should cause no practical problem.

Example 49

The same developer as that for Example 45, except the non-magnetic black toner 43 was replaced by the non-magnetic black toner 47 having a particle diameter of 9.5 μm, was evaluated by the same methods. The image qualities were slightly inferior to those observed in Example 45, as shown in Table 11, although to an extent that should cause no practical problem.

Example 50

The same developer as that for Example 45, except the non-magnetic black toner 43 was replaced by the non-magnetic black toner 48 having a tan δ ($5\times10^4$ Hz) of 0.0102 and tan δ ($10^5$ Hz) of 0.0104, was evaluated by the same methods. The image density was higher than that observed in Example 45, but fogging, toner scattering, solid image uniformity and image density stability of the images produced under the H/H conditions were slightly inferior, as shown in Table 11, although to an extent that should cause no practical problem.

Comparative Example 17

The same developer as that for Example 45, except the non-magnetic black toner 43 was replaced by the comparative, non-magnetic black toner 17 having a tan δ ($5\times10^4$ Hz) of 0.0134 and tan δ ($10^5$ Hz) of 0.0155, was evaluated by the same methods. The image density was higher than that observed in Example 45, but fogging, toner scattering, solid image uniformity and image density stability of the images produced under the H/H conditions were inferior, as shown in Table 12.

Example 51

The same developer as that for Example 45, except the non-magnetic black toner 43 was replaced by the non-magnetic black toner 49 having a Carr's flowability index of 57 and Carr's floodability index of 68, was evaluated by the same methods. The image qualities, e.g., highlight reproducibility, and fogging were slightly inferior to those observed in Example 45, as shown in Table 11, although to an extent that should cause no practical problem.

Comparative Example 18

The same developer as that for Example 45, except the non-magnetic black toner 43 was replaced by the comparative, non-magnetic black toner 18 having a Carr's flowability index of 49 and Carr's floodability index of 63, was evaluated by the same methods. The image qualities, e.g., highlight reproducibility were inferior to those observed in Example 45, and fogging occurred notably, as shown in Table 12.

Example 52

The same developer as that for Example 45, except the non-magnetic black toner 43 was replaced by the non-magnetic black toner 50 containing potassium-containing carbon black, was evaluated by the same methods. It was on a level with that for Example 45 in the image characteristics, as shown in Table 11.

Comparative Example 19

The same developer as that for Example 45, except the non-magnetic black toner 43 was replaced by the comparative, non-magnetic black toner 19 having a particle diameter of 3.4 μm, was evaluated by the same methods. The image density, fogging and toner scattering were significantly inferior to those observed in Example 45, as shown in Table 12.

Comparative Example 20

The same developer as that for Example 45, except the non-magnetic black toner 43 was replaced by the comparative, non-magnetic black toner 20 having a weight-average particle diameter of 11.4 μm, was evaluated by the same methods. The image qualities were significantly inferior to those observed in Example 45, as shown in Table 12.

TABLE 3

Summary of carbon black

| No. | Average primary particle diameter (nm) | pH | Specific surface area ($m^2/g$) | Volatiles content (%) | DBP oil absorption (ml/100 g) | Toluene extraction (%) | Residue on sieve (ppm) | Bulk density (g/l) | Alkaline metal types/contents (ppm) |
|---|---|---|---|---|---|---|---|---|---|
| 1 | 32 | 9.1 | 64 | 0.4 | 41 | 0.02 | 32 | 400 | 0 |
| 2 | 11 | 9.1 | 460 | 0.4 | 41 | 0.02 | 10 | 490 | 0 |
| 3 | 60 | 9.1 | 32 | 0.4 | 41 | 0.02 | 80 | 340 | 0 |
| 4 | 34 | 6.5 | 64 | 0.4 | 41 | 0.02 | 32 | 420 | 0 |
| 5 | 37 | 7.8 | 63 | 1.2 | 41 | 0.02 | 32 | 410 | 0 |
| 6 | 36 | 9.4 | 72 | 0.4 | 19 | 0.02 | 32 | 460 | 0 |
| 7 | 41 | 8.3 | 98 | 0.4 | 115 | 0.02 | 32 | 400 | 0 |
| 8 | 47 | 9.0 | 30 | 0.4 | 41 | 0.13 | 32 | 320 | 0 |
| 9 | 49 | 9.1 | 27 | 0.4 | 41 | 0.02 | 298 | 280 | 0 |
| 10 | 28 | 9.3 | 123 | 0.4 | 41 | 0.02 | 32 | 680 | 0 |
| 11 | 23 | 8.9 | 140 | 0.4 | 41 | 0.02 | 32 | 400 | 0 |
| 12 | 55 | 8.7 | 37 | 0.4 | 41 | 0.02 | 32 | 400 | 0 |
| 13 | 34 | 11.0 | 45 | 0.4 | 41 | 0.02 | 32 | 400 | 0 |
| 14 | 36 | 8.9 | 57 | 0.9 | 41 | 0.02 | 32 | 400 | 0 |
| 15 | 35 | 9.2 | 64 | 0.4 | 27 | 0.02 | 32 | 400 | 0 |
| 16 | 34 | 9.1 | 63 | 0.4 | 70 | 0.02 | 32 | 400 | 0 |
| 17 | 35 | 8.9 | 58 | 0.4 | 41 | 0.07 | 32 | 400 | 0 |
| 18 | 37 | 9.1 | 59 | 0.4 | 41 | 0.02 | 130 | 400 | 0 |
| 19 | 38 | 8.9 | 58 | 0.4 | 41 | 0.02 | 32 | 520 | 0 |
| 20 | 32 | 9.1 | 64 | 0.4 | 41 | 0.02 | 32 | 400 | Potassium/300 |
| 21 | 32 | 9.1 | 64 | 0.4 | 41 | 0.02 | 32 | 400 | Potassium/1100 |
| 22 | 32 | 9.1 | 64 | 0.4 | 41 | 0.02 | 32 | 400 | Potassium/30 |

TABLE 4

Summary of toners, (1)-a-1

| Production Examples | Charge quantities (parts per 100 parts of polymerizable monomer or binder resin) | | | | | | | |
|---|---|---|---|---|---|---|---|---|
| | Organometallic compounds | | | | Alkali metals | | Pigments | |
| | Types | Parts | Types | Parts | Types | Parts (as carbonate) | Types | Parts |
| Production Example 1 | Azo-based iron compound | 0.5 | Aluminum compound of di-t-butylsalicylic acid | 1 | Potassium | 0.035 | Carbon black (1) | 10 |
| Production Example 2 | Azo-based iron compound | 0.5 | Aluminum compound of di-t-butylsalicylic acid | 1 | Potassium | 0.035 | Carbon black (1) | 10 |
| Procuction Comparative Example 1 | Azo-based iron compound | 0.5 | Aluminum compound of di-t-butysalicylic acid | 1 | — | 0 | carbon black (1) | 10 |
| Procuction Comparative Example 2 | Azo-based iron compound | 0.5 | Aluminum compound of di-t-butylsalicylic acid | 1 | — | 0 | Carbon black (1) | 10 |
| Procuction Example 3 | Azo-based iron compound | 0.5 | Aluminum compound of di-t-butylsalicylic acid | 1 | Potassium | 0.0055 | Carbon black (1) | 10 |
| Procuction Comparative Example 3 | Azo-based iron Compound | 0.5 | Aluminum compound of di-t-butylsalicylic acid | 1 | Potassium | 0.003 | Carbon black (1) | 10 |
| Procuction Example 4 | Azo-based iron compound | 0.5 | Aluminum compound of di-t-butysalicylic acid | 1 | Potassium | 0.05 | Carbon black (1) | 10 |
| Procuction Comparative Example 4 | Azo-based iron Compound | 0.5 | Aluminum compound of di-t-butylsalicylic acid | 1 | Potassium | 0.07 | Carbon black (1) | 10 |
| Procuction Example 5 | — | 0 | Zinc compound of di-t-butylsalicylic acid | 1 | Potassium | 0.035 | Carbon black (1) | 10 |
| Procuction Example 6 | — | 0 | Chromium compound of di-t-butylsalicylic acid | 1 | Potassium | 0.035 | Carbon black (1) | 10 |
| Procuction Example 7 | — | 0 | Zirconium compound of di-t-butylsalicylic acid | 1 | Potassium | 0.035 | Carbon black (1) | 10 |
| Procuction Example 8 | — | 0 | Boron benziliate compound | 1 | Potassium | 0.035 | Carbon black (1) | 10 |
| Procuction Comparative Example 5 | — | 0 | Cobalt compound of di-t-butylsalicylic acid | 1 | Potassium | 0.035 | Carbon black (1) | 10 |
| Procuction Comparative Example 6 | — | 0 | — | 1 | Potassium | 0.035 | Carbon black (1) | 10 |
| Procuction Example 9 | Azo-based iron compound | 0.5 | Aluminum compound of di-t-butylsalicylic acid | 1 | Potassium | 0.035 | Carbon black (1) | 10 |
| Procuction Example 10 | Azo-based iron compound | 0.5 | Aluminum compound of di-t-butylsalicylic acid | 1 | Potassium | 0.035 | Carbon black (1) | 10 |
| Procuction Comparative Example 7 | Azo-based iron compound | 0.5 | Aluminum compound of di-t-butylsalicylic acid | 1 | Potassium | 0.035 | Carbon black (1) | 10 |
| Procuction Comparative Example 8 | Azo-based iron compound | 0.5 | Aluminum compound di-t-butylsalicylic acid | 1 | Potassium | 0.035 | Carbon black (1) | 10 |
| Procuction Example 11 | Azo-based iron compound | 0.5 | Aluminum compound of di-t-butylsalicylic acid | 1 | Potassium | 0.009 | Carbon black (1) | 15 |
| Procuction Comparative Example 9 | Azo-based iron compound | 0.5 | Aluminum compound of di-t-butylsalicylic acid | 1 | Potassium | 0.006 | Carbon black (1) | 16 |
| Procuction Example 12 | Azo-based iron compound | 0.5 | Aluminim compound of di-t-butylsalicylic acid | 1 | Potassium | 0.035 | Carbon black (1) | 10 |
| Procuction Comparative Example 10 | Azo-based iron compound | 0.5 | Aluminum compound of di-t-butylsalicylic acid | 1 | Potassium | 0.035 | Carbon black (1) | 10 |
| Procuction Example 13 | Azo-based iron compound | 0.5 | Aluminum compound of di-t-butylsalicylic acid | 1 | Sodium | 0.045 | Carbon black (1) | 10 |
| Procuction Example 14 | Azo-based iron compound | 0.5 | Aluminum compound of di-t-butylsalicylic acid | 1 | — | 0 | Carbon black (20) | 10 |

TABLE 4-continued

Summary of toners, (1)-a-2

| Toner particle contents | | | | | PES resins | |
|---|---|---|---|---|---|---|
| Alkali metal contents A (ppm) | Carbon black contents B (wt. %) | Organo-metallic compound contents C (wt. %) | A/B | A/C | Acid value (Resin1/Resin2) | Hydroxyl value (Resin1/Resin2) |
| 113 | 7.76 | 1.16 | 14.6 | 97.4 | 11.0/19.9 | 23.0/7.5 |
| 125 | 7.65 | 1.15 | 16.3 | 108.7 | 11.0/19.9 | 23.0/7.5 |
| 0 | 7.73 | 1.16 | 0 | 0 | 11.0/19.9 | 23.0/7.5 |
| 0 | 7.65 | 1.15 | 0 | 0 | 11.0/19.9 | 23.0/7.5 |
| 14.0 | 7.73 | 1.16 | 1.85 | 12.3 | 11.0/19.9 | 23.0/7.5 |
| 5.5 | 7.73 | 1.16 | 0.73 | 4.84 | 11.0/19.9 | 23.0/7.5 |
| 190 | 7.72 | 1.16 | 24.6 | 164 | 11.0/19.9 | 23.0/7.5 |
| 240 | 7.72 | 1.16 | 31.1 | 207 | 11.0/19.9 | 23.0/7.5 |
| 132 | 7.76 | 0.77 | 17.0 | 171 | 11.0/19.9 | 23.0/7.5 |
| 132 | 7.76 | 0.77 | 17.0 | 171 | 11.0/19.9 | 23.0/7.5 |
| 129 | 7.76 | 0.77 | 16.6 | 168 | 11.0/19.9 | 23.0/7.5 |
| 127 | 7.76 | 0.77 | 16.4 | 165 | 11.0/19.9 | 23.0/7.5 |
| 130 | 7.82 | 0.77 | 16.8 | 169 | 11.0/19.9 | 23.0/7.5 |
| 130 | 7.73 | 0 | 16.6 | — | 11.0/19.9 | 23.0/7.5 |
| 107 | 7.73 | 1.16 | 13.8 | 92.2 | 11.0/19.9 | 23.0/7.5 |
| 112 | 7.73 | 1.16 | 14.5 | 96.6 | 11.0/19.9 | 23.0/7.5 |
| 89 | 7.73 | 1.16 | 11.5 | 76.7 | 11.0/19.9 | 23.0/7.5 |
| 118 | 7.73 | 1.16 | 15.3 | 102 | 11.0/19.9 | 23.0/7.5 |
| 31.8 | 11.2 | 1.12 | 2.84 | 28.4 | 11.0/19.9 | 23.0/7.5 |
| 22.1 | 11.8 | 1.11 | 1.87 | 19.9 | 11.0/19.9 | 23.0/7.5 |
| 113 | 7.73 | 1.16 | 14.6 | 97.4 | 11.0/19.9 | 23.0/7.5 |
| 111 | 7.73 | 1.16 | 14.4 | 95.7 | 11.0/19.9 | 23.0/7.5 |
| 112 | 7.73 | 1.16 | 14.5 | 96.6 | 11.0/19.9 | 23.0/7.5 |
| 100 | 7.73 | 1.16 | 12.9 | 86.2 | 11.0/19.9 | 23.0/7.5 |

TABLE 5

Summary of toners, (1)-b

| | Toner particle diameter | | | | | | | tan δ | | | | |
|---|---|---|---|---|---|---|---|---|---|---|---|---|
| | Weight average | 4 μm | | External additives | | | | at | | Carr's | Carr's | Contact |
| Production Examples | particle diameter (μM) | or less (% by number) | 12.7 μm or more (vol. %) | Types | Dose rates (wt. %) | Types | Dose rates (wt. %) | $5 \times 10^4$ Hz | at $10^5$ Hz | flow-ability index | flood-ability index | angle with water |
| Production Example 1 | 7.9 | 6.0 | 1.5 | Hydrophobic titanium oxide | 0.7 | Hydrophobic silica | 0.7 | 0.00736 | 0.00548 | 75 | 85 | 129 |
| Production Example 2 | 7.9 | 8.0 | 1.9 | Hydrophobic titanium oxide | 0.7 | Hydrophobic silica | 0.7 | 0.00701 | 0.00517 | 72 | 82 | 128 |
| Production Comparative Example 1 | 7.9 | 7.6 | 1.4 | Hydrophobic titanium oxide | 0.7 | Hydrophobic silica | 0.7 | 0.0134 | 0.0115 | 67 | 75 | 121 |
| Production Comparative Example 2 | 7.8 | 7.8 | 1.3 | Hydrophobic titanium oxide | 0.7 | Hydrophobic silica | 0.7 | 0.0136 | 0.0117 | 66 | 74 | 120 |
| Production Example 3 | 7.6 | 8.6 | 0.9 | Hydrophobic titanium oxide | 0.7 | Hydrophobic silica | 0.7 | 0.0121 | 0.1010 | 69 | 77 | 124 |
| Production Comparative Example 3 | 7.7 | 8.1 | 1.1 | Hydrophobic titanium oxide | 0.7 | Hydrophobic silica | 0.7 | 0.0123 | 0.0103 | 68 | 75 | 122 |
| Production Example 4 | 7.7 | 8.0 | 1.2 | Hydrophobic titanium oxide | 0.7 | Hydrophobic silica | 0.7 | 0.00688 | 0.00518 | 72 | 79 | 126 |
| Production Comparative Example 4 | 7.7 | 8.1 | 3.1 | Hydrophobic titanium oxide | 0.7 | Hydrophobic silica | 0.7 | 0.00678 | 0.00528 | 71 | 77 | 125 |
| Production Example 5 | 7.8 | 7.6 | 3.3 | Hydrophobic titanium oxide | 0.7 | Hydrophobic silica | 0.7 | 0.0818 | 0.00624 | 74 | 84 | 128 |

TABLE 5-continued

Summary of toners, (1)-b

| Production Examples | Toner particle diameter: Weight average particle diameter (μM) | Toner particle diameter: 4 μm or less (% by number) | Toner particle diameter: 12.7 μm or more (vol. %) | External additives: Types | External additives: Dose rates (wt. %) | External additives: Types | External additives: Dose rates (wt. %) | tan δ at 5 × 10^4 Hz | tan δ at 10^5 Hz | Carr's flow-ability index | Carr's flood-ability index | Contact angle with water |
|---|---|---|---|---|---|---|---|---|---|---|---|---|
| Production Example 6 | 7.8 | 7.7 | 1.2 | Hydrophobic titanium oxide | 0.7 | Hydrophobic silica | 0.7 | 0.00826 | 0.00633 | 75 | 83 | 127 |
| Production Example 7 | 7.8 | 7.7 | 3.2 | Hydrophobic titanium oxide | 0.7 | Hydrophobic silica | 0.7 | 0.00826 | 0.00633 | 75 | 83 | 127 |
| Production Example 8 | 7.8 | 7.7 | 1.2 | Hydrophobic titanium ozide | 0.7 | Hydrophobic silica | 0.7 | 0.00826 | 0.00633 | 75 | 83 | 127 |
| Production Comparative Example 5 | 7.9 | 7.9 | 1.4 | Hydrophobic titanium oxide | 0.7 | Hydrophobic silica | 0.7 | 0.00823 | 0.00631 | 74 | 84 | 128 |
| Production Comparative Example 6 | 7.8 | 8.1 | 3.4 | Hydrophobic titanium oxide | 0.7 | Hydrophobic silica | 0.7 | 0.0151 | 0.0138 | 73 | 82 | 126 |
| Production Example 9 | 5.4 | 23.0 | 0.0 | Hydrophobic titanium oxide | 0.7 | Hydrophobic silica | 0.7 | 0.00779 | 0.00568 | 71 | 80 | 123 |
| Production Example 10 | 9.5 | 3.0 | 2.7 | Hydrophobic titanium oxide | 0.7 | Hydrophobic silica | 0.7 | 0.00736 | 0.00548 | 78 | 88 | 131 |
| Production Comparative Example 7 | 3.9 | 29.0 | 0.0 | Hydrophobic titanium oxide | 0.7 | Hydrophobic silica | 0.7 | 0.00801 | 0.00628 | 67 | 74 | 119 |
| Production Comparative Example 8 | 11.5 | 2.7 | 2.7 | Hydrophobic titanium oxide | 0.7 | Hydrophobic silica | 0.7 | 0.00692 | 0.00525 | 82 | 92 | 125 |
| Production Example 11 | 7.3 | 8.8 | 1.2 | Hydrophobic titanium oxide | 0.7 | Hydrophobic silica | 0.7 | 0.0115 | 0.0102 | 72 | 82 | 126 |
| Production Comparative Example 9 | 7.1 | 8.9 | 1.2 | Hydrophobic titanium oxide | 0.7 | Hydrophobic silica | 0.7 | 0.0131 | 0.0111 | 71 | 81 | 125 |
| Production Example 12 | 6.5 | 15.4 | 0.3 | Hydrophobic titanium oxide | 0.3 | Hydrophobic silica | 0.3 | 0.00746 | 0.00568 | 55 | 70 | 122 |
| Production Comparative Example 10 | 6.2 | 16.7 | 0.1 | Hydrophobic titanium oxide | 0.2 | Hydrophobic silica | 0.2 | 0.00756 | 0.00575 | 48 | 80 | 120 |
| Production Example 13 | 7.8 | 6.1 | 1.7 | Hydrophobic titanium oxide | 0.7 | Hydrophobic silica | 0.7 | 0.00895 | 0.00638 | 74 | 82 | 125 |
| Production Example 14 | 7.7 | 6.2 | 1.8 | Hydrophobic titanium oxide | 0.7 | Hydrophobic silica | 0.7 | 0.00718 | 0.00538 | 75 | 84 | 128 |

TABLE 6

Summary of toners, (2)-a

| Production Examples | Charge quantities (parts per 100 parts of polymerizable monomer or binder resin): Organometallic compounds: Types | Organometallic compounds: Parts | Organometallic compounds: Types | Organometallic compounds: Parts | Alkali metals: Types | Alkali metals: Parts (as carbonate) | Pigments: Types | Pigments: Parts |
|---|---|---|---|---|---|---|---|---|
| Production Comparative Example 11 | Azo-based iron compound | 0.5 | Aluminum compound of di-t-butylsalicylic acid | 1 | — | 0 | Carbon black (21) | 10 |
| Production Comparative Example 12 | Azo-based iron compound | 0.5 | Aluminum compound of di-t-butylsalicylic acid | 1 | — | 0 | Carbon black (22) | 10 |

TABLE 6-continued

Summary of toners, (2)-a

| | | | | | | | | |
|---|---|---|---|---|---|---|---|---|
| Production Example 13 | Azo-based iron compound | 0.5 | Aluminum compound of di-t-butylsalicylic acid | 1 | Potassium | 0.035 | Carbon black (1) | 10 |
| Production Example 16 | Azo-based iron compound | 0.5 | Aluminum compound of di-t-butylsalicylic acid | 1 | Potassium | 0.035 | Carbon black (1) | 10 |
| Production Example 17 | Azo-based iron compound | 0.5 | Aluminum compound of di-t-butylsalicylic acid | 1 | Potassium | 0.035 | Carbon black (1) | 10 |
| Production Example 18 | Azo-based iron compound | 0.5 | Aluminum compound of di-t-butylsalicylic acid | 1 | Potassium | 0.035 | Carbon black (2) | 10 |
| Production Example 19 | Azo-based iron compound | 0.5 | Aluminum compound of di-t-butylsalicylic acid | 1 | Potassium | 0.035 | Carbon black (3) | 10 |
| Production Example 20 | Azo-based iron compound | 0.5 | Aluminum compound of di-t-butylsalicylic acid | 1 | Potassium | 0.035 | Carbon black (4) | 10 |
| Production Example 21 | Azo-based iron compound | 0.5 | Aluminum compound of di-t-butylsalicylic acid | 1 | Potassium | 0.035 | Carbon black (5) | 10 |
| Production Example 22 | Azo-based iron compound | 0.5 | Aluminum compound of di-t-butylsalicylic acid | 1 | Potassium | 0.035 | Carbon black (6) | 10 |
| Production Example 23 | Azo-based iron compound | 0.5 | Aluminum compound of di-t-butylsalicylic acid | 1 | Potassium | 0.035 | Carbon black (7) | 10 |
| Production Example 24 | Azo-based iron compound | 0.5 | Aluminum compound of di-t-butylsalicylic acid | 1 | Potassium | 0.035 | Carbon black (8) | 10 |
| Production Example 25 | Azo-based iron compound | 0.5 | Aluminum compound of di-t-butylsalicylic acid | 1 | Potassium | 0.035 | Carbon black (9) | 10 |
| Production Example 26 | Azo-based iron compound | 0.5 | Aluminum compound of di-t-butylsalicylic acid | 1 | Potassium | 0.035 | Carbon black (10) | 10 |
| Production Example 27 | Azo-based iron compound | 0.5 | Aluminum compound of di-t-butylsalicylic acid | 1 | Potassium | 0.035 | Carbon black (11) | 10 |
| Production Example 28 | Azo-based iron compound | 0.5 | Aluminum compound of di-t-butylsalicylic acid | 1 | Potassium | 0.035 | Carbon black (12) | 10 |
| Production Example 29 | Azo-based iron compound | 0.5 | Aluminum compound of di-t-butylsalicylic acid | 1 | Potassium | 0.035 | Carbon black (13) | 10 |
| Production Example 30 | Azo-based iron compound | 0.5 | Aluminum compound of di-t-butylsalicylic acid | 1 | Potassium | 0.035 | Carbon black (14) | 10 |
| Production Example 31 | Azo-based iron compound | 0.5 | Aluminum compound of di-t-butylsalicylic acid | 1 | Potassium | 0.035 | Carbon black (15) | 15 |
| Production Example 32 | Azo-based iron compound | 0.5 | Aluminum compound of di-t-butylsalicylic acid | 1 | Potassium | 0.035 | Carbon black (16) | 16 |
| Production Example 33 | Azo-based iron compound | 0.5 | Aluminum compound of di-t-butylsalicylic acid | 1 | Potassium | 0.035 | Carbon black (17) | 10 |
| Production Example 34 | Azo-based iron compound | 0.5 | Aluminum compound of di-t-butylsalicylic acid | 1 | Potassium | 0.035 | Carbon black (18) | 10 |
| Production Example 35 | Azo-based iron compound | 0.5 | Aluminum compound of di-t-butylsalicylic acid | 1 | Potassium | 0.035 | Carbon black (19) | 10 |

| | Toner particle contents | | | | | PES resin | |
|---|---|---|---|---|---|---|---|
| Production Examples | | | | A/B | A/C | Acid value Resin 1/ Resin 2) | Hydroxyl value (Resin 1/Resin 2) |
| Production Comparative Example 11 | 230 | 7.73 | 1.16 | 29.8 | 98.0 | 11.0/19.9 | 23.0/7.5 |
| Production Comparative Example 12 | 710 | 7.73 | 1.16 | 0.91 | 6.03 | 11.0/19.9 | 23.0/7.5 |
| Production Example 13 | 111 | 7.73 | 1.16 | 14.4 | 95.7 | 4.0/3.0 | 9.0/8.0 |
| Production Example 16 | 112 | 7.73 | 1.18 | 14.5 | 96.6 | 33.0/31.5 | 42.0/41.0 |
| Production Example 17 | 115 | 7.73 | 1.15 | 14.8 | 99.1 | 11.0/19.9 | 23.0/7.5 |
| Production Example 18 | 115 | 7.73 | 1.16 | 14.9 | 99.1 | 11.0/19.9 | 23.0/7.5 |
| Production Example 19 | 112 | 7.73 | 1.15 | 14.5 | 96.6 | 11.0/19.9 | 23.0/7.5 |
| Production Example 20 | 114 | 7.73 | 1.15 | 14.7 | 98.3 | 11.0/19.9 | 23.0/7.5 |
| Production Example 21 | 112 | 7.73 | 1.15 | 14.5 | 96.6 | 11.0/19.9 | 23.0/7.5 |
| Production Example 22 | 114 | 7.73 | 1.16 | 14.7 | 98.3 | 11.0/19.9 | 23.0/7.5 |
| Production Example 23 | 110 | 7.73 | 1.14 | 14.2 | 94.8 | 11.0/19.9 | 23.0/7.5 |
| Production Example 24 | 112 | 7.73 | 1.18 | 14.5 | 96.6 | 11.0/19.9 | 23.0/7.5 |
| Production Example 25 | 113 | 7.73 | 1.16 | 14.6 | 97.4 | 11.0/19.9 | 23.0/7.5 |
| Production Example 26 | 113 | 7.73 | 1.16 | 14.6 | 97.4 | 11.0/19.9 | 23.0/7.5 |
| Production Example 27 | 112 | 7.73 | 1.16 | 24.5 | 96.6 | 11.0/19.9 | 23.0/7.5 |
| Production Example 28 | 113 | 7.73 | 1.16 | 14.5 | 97.4 | 11.0/19.9 | 23.0/7.5 |
| Production Example 29 | 112 | 7.73 | 1.15 | 14.5 | 96.5 | 11.0/19.9 | 23.0/7.5 |
| Production Example 30 | 116 | 7.73 | 1.15 | 15.0 | 100 | 11.0/19.9 | 23.0/7.5 |
| Production Example 31 | 112 | 7.73 | 1.15 | 14.6 | 97.4 | 11.0/19.9 | 23.0/7.5 |
| Production Example 32 | 110 | 7.73 | 1.15 | 14.2 | 94.8 | 11.0/19.9 | 23.0/7.5 |
| Production Example 33 | 112 | 7.73 | 1.16 | 14.8 | 96.6 | 11.0/19.9 | 23.0/7.5 |
| Production Example 34 | 112 | 7.73 | 1.16 | 14.5 | 96.6 | 11.0/19.9 | 23.0/7.5 |
| Production Example 35 | 116 | 7.73 | 1.15 | 15.0 | 100 | 11.0/19.9 | 23.0/7.5 |

TABLE 7

Summary of toners, (2)-b

| Production Examples | Toner particle diameter: Weight-average particle diameter (μM) | Toner particle diameter: 4 μm or less (% by number) | Toner particle diameter: 12.7 μm or more (vol. %) | External additives: Types | External additives: Dose rates (wt. %) | External additives: Types | External additives: Dose rates (wt. %) | tan δ at $5 \times 10^4$ Hz | tan δ at $10^5$ Hz | Carr's flow-ability index | Carr's flood-ability index | Contact angle with water |
|---|---|---|---|---|---|---|---|---|---|---|---|---|
| Production Comparative Example 11 | 7.8 | 5.9 | 1.7 | Hydrophobic titanium oxide | 0.7 | Hydrophobic silica | 0.7 | 0.00664 | 0.00508 | 72 | 79 | 126 |
| Comparative Production Example 12 | 7.7 | 6.3 | 1.6 | Hydrophobic titanium oxide | 0.7 | Hydrophobic silica | 0.7 | 0.0121 | 0.0101 | 68 | 76 | 124 |
| Production Example 15 | 7.0 | 7.7 | 1.9 | Hydrophobic titanium oxide | 0.7 | Hydrophobic silica | 0.7 | 0.00823 | 0.00588 | 73 | 84 | 132 |
| Production Example 16 | 7.8 | 7.9 | 1.2 | Hydrophobic titanium oxide | 0.7 | Hydrophobic silica | 0.7 | 0.00713 | 0.00519 | 69 | 81 | 119 |
| Production Example 17 | 7.8 | 7.1 | 1.1 | Hydrophobic titanium oxide | 0.7 | Hydrophobic silica | 0.7 | 0.00746 | 0.00534 | 69 | 77 | 105 |
| Production Example 18 | 7.7 | 7.2 | 1.2 | Hydrophobic titanium oxide | 0.7 | Hydrophobic silica | 0.7 | 0.00997 | 0.00912 | 71 | 82 | 123 |
| Production Example 19 | 7.9 | 7.3 | 1.0 | Hydrophobic titanium oxide | 0.7 | Hydrophobic silica | 0.7 | 0.00689 | 0.00506 | 72 | 81 | 128 |
| Production Example 20 | 7.3 | 9.6 | 0.7 | Hydrophobic titanium oxide | 0.7 | Hydrophobic silica | 0.7 | 0.00886 | 0.00779 | 73 | 83 | 127 |
| Production Example 21 | 7.4 | 9.7 | 0.8 | Hydrophobic titanium oxide | 0.7 | Hydrophobic silica | 0.7 | 0.00897 | 0.00788 | 74 | 81 | 126 |
| Production Example 22 | 7.8 | 5.8 | 1.7 | Hydrophobic titanium oxide | 0.7 | Hydrophobic silica | 0.7 | 0.00905 | 0.00786 | 73 | 83 | 124 |
| Production Example 23 | 7.5 | 9.7 | 0.7 | Hydrophobic titanium oxide | 0.7 | Hydrophobic silica | 0.7 | 0.00834 | 0.00734 | 73 | 83 | 124 |
| Production Example 24 | 7.3 | 9.7 | 0.7 | Hydrophobic titanium oxide | 0.7 | Hydrophobic silica | 0.7 | 0.00827 | 0.00728 | 72 | 84 | 124 |
| Production Example 25 | 7.7 | 6.2 | 1.8 | Hydrophobic titanium oxide | 0.7 | Hydrophobic silica | 0.7 | 0.00848 | 0.00768 | 73 | 84 | 123 |
| Production Example 26 | 7.8 | 6.1 | 1.7 | Hydrophobic titanium oxide | 0.7 | Hydrophobic silica | 0.7 | 0.00856 | 0.00784 | 73 | 83 | 122 |
| Production Example 27 | 7.7 | 6.2 | 1.8 | Hydrophobic titanium oxide | 0.7 | Hydrophobic silica | 0.7 | 0.00858 | 0.00768 | 74 | 83 | 123 |
| Production Example 28 | 7.8 | 5.8 | 1.7 | Hydrophobic titanium oxide | 0.7 | Hydrophobic silica | 0.7 | 0.00712 | 0.00526 | 73 | 81 | 126 |
| Production Example 29 | 7.6 | 9.0 | 1.6 | Hydrophobic titanium oxide | 0.7 | Hydrophobic silica | 0.7 | 0.00807 | 0.00738 | 73 | 81 | 124 |
| Production Example 30 | 7.6 | 8.6 | 1.1 | Hydrophobic titanium oxide | 0.7 | Hydrophobic silica | 0.7 | 0.00812 | 0.00746 | 74 | 82 | 123 |
| Production Example 31 | 7.8 | 5.8 | 1.7 | Hydrophobic titanium oxide | 0.7 | Hydrophobic silica | 0.7 | 0.00857 | 0.00758 | 73 | 83 | 124 |
| Production Example 32 | 7.7 | 6.3 | 1.6 | Hydrophobic titanium oxide | 0.7 | Hydrophobic silica | 0.7 | 0.00789 | 0.00708 | 74 | 83 | 123 |
| Production Example 33 | 7.6 | 8.5 | 1.0 | Hydrophobic titanium oxide | 0.7 | Hydrophobic silica | 0.7 | 0.00798 | 0.00709 | 73 | 83 | 124 |
| Production Example 34 | 7.7 | 6.2 | 1.8 | Hydrophobic titanium oxide | 0.7 | Hydrophobic silica | 0.7 | 0.00815 | 0.00724 | 73 | 82 | 124 |

TABLE 7-continued

Summary of toners, (2)-b

| Production Examples | Toner particle diameter: Weight-average particle diameter (μM) | Toner particle diameter: 4 μm or less (% by number) | Toner particle diameter: 12.7 μm or more (vol. %) | External additives: Types | External additives: Dose rates (wt. %) | External additives: Types | External additives: Dose rates (wt. %) | tan δ at $5 \times 10^4$ Hz | tan δ at $10^5$ Hz | Carr's flow-ability index | Carr's flood-ability index | Contact angle with water |
|---|---|---|---|---|---|---|---|---|---|---|---|---|
| Production Example 35 | 7.8 | 6.1 | 1.7 | Hydrophobic titanium oxide | 0.7 | Hydrophobic silica | 0.7 | 0.00818 | 0.00718 | 74 | 83 | 125 |

TABLE 8

Summary of toners, (3)-a

| Production Examples | Charge quantities (parts per 100 parts of polymerizable monomer or binder resin): Organometallic compounds: Types | Organometallic compounds: Parts | Organometallic compounds: Types | Organometallic compounds: Parts | Alkali metals: Types | Alkali metals: Parts (as carbonated) | Pigments: Types | Pigments: Parts |
|---|---|---|---|---|---|---|---|---|
| Production Example 36 | Azo-based iron compound | 1.5 | Aluminum compound of di-t-butylsalicylic acid | 4.5 | Potassium | 0.007 | Carbon black (1) | 10 |
| Production Example 37 | Azo-based iron compound | 1 | Aluminum compound of di-t-butylsalicylic acid | 3 | Potassium | 0.007 | Carbon black (1) | 10 |
| Production Example 38 | — | 0 | Aluminum compound of di-t-butylsalicylic acid | 1 | Potassium | 0.035 | Carbon black (1) | 10 |
| Production Example 39 | Azo-based iron compound | 0.5 | Aluminum compound of di-t-butylsalicylic acid | 1 | Potassium | 0.035 | Carbon black (1) | 10 |
| Production Example 40 (magenta) | — | 0 | Aluminum compound of di-t-butylsalicylic acid | 1 | — | 0 | Quinacridon | 8 |
| Production Example 41 (cyan) | — | 0 | Aluminum compound of di-t-butylsalicylic acid | 1 | — | 0 | Phthalocyanine | 6.5 |
| Production Example 42 (yellow) | — | 0 | Aluminum compound of di-t-butylsalicylic acid | 1 | — | 0 | Pigment yellow 93 | 6 |
| Production Example 43 | — | 0 | Aluminum compound of di-t-butylsalicylic acid | 5 | Potassium | 0.02 | Carbon black (1) | 6 |
| Production Comparative Example 13 | — | 0 | Aluminum compound of di-t-butylsalicylic acid | 5 | — | 0 | Carbon black (1) | 6 |
| Production Example 44 | — | 0 | Aluminum compound of di-t-butylsalicylic acid | 5 | Potassium | 0.011 | Carbon black (1) | 6 |
| Production Comparative Example 14 | — | 0 | Aluminum compound of di-t-butylsalicylic acid | 5 | Potassium | 0.004 | Carbon black (1) | 6 |
| Production Example 45 | — | 0 | Aluminum compound of di-t-butylsalicylic acid | 5 | Potassium | 0.09 | Carbon black (1) | 6 |
| Production Comparative Example 15 | — | 0 | Aluminum compound of di-t-butylsalicylic acid | 5 | Potassium | 0.12 | Carbon black (1) | 6 |
| Production Comparative Example 16 | — | 0 | — | 0 | Potassium | 0.02 | Carbon black (1) | 6 |
| Production Example 46 | — | 0 | Aluminum compound of di-t-butylsalicylic acid | 5 | Potassium | 0.02 | Carbon black (1) | 6 |
| Production Example 47 | — | 0 | Aluminum compound of di-t-butylsalicylic acid | 5 | Potassium | 0.02 | Carbon black (1) | 6 |
| Production Example 48 | — | 0 | Aluminum compound of di-t-butylsalicylic acid | 5 | Potassium | 0.01 | Carbon black (1) | 7 |
| Production Comparative Example 17 | — | 0 | Aluminum compound of di-t-butylsalicylic acid | 5 | Potassium | 0.008 | Carbon black (1) | 8 |

TABLE 8-continued

| Summary of toners, (3)-a | | | | | | | | |
|---|---|---|---|---|---|---|---|---|
| Production Example 49 | — | 0 | Aluminum compound of di-t-butylsalicylic acid | 5 | Potassium | 0.02 | Carbon black (1) | 6 |
| Production Comparative Example 18 | — | 0 | Aluminum compound of di-t-butylsalicylic acid | 5 | Potassium | 0.02 | Carbon black (1) | 6 |
| Production Example 50 | — | 0 | Aluminum compound of di-t-butylsalicylic acid | 5 | — | 0 | Carbon black (20) | 6 |
| Production Comparative Example 19 | — | 0 | Aluminum compound of di-t-butysalicylic acid | 5 | Potassium | 0.02 | Carbon black (1) | 6 |
| Production Comparative Example 20 | — | 0 | Aluminum compound of di-t-butylsalicylic acid | 5 | Potassium | 0.02 | Carbon black (1) | 6 |

| | Toner particle contents | | | | | PES Resins | |
|---|---|---|---|---|---|---|---|
| Production Example | Alkali metal contents A (ppm) | Carbon black contents B (wt. %) | Organo-metallic compound contents C (wt. %) | A/B | A/C | Acid value (Resin 1/ Resin 2) | Hydroxyl value (Resin 1/ Resin 2) |
| Production Example 36 | 21 | 7.47 | 4.48 | 2.81 | 4.69 | 11.0/ 19.9 | 23.0/ 7.5 |
| Production Example 37 | 21 | 7.58 | 3.03 | 2.77 | 6.93 | 11.0/ 19.9 | 23.0/ 7.5 |
| Production Example 38 | 112 | 7.76 | 0.78 | 14.4 | 144 | 11.0/ 19.9 | 23.0/ 7.5 |
| Production Example 39 | 112 | 7.74 | 1.16 | 14.5 | 96.6 | 11.0/ — | 23.0/ — |
| Production Example 40 (magenta) | 0 | — | 0.77 | — | 0 | 11.0/ — | 23.0/ — |
| Production Example 41 (cyan) | 0 | — | 0.78 | — | 0 | 11.0/ — | 23.0/ — |
| Production Example 42 (yellow) | 0 | — | 0.77 | — | 0 | 11.0/ — | 23.0/ — |
| Production Example 43 | 130 | 5.31 | 4.42 | 24.5 | 29.4 | 10.5 | 18.6 |
| Production Comparative Example 13 | 0 | 5.31 | 4.42 | 0 | 0 | 10.5 | 18.6 |
| Production Example 44 | 14.2 | 5.31 | 4.42 | 2.67 | 3.21 | 10.5 | 18.6 |
| Production Comparative Example 14 | 5.1 | 5.31 | 4.42 | 0.96 | 1.15 | 10.5 | 18.6 |
| Production Example 45 | 198 | 5.31 | 4.42 | 37.3 | 44.8 | 10.5 | 18.6 |
| Production Comparative Example 15 | 290 | 5.30 | 4.42 | 54.7 | 65.6 | 10.5 | 18.6 |
| Production Comparative Example 16 | 132 | 5.55 | 0 | 23.8 | — | 10.5 | 18.6 |
| Production Example 46 | 131 | 5.31 | 4.42 | 24.7 | 29.6 | 10.5 | 18.6 |
| Production Example 47 | 132 | 5.31 | 4.42 | 24.9 | 29.9 | 10.5 | 18.6 |
| Production Example 48 | 5.5 | 6.14 | 4.39 | 0.91 | 1.28 | 10.5 | 18.6 |
| Production Comparative Example 17 | 4.5 | 6.96 | 4.35 | 0.65 | 1.03 | 10.5 | 18.6 |
| Production Example 49 | 129 | 5.31 | 4.42 | 24.3 | 29.2 | 10.5 | 18.6 |
| Production Comparative Example 18 | 130 | 5.31 | 4.42 | 24.5 | 29.4 | 10.5 | 18.6 |
| Production Example 50 | 65 | 5.31 | 4.42 | 12.2 | 14.7 | 10.5 | 18.6 |

TABLE 8-continued

| Summary of toners, (3)-a | | | | | | | |
|---|---|---|---|---|---|---|---|
| Production Comparative Example 19 | 130 | 5.31 | 4.42 | 24.5 | 29.4 | 10.5 | 18.6 |
| Production Comparative Example 20 | 129 | 5.31 | 4.42 | 24.3 | 29.2 | 10.5 | 18.6 |

TABLE 9

Summary of toners, (3)-b

| | Toner particle diameter | | | External additives | | | | tan δ | | | | |
|---|---|---|---|---|---|---|---|---|---|---|---|---|
| Production Examples | Weight-average particle diameter (μM) | 4 μm or less (% by number) | 12.7 μm or more (vol. %) | Types | Dose rates (wt. %) | Types | Dose rates (wt. %) | at $5 \times 10^4$ Hz | at $10^5$ Hz | Carr's flowability index | Carr's flooda-bility index | Contact angle with water |
| Production Example 36 | 7.5 | 8.1 | 1.4 | Hydrophobic titanium oxide | 0.7 | Hydrophobic silica | 0.7 | 0.00834 | 0.00758 | 73 | 82 | 123 |
| Production Example 37 | 7.6 | 7.8 | 1.3 | Hydrophobic titanium oxide | 0.7 | Hydrophobic silica | 0.7 | 0.00812 | 0.00732 | 72 | 81 | 124 |
| Production Example 38 | 7.8 | 6.0 | 1.7 | Hydrophobic titanium oxide | 0.7 | Hydrophobic silica | 0.7 | 0.00736 | 0.00588 | 74 | 81 | 123 |
| Production Example 39 | 7.9 | 6.5 | 1.4 | Hydrophobic titanium oxide | 0.7 | Hydrophobic silica | 0.7 | 0.00735 | 0.00538 | 75 | 81 | 128 |
| Production Example 40 (magenta) | 7.3 | 8.6 | 1.8 | Hydrophobic titanium oxide | 0.7 | Untreated hydrophobic silica | 0.7 | Not measured | Not measured | 73 | 82 | 124 |
| Production Example 41 (cyan) | 7.4 | 8.7 | 1.7 | Hydrophobic titanium oxide | 0.7 | Hydrophobic silica | 0.7 | Not measured | Not measured | 74 | 83 | 125 |
| Production Example 42 (Yellow) | 7.3 | 8.9 | 1.8 | Hydrophobic titanium oxide | 0.7 | Hydrophobic silica | 0.7 | Not measured | Not measured | 74 | 83 | 124 |
| Production Example 43 | 7.8 | 6.1 | 1.3 | Hydrophobic titanium oxide | 1.1 | Strontium titanate | 0.2 | 0.00528 | 0.00618 | 83 | 90 | 128 |
| Production Comparative Example 12 | 7.7 | 6.2 | 1.8 | Hydrophobic titanium oxide | 1.1 | Strontium titanate | 0.2 | 0.0125 | 0.0133 | 69 | 77 | 119 |
| Production Example 44 | 7.8 | 6.0 | 1.7 | Hydrophobic titanium oxide | 1.1 | Strontium titanate | 0.2 | 0.0121 | 0.0102 | 73 | 82 | 120 |
| Production Comparative Example 14 | 7.7 | 6.3 | 1.6 | Hydrophobic titanium oxide | 1.1 | Strontium titanate | 0.2 | 0.0124 | 0.0104 | 71 | 80 | 122 |
| Production Example 45 | 7.8 | 6.1 | 1.7 | Hydrophobic titanium oxide | 1.1 | Strontium titanate | 0.2 | 0.00501 | 0.00598 | 78 | 86 | 125 |
| Production Comparative Example 15 | 7.7 | 6.1 | 1.8 | Hydrophobic titanium oxide | 1.1 | Strontium titanate | 0.2 | 0.00476 | 0.00651 | 76 | 84 | 125 |
| Production Comparative Example 16 | 7.8 | 5.8 | 1.7 | Hydrophobic titanium oxide | 1.1 | Strontium titanate | 0.2 | 0.00146 | 0.0131 | 69 | 77 | 122 |
| Production Example 46 | 5.4 | 24.0 | 0.0 | Hydrophobic titanium oxide | 1.1 | Strontium titanate | 0.2 | 0.00569 | 0.00651 | 73 | 79 | 121 |
| Production Example 47 | 9.5 | 4.5 | 2.4 | Hydrophobic titanium oxide | 1.1 | Strontium titanate | 0.2 | 0.00506 | 0.00601 | 82 | 92 | 124 |
| Production Example 48 | 7.7 | 6.2 | 1.8 | Hydrophobic titanium oxide | 1.1 | Strontium titanate | 0.2 | 0.0102 | 0.0104 | 75 | 82 | 123 |
| Production Comparative Example 17 | 7.8 | 6.1 | 1.7 | Hydrophobic titanium oxide | 1.1 | Strontium titanate | 0.2 | 0.0134 | 0.0155 | 71 | 75 | 124 |
| Production Example 49 | 6.5 | 15.4 | 0.3 | Hydrophobic titanium oxide | 0.3 | Strontium titanate | 0.2 | 0.00539 | 0.00629 | 57 | 72 | 119 |
| Production Comparative Example 18 | 6.2 | 16.8 | 0.1 | Hydrophobic titanium oxide | 0.2 | Strontium titanate | 0.2 | 0.00547 | 0.00641 | 49 | 63 | 117 |
| Production Example 50 | 7.7 | 6.3 | 1.6 | Hydrophobic titanium oxide | 1.1 | Strontium titanate | 0.2 | 0.00518 | 0.00606 | 79 | 89 | 125 |

TABLE 9-continued

Summary of toners, (3)-b

| Production Examples | Toner particle diameter: Weight-average particle diameter (μM) | Toner particle diameter: 4 μm or less (% by number) | Toner particle diameter: 12.7 μm or more (vol. %) | External additives: Types | External additives: Dose rates (wt. %) | External additives: Types | External additives: Dose rates (wt. %) | tan δ: at $5 \times 10^4$ Hz | tan δ: at $10^5$ Hz | Carr's flowability index | Carr's flooda-bility index | Contact angle with water |
|---|---|---|---|---|---|---|---|---|---|---|---|---|
| Production Comparative Example 19 | 3.4 | 29.0 | 0.0 | Hydrophobic titanium oxide | 1.1 | Strontium titanate | 0.2 | 0.00526 | 0.00681 | 67 | 74 | 119 |
| Production Comparative Example 20 | 11.4 | 2.8 | 2.9 | Hydrophobic titanium oxide | 1.1 | Strontium titanate | 0.2 | 0.00478 | 0.00581 | 83 | 93 | 125 |

TABLE 10

Example

| | Toner No. | Carrier No. | Image density: Initial stage N/N | Image density: Initial stage N/L | Image density: Initial stage H/H | Image density: 30,000th copy N/N | Image density: 30,000th copy N/L | Image density: 30,000th copy H/H | Solid image uniformity: Initial stage H/H | Solid image uniformity: 30,000th copy H/H | Fogging: Initial stage N/L | Fogging: Initial stage H/H | Fogging: 30,000th copy N/L | Fogging: 30,000th copy H/H |
|---|---|---|---|---|---|---|---|---|---|---|---|---|---|---|
| Example 1 | 1 | I | 1.50 | 1.49 | 1.51 | 1.49 | 1.50 | 1.55 | A | A | A | A | A | A |
| Example 2 | 2 | I | 1.51 | 1.49 | 1.50 | 1.50 | 1.49 | 1.54 | A | A | A | A | A | A |
| Example 3 | 3 | I | 1.47 | 1.46 | 1.47 | 1.47 | 1.46 | 1.48 | A | B | A | B | B | B |
| Example 4 | 4 | I | 1.49 | 1.49 | 1.50 | 1.49 | 1.50 | 1.50 | A | C | A | C | B | C |
| Example 5 | 5 | I | 1.47 | 1.46 | 1.47 | 1.47 | 1.46 | 1.48 | A | B | A | B | B | B |
| Example 6 | 6 | I | 1.48 | 1.46 | 1.46 | 1.46 | 1.47 | 1.48 | A | B | A | B | A | B |
| Example 7 | 7 | I | 1.47 | 1.47 | 1.46 | 1.46 | 1.47 | 1.47 | A | B | A | B | A | B |
| Example 8 | 8 | I | 1.48 | 1.47 | 1.47 | 1.47 | 1.45 | 1.46 | A | B | A | B | A | B |
| Example 9 | 9 | I | 1.49 | 1.51 | 1.51 | 1.50 | 1.51 | 1.47 | A | A | B | B | B | B |
| Example 10 | 10 | I | 1.51 | 1.51 | 1.50 | 1.50 | 1.50 | 1.53 | A | A | A | A | A | A |
| Example 11 | 11 | I | 1.55 | 1.56 | 1.55 | 1.52 | 1.55 | 1.47 | B | C | A | B | A | C |
| Example 12 | 12 | I | 1.50 | 1.48 | 1.50 | 1.50 | 1.49 | 1.54 | B | C | B | B | B | B |
| Example 13 | 13 | I | 1.48 | 1.47 | 1.47 | 1.47 | 1.48 | 1.49 | A | A | B | B | B | B |
| Example 14 | 14 | I | 1.51 | 1.49 | 1.50 | 1.50 | 1.49 | 1.54 | A | A | A | A | A | A |
| Example 15 | 15 | I | 1.51 | 1.49 | 1.50 | 1.50 | 1.49 | 1.54 | A | A | A | A | A | B |
| Example 16 | 16 | I | 1.50 | 1.51 | 1.50 | 1.50 | 1.49 | 1.51 | A | B | A | B | B | A |
| Example 17 | 17 | I | 1.51 | 1.49 | 1.50 | 1.50 | 1.49 | 1.54 | A | C | A | A | A | B |
| Example 18 | 18 | I | 1.49 | 1.47 | 1.41 | 1.49 | 1.49 | 1.36 | B | C | B | B | B | C |
| Example 19 | 19 | I | 1.39 | 1.38 | 1.35 | 1.38 | 1.36 | 1.29 | A | A | A | A | A | A |
| Example 20 | 20 | I | 1.46 | 1.47 | 1.44 | 1.44 | 1.44 | 1.41 | B | C | B | B | B | C |
| Example 21 | 21 | I | 1.46 | 1.48 | 1.39 | 1.46 | 1.46 | 1.29 | B | C | B | B | B | C |
| Example 22 | 22 | I | 1.28 | 1.29 | 1.31 | 1.26 | 1.22 | 1.20 | B | B | B | C | B | C |
| Example 23 | 23 | I | 1.48 | 1.47 | 1.41 | 1.47 | 1.49 | 1.39 | C | C | B | C | B | C |
| Example 24 | 24 | I | 1.48 | 1.51 | 1.42 | 1.46 | 1.49 | 1.41 | B | C | B | C | B | C |
| Example 25 | 25 | I | 1.48 | 1.48 | 1.28 | 1.37 | 1.34 | 1.22 | C | C | C | D | C | D |
| Example 26 | 26 | I | 1.39 | 1.38 | 1.32 | 1.37 | 1.34 | 1.29 | C | C | B | C | B | C |

| | Image qualifier: Initial stage N/L | Image qualifier: Initial stage H/H | Image qualifier: 30,000th copy N/L | Image qualifier: 30,000th copy H/H | Toner scattering after 30,000th copy H/H | Image density stability H/H |
|---|---|---|---|---|---|---|
| Example 1 | A | A | A | A | A | A |
| Example 2 | A | A | A | A | A | A |
| Example 3 | A | B | A | B | B | B |
| Example 4 | A | B | A | B | C | C |
| Example 5 | A | B | A | B | B | B |
| Example 6 | A | B | A | B | B | B |
| Example 7 | A | B | A | B | B | B |
| Example 8 | A | B | A | B | B | B |
| Example 9 | A | A | A | A | C | B |
| Example 10 | B | B | B | C | A | A |
| Example 11 | A | A | B | C | C | B |
| Example 12 | B | B | B | C | B | A |
| Example 13 | A | A | A | A | A | A |
| Example 14 | A | A | A | A | A | A |
| Example 15 | A | A | A | A | A | C |

TABLE 10-continued

| Example | | | | | | |
|---|---|---|---|---|---|---|
| Example 16 | A | A | A | B | C | B |
| Example 17 | A | B | A | B | B | A |
| Example 18 | A | B | A | B | A | A |
| Example 19 | A | B | B | B | A | A |
| Example 20 | A | B | A | B | A | B |
| Example 21 | A | B | A | B | A | B |
| Example 22 | B | C | C | C | B | A |
| Example 23 | A | B | A | B | A | B |
| Example 24 | A | B | A | B | A | A |
| Example 25 | A | B | A | B | A | B |
| Example 26 | B | C | C | C | B | B |

TABLE 11

| Example | | | | | | | | | | | | | | |
|---|---|---|---|---|---|---|---|---|---|---|---|---|---|---|
| | | | | | | | | | | Solid image uniformity | | Fogging | | | |
| | | | Image density | | | | | | | | 30,000th | | | 30,000th | |
| | | | Initial stage | | | 30,000th copy | | | Initial stage | copy | Initial stage | | copy | |
| | Toner No. | Carrier No. | N/N | N/L | H/H | N/N | N/L | H/H | H/H | H/H | N/L | H/H | N/L | H/H |
| Example 27 | 27 | I | 1.50 | 1.50 | 1.46 | 1.49 | 1.51 | 1.45 | B | B | A | A | A | B |
| Example 28 | 28 | I | 1.47 | 1.48 | 1.47 | 1.48 | 1.47 | 1.46 | A | A | A | A | A | B |
| Example 29 | 29 | I | 1.44 | 1.45 | 1.45 | 1.44 | 1.44 | 1.43 | A | B | A | B | A | B |
| Example 30 | 30 | I | 1.50 | 1.51 | 1.46 | 1.49 | 1.50 | 1.45 | B | B | A | A | A | B |
| Example 31 | 31 | I | 1.45 | 1.44 | 1.45 | 1.45 | 1.45 | 1.42 | A | B | A | B | A | B |
| Example 32 | 32 | I | 1.50 | 1.50 | 1.46 | 1.49 | 1.51 | 1.45 | B | C | A | B | A | B |
| Example 33 | 33 | I | 1.50 | 1.51 | 1.45 | 1.49 | 1.50 | 1.44 | A | B | B | B | A | B |
| Example 34 | 34 | I | 1.50 | 1.49 | 1.46 | 1.49 | 1.49 | 1.45 | A | B | A | A | A | B |
| Example 35 | 35 | I | 1.48 | 1.46 | 1.44 | 1.48 | 1.47 | 1.39 | A | B | A | B | A | B |
| Example 36 | 36 | I | 1.45 | 1.46 | 1.46 | 1.46 | 1.48 | 1.43 | B | B | A | B | A | B |
| Example 37 | 37 | I | 1.48 | 1.49 | 1.50 | 1.47 | 1.48 | 1.47 | A | B | A | A | A | B |
| Example 38 | 38 | I | 1.47 | 1.46 | 1.47 | 1.47 | 1.46 | 1.48 | A | A | A | A | A | A |
| Example 39 | 39 | I | 1.48 | 1.48 | 1.47 | 1.48 | 1.49 | 1.47 | A | A | A | A | A | A |
| Example 40 | 1, 40, 41, 42 | I | 1.49 | 1.51 | 1.51 | 1.48 | 1.49 | 1.50 | A | A | A | A | A | A |
| Example 41 | 1, 40, 41, 42 | I | 1.53 | 1.54 | 1.53 | 1.52 | 1.51 | 1.55 | A | A | A | A | A | A |
| Example 42 | 1, 40, 41, 42 | I | 1.49 | 1.50 | 1.51 | 1.48 | 1.48 | 1.50 | A | A | A | A | A | A |
| Example 43 | 1 | I | 1.48 | 1.49 | 1.50 | 1.48 | 1.48 | 1.50 | A | A | A | A | A | A |
| Example 44 | 1 | II | 1.49 | 1.51 | 1.51 | 1.48 | 1.49 | 1.50 | A | A | A | B | A | B |
| Example 45 | 43 | II | 1.54 | 1.51 | 1.52 | 1.52 | 1.51 | 1.56 | A | A | A | A | A | A |
| Example 46 | 41 | II | 1.47 | 1.47 | 1.48 | 1.47 | 1.47 | 1.48 | A | B | A | B | B | B |
| Example 47 | 43 | II | 1.52 | 1.52 | 1.53 | 1.52 | 1.53 | 1.52 | A | C | A | C | B | C |
| Example 48 | 46 | II | 1.52 | 1.54 | 1.54 | 1.53 | 1.54 | 1.50 | A | A | B | B | B | B |
| Example 49 | 47 | II | 1.54 | 1.53 | 1.52 | 1.52 | 1.52 | 1.55 | A | A | A | A | A | A |
| Example 50 | 48 | II | 1.58 | 1.59 | 1.58 | 1.55 | 1.58 | 1.50 | B | C | A | B | A | C |
| Example 51 | 49 | II | 1.53 | 1.50 | 1.52 | 1.52 | 1.51 | 1.56 | B | C | B | B | B | B |
| Example 52 | 50 | II | 1.54 | 1.52 | 1.53 | 1.53 | 1.52 | 1.57 | A | A | A | A | A | A |

| | Image qualifier | | | | Toner scattering after 30,000th | |
|---|---|---|---|---|---|---|
| | Initial stage | | 30,000th copy | | copy | Image density stability |
| | N/L | H/H | N/L | H/H | H/H | H/H |
| Example 27 | A | A | A | B | A | A |
| Example 28 | A | A | A | A | A | A |
| Example 29 | A | A | A | A | A | A |
| Example 30 | A | A | A | B | A | A |
| Example 31 | A | A | A | A | A | C |
| Example 32 | A | A | A | B | A | A |
| Example 33 | A | A | A | B | A | A |
| Example 34 | A | A | A | B | A | A |
| Example 35 | A | A | A | A | A | B |
| Example 36 | A | B | A | B | B | B |
| Example 37 | A | B | A | B | B | B |
| Example 38 | A | A | A | A | A | A |
| Example 39 | A | A | A | A | A | A |
| Example 40 | A | A | A | A | A | A |
| Example 41 | A | A | A | A | A | A |
| Example 42 | A | B | A | B | A | A |

TABLE 11-continued

| Example | | | | | | |
|---|---|---|---|---|---|---|
| Example 43 | A | B | A | B | A | A |
| Example 44 | A | A | A | A | A | A |
| Example 45 | A | A | A | A | A | A |
| Example 46 | A | B | A | B | B | B |
| Example 47 | A | B | A | B | C | C |
| Example 48 | A | A | A | A | C | B |
| Example 49 | B | B | B | C | A | A |
| Example 50 | A | A | B | C | C | B |
| Example 51 | B | B | B | C | B | A |
| Example 52 | A | A | A | A | A | A |

* Number of copies produced during the durability test was 15,000 only for Example 43

TABLE 12

| Comparative Example | | | | | | | | | | | | | | |
|---|---|---|---|---|---|---|---|---|---|---|---|---|---|---|
| | | | Image density | | | | | | Solid image uniformity | | Fogging | | | |
| | Toner | Carrier | Initial stage | | | 30,000th copy | | | Inital stage | 30,000th copy | Initial stage | | 30,000th copy | |
| | No. | No. | N/N | N/L | H/H | N/N | N/L | H/H | H/H | H/H | N/H | H/H | N/L | H/H |
| Comparative Example 1 | 1 | I | 1.08 | 1.15 | 1.00 | 1.02 | 1.07 | 0.91 | E | F | D | E | E | E |
| Comparative Example 2 | 2 | I | 1.06 | 1.15 | 1.01 | 1.01 | 1.06 | 0.89 | E | F | D | E | E | F |
| Comparative Example 3 | 3 | I | 1.28 | 1.33 | 1.24 | 1.25 | 1.32 | 1.12 | B | F | A | D | B | E |
| Comparative Example 4 | 4 | I | 1.36 | 1.41 | 1.38 | 1.35 | 1.37 | 1.08 | B | E | A | C | B | E |
| Comparative Example 5 | 5 | I | 1.36 | 1.41 | 1.38 | 1.35 | 1.15 | 1.03 | B | E | A | C | B | E |
| Comparative Example 6 | 6 | I | 1.38 | 1.36 | 1.24 | 1.21 | 1.15 | 1.03 | B | F | B | D | B | D |
| Comparative Example 7 | 7 | I | 1.39 | 1.34 | 1.41 | 1.17 | 1.07 | 1.09 | B | F | E | E | F | F |
| Comparative Example 8 | 8 | I | 1.41 | 1.41 | 1.42 | 1.40 | 1.40 | 1.43 | A | A | A | A | A | A |
| Comparative Example 9 | 9 | I | 1.56 | 1.56 | 1.57 | 1.42 | 1.45 | 1.27 | D | F | A | C | A | D |
| Comparative Example 10 | 10 | I | 1.40 | 1.38 | 1.40 | 1.40 | 1.39 | 1.44 | B | D | D | D | D | E |
| Comparative Example 11 | 11 | I | 1.36 | 1.40 | 1.39 | 1.34 | 1.36 | 1.07 | B | E | A | C | B | E |
| Comparative Example 12 | 12 | I | 1.27 | 1.31 | 1.25 | 1.25 | 1.31 | 1.11 | B | F | A | D | B | E |
| Comparative Example 13 | 13 | II | 1.07 | 1.17 | 1.03 | 1.03 | 1.08 | 0.91 | E | F | D | E | E | F |
| Comparative Example 14 | 14 | II | 1.29 | 1.35 | 1.26 | 1.27 | 1.34 | 1.14 | B | F | A | D | B | E |
| Comparative Example 15 | 15 | II | 1.38 | 1.43 | 1.40 | 1.37 | 1.39 | 1.10 | B | E | A | C | B | E |
| Comparative Example 16 | 16 | II | 1.40 | 1.38 | 1.26 | 1.23 | 1.17 | 1.05 | B | F | B | D | B | D |
| Comparative Example 17 | 17 | II | 1.56 | 1.55 | 1.57 | 1.43 | 1.45 | 1.27 | D | F | A | C | A | D |
| Comparative Example 18 | 18 | II | 1.42 | 1.40 | 1.42 | 1.42 | 1.41 | 1.46 | B | D | D | D | D | E |
| Comparative Example 19 | 19 | II | 1.41 | 1.36 | 1.43 | 1.42 | 1.29 | 1.21 | B | F | E | E | F | F |
| Comparative Example 20 | 20 | I | 1.43 | 1.43 | 1.44 | 1.42 | 1.42 | 1.45 | A | A | A | A | A | A |

| | Image qualifier | | | | Toner scattering | |
|---|---|---|---|---|---|---|
| | Initial stage | | 30,000th copy | | after 30,000th copy | Image density stability |
| | N/L | H/H | N/L | H/H | H/H | H/H |
| Comparative Example 1 | C | D | C | D | F | F |
| Comparative Example 2 | D | D | C | D | F | F |

TABLE 12-continued

| Comparative Example | | | | | | |
|---|---|---|---|---|---|---|
| Comparative Example 3 | B | C | B | C | E | E |
| Comparative Example 4 | B | C | B | C | D | D |
| Comparative Example 5 | B | C | B | C | D | D |
| Comparative Example 6 | A | C | C | D | E | E |
| Comparative Example 7 | B | B | C | E | F | E |
| Comparative Example 8 | D | D | E | F | A | A |
| Comparative Example 9 | B | C | C | E | E | E |
| Comparative Example 10 | B | B | D | E | B | A |
| Comparative Example 11 | B | B | B | B | D | D |
| Comparative Example 12 | B | C | B | C | E | E |
| Comparative Example 13 | D | D | C | D | F | F |
| Comparative Example 14 | B | C | B | C | E | E |
| Comparative Example 15 | B | B | B | B | D | D |
| Comparative Example 16 | A | C | A | D | E | E |
| Comparative Example 17 | B | C | C | E | E | E |
| Comparative Example 18 | B | B | D | E | B | A |
| Comparative Example 19 | B | B | C | E | F | E |
| Comparative Example 20 | D | D | E | F | A | A |

What is claimed is:

1. A non-metallic black toner comprising toner particles containing at least a binder resin, a carbon black and an organometallic compound, and an external additive, wherein:

the toner particles contain 10 to 200 ppm of at least one kind of alkali metal element;

the toner particles contain at least one kind of organometallic compound selected from organoiron compounds, organoaluminum compounds, organochromium compounds, organozinc compounds, organoboron compounds, and organozirconium compounds;

the toner particles contain a polyester resin as a resin component; and the non-metallic black toner has a weight-average particle diameter of 4 to 11 $\mu$m, the following loss tangents tan δ shown by dielectric loss factor ∈"/dielectric constant ∈' at frequencies of $5\times10^4$ Hz and $10^5$ Hz:

$$\tan\delta\ (5\times10^4\ \text{Hz})\leqq0.0125$$

$$\tan\delta\ (10^5\ \text{Hz})\leqq0.0105,$$

a Carr's flowability index of 50 or more, and a Carr's floodability index of 65 or more.

2. The toner according to claim 1, wherein the toner particles contain 20 to 170 ppm of alkali metal elements.

3. The toner according to claim 1, wherein potassium is most contained aong alkali metal elements contained in toner particles.

4. The toner according to claim 1, wherein the alkali metal eements in the toner particles are contained in the carbon black.

5. The toner according to claim 4, wherein the carbon black contains 50 to 1,000 ppm of alkali metal elements on the basis of the weight of the carbon black.

6. The toner according to claim 1, wherein the organometallic compound is an organoiron compound, an organoaluminum compound, or an organozinc compound.

7. The toner according to claim 1, wherein the organometallic compound is an azo-based metallic compound.

8. The toner according to claim 1, wherein the organometallic compound is a hydroxycarboxylic acid metal compound.

9. The toner according to claim 1, wherein the polyester resin in the toner particles has an acid value of 5 to 30 mgKOH/g.

10. The toner according to claim 1, wherein the non-metallic black toner has the following loss tangents tan δ shown by dielectric loss factor ∈"/dielectric constant ∈' at frequencies of $5\times10^4$ Hz and $10^5$ Hz:

$$\tan\delta\ (5\times10^4\ \text{Hz})\leqq0.0110$$

$$\tan\delta\ (10^5\ \text{Hz})\leqq0.0090.$$

11. The toner according to claim 1, wherein the no-metallic black toner has a Carr's flowability index of 60 or more, and a Carr's floodability index of 75 or more.

12. The toner according to claim 1, wherein the non-metallic black toner has a contact angle of 110° or more to water.

13. The toner according to claim 1, wherein the carbon black has an average primary particle diameter of 13 to 55 nm, pH of 7 or more, a volatile matter of 1% or leass, a DBP oil absorption of 20 to 100 ml for 100 g, a toluene extraction of 0.1% or less, a residue-on-sieve of 250 ppm or less, and a bulk density of 650 g/lit. or less.

14. The toner according to claim 13, wherein the carbon black has an average primary particle diameter of 25 to 50 nm.

15. The toner according to claim 13, wherein the carbon black has pH of 7.5 to 10.5.

16. The toner according to claim 13, wherein the carbon black has a volatile matter of 0.8% or less.

17. The toner according to claim 13, wherein the carbon black has a DBP oil absorption of 30 to 60 ml for 100 g.

18. The toner according to claim 13, wherein the carbon black has a toluene extraction of 0.05% or less.

19. The toner according to claim 13, wherein the carbon black has a residue-on-sieve of 100 ppm or less.

20. The toner according to claim 13, wherein the carbon black has a bulk density of 500 g/lit. or less.

21. The toner according to claim 1, wherein the toner particles contain 0.8 to 20 percent by weight of the carbon black.

22. The toner acoording to claim 1, wherein toner particles contain 2 to 15 percent by weight of the carbon black.

23. The toner according to claim 1, wherein toner particles contain 0.1 to 8 percent by weight of the organometallic compound.

24. The toner according to claim 1, wherein toner particles contain 0.3 to 6 percent by weight of the organometallic compound.

25. The toner according to claim 1, wherein non-metallic black toner has a weight-average particle diameter of 6 to 9 $\mu$m.

26. The toner according to claim 1, wherein toner contains 20 percent or less by number of particles having a diameter of 4 $\mu$m or less and 3.5 percent or less by volume of particles having a diameter of 12.7 $\mu$m or more.

27. An image forming method comprising:

a development step of developing an electrostatic latent image held by a latent image holding member with a non-metallic black toner and forming a toner image;

a transfer step of transferring the toner image formed on the latent image holding member onto a recording material through or not through an intermediate transfer medium; and a fixing step of fixing the toner image transferred onto the recording material, wherein:

the non-metallic black toner is a non-matallic black toner comprising toner particles containing at least a binder resin, a carbon black and an organometallic compound, and an external additive;

the toner particles contain 10 to 200 ppm of at least one kind of alkali metal element;

the toner particles contain at least one type of organometallic compound selected from organoiron compounds, organoaluminum compounds, organochromium compounds, organozine compounds, organoboron compounds, and organozirconium compounds;

the toner particles contain a polyester resin as a resin component; and the non-metallic black toner has a weight-average particle diameter of 4 to 11 $\mu$m, the following loss tangents tan $\delta$ shown by dielectric los factor $\in''$/dielectric constant $\in'$ at frequencies of $5\times10^4$ Hz and $10^5$ Hz:

$$\tan\delta\ (5\times10^4\ \text{Hz}) \leqq 0.0125$$

$$\tan\delta\ (10^5\ \text{Hz}) \leqq 0.0105,$$

a Carr's flowability index of 50 or more, and a Carr's floodability index of 65 or more.

28. The image forming method according to claim 27, wherein the toner image supplied to the fixing step is a color toner image having the non-metallic, black toner and chromatic color toner.

29. The image forming method according to claim 27, wherein the toner image supplied to the fixing step is a full-color toner image having the non-metallic, black toner, cyan toner, magenta toner, and yellow toner.

30. The image forming method according to claim 27, wherein the latent image holding member is an electrophotographic photosensitive member.

31. An image forming method comprising:

a development step of developing an electrostatic latent image held by a latent image holding member and forming a toner image;

a transfer step of transferring the toner image formed on the latent image holding member onto a recording material through or not through an intermediate transfer member; and a fixing step of fixing the toner image transferred onto the recording material, wherein the non-metallic black toner is the toner according to any one of claims 2 to 26.

* * * * *

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Title page,
Item [57], ABSTRACT, "disclose," should read -- disclosed --.

Column 1,
Line 47, "toners." should read -- toner. --.

Column 3,
Line 54, "10 Hz:" should read -- $10^5$Hz: --.

Column 4,
Line 3, "sowing" should read -- showing --.

Column 5,
Line 9, "two" should read -- where two --; and
Line 36, "$H^{\theta}O^{\theta}$—" should read -- $H_{l}{}^{\oplus}O^{\theta}$- --; and
Line 39, "not like" should read -- unlike --.

Column 7,
Line 28, "extration" should read -- extraction --; and
Line 34, "surfaces" should read -- surface, --.

Column 10,
Line 24, "as other" should read -- of other --.

Column 11,
Line 22, "cross-liked" should read -- cross-linked --; and
Line 40, "uniform, for" should read -- uniform. For --.

Column 12,
Line 6, "be" should read -- at --; and
Line 46, "asides," should read -- amides, --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 13,
Line 18, "aiming" should read -- desired --; and
Line 24, "aster" should read -- ester --; and
Line 29, "aster" should read -- ester --; and
Line 37, "comnpounds" should read -- compounds --; and "disired" should read -- desired --; and
Line 39, "ivember" should read -- member --; and
Line 42, "triboalectric" should read -- triboelectric --.

Column 16,
Line 59, "trans ission" should read -- transmission --.

Column 17,
Line 24, "orgenosilicon" should read -- organosilicon --; and
Line 26, "examples," should read -- example, --; and
Line 35, "by parts" should read -- by weight --; and
Line 55, "the," should read -- the --.

Column 18,
Line 1, "(tetrafluoroethylens)" should read -- "(tetrafluoroethylene) --; and
Line 4, "hexafluoropropylone" should read -- hexafluoropropylene --; and
Line 5, "copolymer," should read -- copolymer; --; and "fluorlde-" should read -- fluoride- --; and
Line 30, "oxydlethylene" should read -- oxydiethylene --; and
Line 49, "methozyethylens" should read -- methoxyethylene --; and
Line 51, "phanoxytetraethylene" should read -- phenoxytetraethylene --; and
Line 52, "phenoxytetraethylene glycol acrylate" should be deleted, second occurrence; and
Line 59, "acld;" should read -- acid; --.

Column 19,
Line 17, "eaterified" should read -- esterified --; and
Line 32, "malamine" should read -- melamine --; and
Line 60, "$\mu$ m)" should read -- $\mu$ m). --.

Column 20,
Line 42, "it is" should read -- there is --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 21,
Line 34, "mN·sec/$M^2$" should read -- mN/sec/$M^2$ --; and
Line 61, "dimetylaminoethyl" should read -- dimethylaminoethyl --.

Column 22,
Line 51, "the" should read -- The --.

Column 24,
Line 54, "hallow" should read -- hollow --; and
Line 60, "(Kyown" should read -- (Kyowa --; and
Line 61, "with of" should read -- of --; and
Line 63, "Same" should read -- The same --.

Column 25,
Line 10, "measurement" should read -- measurement. --; and
Line 35, "(c)0.1" should read -- (c) 0.1--.

Column 26,
Line 13, "(c)0.5" should read -- (c) 0.5 --; and
Line 18, "8006" should read -- 8006. --; and
Line 28, "fennel," should read -- funnel, --.

Column 27,
Line 11, "are" should read -- is --; and
Line 26, "is.carried" should read -- is carried --.

Column 28,
Table 1, "66" should read -- --66 --; and "67-59" should read -- 67-89 --; and "90" should read -- 90 --.

Column 29,
Line 67, "given" should read -- be given --.

Column 31,
Line 2, "mean" should read -- means --; and
Line 31, "$R_2$" should read -- $R_2$, --; and
Line 39, "a adjustment" should read -- and adjustment --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 32,
Line 13, "am" should read -- as --; and
Line 40, "a electric" should read -- an electric --; and
Line 48, "forth" should read -- fourth --.

Column 33,
Line 7, "64A" should read -- transfer blade 64A --; and
Line 33, "mean" should read -- means --; and "conveyer," should read -- conveyor, --; and
Line 65, "a example" should read -- an example --.

Column 34,
Line 42, "approaches" should read -- approach --.

Column 35,
Line 2, "syan" should read -- cyan --; and
Line 17, "thor-" should read -- through --; and
Line 18, "ough" should be deleted.

Column 36,
Line 37, "hiblade" should read -- blade --.

Column 38,
Line 39, "member" should read -- member --; and
Line 56, "an conductive" should read -- a conductive --.

Column 39,
Line 1, "like" should read -- likely --; and
Line 15, "and" should be deleted; and
Line 56, "its" should read -- is --.

Column 40,
Line 13, "kg/m))." should read -- kg/m) --.

Column 41,
Line 7, "slave:" should read -- sieve: --; and
Line 60, "agitate" should read -- agitate and --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 43,
Line 4, "Emtecnnk" should read -- Emtechnik --; and
Line 17, "agitate" should read -- agitate and --.

Column 45,
Line 26, "more;" should read -- more: --.

Column 46,
Line 24, "0.09g" should read -- 0.09 --; and
Line 48, "ssme" should read -- same --.

Column 47,
Line 12, "hydrophoqized" should read -- hydrophobized --; and
Line 61, "procedure, as" should read -- procedure as --.

Column 48,
Line 36, "Hz);" should read -- Hz): --; and
Line 38, "Carrts" should read -- Carr's --.

Column 51,
Line 53, "contain a" should read -- contain --.

Column 52,
Line 39, "1.21%" should read -- 1.2% --.

Column 53,
Line 6, "100the" should read -- $100^{th}$ --; and
Line 59, "Image" should read -- image --.

Column 57,
Line 50, "caused" should read -- were caused --.

Column 59,
Line 49, "varsied" should read -- varied --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 60,
Line 34, "ratio 6.93" should read -- ratio=6.93 --.

Column 65,
Line 74, "Procuction" (all occurrences) should read -- Production --; and
Table 4, "t-butysalicylic acid" (two occurrences) should read -- t-butylsalicylic acid --.

Column 68,
Table 5,"0.0121 0.1010" should read -- 0.0121 0.0101 --; and "8.1 3.1" should read -- 8.1 1.1 --.

Column 69,
Table 5, "8.1 34" should read -- 81. 1.4 --.

Column 70,
Table 5, "48 80" should read -- 48 60 --.

Column 71,
Table 6, "Production Example 13" (both occurrences) should read -- Production Example 15 --.

Column 71-72,
Table 6, should read: (see attached).

Column 73,
Table 7, "7.3 9.6" should read -- 7.3 9.8 --.

Column 79,
Table 9, "Production Comparative Example 12" should read -- Production Comparative Example 13 --; and and "6.1 1.3" should read -- 6.1 1.7 --.

Column 80,
Table 9, "0.00476 0.00651" should read -- _____ --; and
Table 9, "0.00736 0.00658" should read -- 0.00752 0.00588 --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 81,
Table 10, "23 I 1.48" should read -- 23 I 1.46 --.

Column 82,
Table 10, "Image Qualifier" should read -- Image Qualities --.

Column 83,
Table 11, "1.50 1.49" should read -- 1.50 1.48 --; and "1.48 1.46" should read -- 1.48 1.48 --; and "1.46 1.49" should read -- 1.46 1.49 --; and "1.45 1.45" should read -- 1.43 1.45 --; and "1.49 1.50" should read -- 1.49 1.50 --; and "1.51 1.55" should read -- 1.51 1.52 --; and "1.53 1.52" should read -- 1.53 1.53 --; and "1.54 1.50" should read -- 1.54 1.50 --.

Column 84,
Table 10, "C B B A A A" should read -- C B B A A B --; and
Table 11, "Image Qualifier" should read -- Image Qualities --.

Column 85,
Table 12, "20 I" should read -- 20 II --; and
Table 12, "Image Qualifier" should read -- Image Qualities --.

Column 87,
Line 52, "shown" should read -- are shown --; and
Line 63, "aong" should read -- among --.

Column 88,
Line 59, "no-metallic" should read -- non-metallic --.

UNITED STATES PATENT AND TRADEMARK OFFICE

CERTIFICATE OF CORRECTION

PATENT NO. : 6,316,157 B1
DATED : November 13, 2001
INVENTOR(S) : Junko Yoshikawa et al.

It is certified that error appears in the above-identified patent and that said Letters Patent is hereby corrected as shown below:

Column 90,
Line 15, "los" should read -- loss --.

Signed and Sealed this

Thirtieth Day of April, 2002

*Attest:*

*Attesting Officer*

JAMES E. ROGAN
*Director of the United States Patent and Trademark Office*

[Table 6]

Summary of toners, (2)-a

| Production Example | Charge quantities (parts per 100 parts of polymerizable monomer or binder resin)/Pigments | | | | | | | | Toner particle contents | | | A/B | A/C | PES resin | |
|---|---|---|---|---|---|---|---|---|---|---|---|---|---|---|---|
| | Organometallic compounds | | | | Alkalies metals | | Pigments | | | | | | | | |
| | Types | Parts | Types | Parts | Types | Parts (as substrate) | Types | Parts | | | | | | Acid value (Parts KOH/g) | Hydroxyl value (Parts KOH/g) |
| Production Comparative Example 11 | Azo-based iron compound | 0.5 | Aluminum compound of di-t-butylsalicylic acid | 1 | - | 0 | Carbon black (21) | 10 | 220 | 7.73 | 1.16 | 28.3 | 96.3 | 11.0/15.0 | 23.0/7.5 |
| Production Comparative Example 12 | Azo-based iron compound | 0.5 | Aluminum compound of di-t-butylsalicylic acid | 1 | - | 0 | Carbon black (22) | 10 | 7.0 | 7.73 | 1.16 | 0.01 | 0.03 | 11.0/15.0 | 23.0/7.5 |
| Production Example 15 | Azo-based iron compound | 0.5 | Aluminum compound of di-t-butylsalicylic acid | 1 | Potassium | 0.035 | Carbon black (1) | 10 | 111 | 7.73 | 1.16 | 14.4 | 96.7 | 4.0/3.0 | 9.0/5.0 |
| Production Example 16 | Azo-based iron compound | 0.5 | Aluminum compound of di-t-butylsalicylic acid | 1 | Potassium | 0.035 | Carbon black (1) | 10 | 112 | 7.73 | 1.16 | 14.5 | 96.6 | 33.0/51.0 | 42.0/41.0 |
| Production Example 17 | Azo-based iron compound | 0.5 | Aluminum compound of di-t-butylsalicylic acid | 1 | Potassium | 0.035 | Carbon black (1) | 10 | 116 | 7.73 | 1.16 | 14.9 | 96.1 | 11.0/15.0 | 23.0/7.5 |
| Production Example 18 | Azo-based iron compound | 0.5 | Aluminum compound of di-t-butylsalicylic acid | 1 | Potassium | 0.035 | Carbon black (2) | 10 | 116 | 7.73 | 1.16 | 14.9 | 96.1 | 11.0/15.0 | 23.0/7.5 |
| Production Example 19 | Azo-based iron compound | 0.5 | Aluminum compound of di-t-butylsalicylic acid | 1 | Potassium | 0.035 | Carbon black (3) | 10 | 112 | 7.73 | 1.16 | 14.5 | 96.6 | 11.0/15.0 | 23.0/7.5 |
| Production Example 20 | Azo-based iron compound | 0.5 | Aluminum compound of di-t-butylsalicylic acid | 1 | Potassium | 0.035 | Carbon black (4) | 10 | 114 | 7.73 | 1.16 | 14.7 | 96.3 | 11.0/15.0 | 23.0/7.5 |
| Production Example 21 | Azo-based iron compound | 0.5 | Aluminum compound of di-t-butylsalicylic acid | 1 | Potassium | 0.035 | Carbon black (5) | 10 | 112 | 7.73 | 1.16 | 14.5 | 96.6 | 11.0/15.0 | 23.0/7.5 |
| Production Example 22 | Azo-based iron compound | 0.5 | Aluminum compound of di-t-butylsalicylic acid | 1 | Potassium | 0.035 | Carbon black (6) | 10 | 114 | 7.73 | 1.16 | 14.7 | 96.3 | 11.0/15.0 | 23.0/7.5 |
| Production Example 23 | Azo-based iron compound | 0.5 | Aluminum compound of di-t-butylsalicylic acid | 1 | Potassium | 0.035 | Carbon black (7) | 10 | 116 | 7.73 | 1.16 | 14.9 | 96.1 | 11.0/15.0 | 23.0/7.5 |
| Production Example 24 | Azo-based iron compound | 0.5 | Aluminum compound of di-t-butylsalicylic acid | 1 | Potassium | 0.035 | Carbon black (8) | 10 | 112 | 7.73 | 1.16 | 14.5 | 96.6 | 11.0/15.0 | 23.0/7.5 |
| Production Example 25 | Azo-based iron compound | 0.5 | Aluminum compound of di-t-butylsalicylic acid | 1 | Potassium | 0.035 | Carbon black (9) | 10 | 113 | 7.73 | 1.16 | 14.6 | 97.4 | 11.0/15.0 | 23.0/7.5 |
| Production Example 26 | Azo-based iron compound | 0.5 | Aluminum compound of di-t-butylsalicylic acid | 1 | Potassium | 0.035 | Carbon black (10) | 10 | 113 | 7.73 | 1.16 | 14.6 | 97.4 | 11.0/15.0 | 23.0/7.5 |
| Production Example 27 | Azo-based iron compound | 0.5 | Aluminum compound of di-t-butylsalicylic acid | 1 | Potassium | 0.035 | Carbon black (11) | 10 | 112 | 7.73 | 1.16 | 14.5 | 96.6 | 11.0/15.0 | 23.0/7.5 |
| Production Example 28 | Azo-based iron compound | 0.5 | Aluminum compound of di-t-butylsalicylic acid | 1 | Potassium | 0.035 | Carbon black (12) | 10 | 113 | 7.73 | 1.16 | 14.6 | 97.4 | 11.0/15.0 | 23.0/7.5 |
| Production Example 29 | Azo-based iron compound | 0.5 | Aluminum compound of di-t-butylsalicylic acid | 1 | Potassium | 0.035 | Carbon black (13) | 10 | 112 | 7.73 | 1.16 | 14.5 | 96.6 | 11.0/15.0 | 23.0/7.5 |
| Production Example 30 | Azo-based iron compound | 0.5 | Aluminum compound of di-t-butylsalicylic acid | 1 | Potassium | 0.035 | Carbon black (14) | 10 | 116 | 7.73 | 1.16 | 14.9 | 100 | 11.0/15.0 | 23.0/7.5 |
| Production Example 31 | Azo-based iron compound | 0.5 | Aluminum compound of di-t-butylsalicylic acid | 1 | Potassium | 0.035 | Carbon black (15) | 15 | 113 | 7.73 | 1.16 | 14.6 | 97.4 | 11.0/15.0 | 23.0/7.5 |
| Production Example 32 | Azo-based iron compound | 0.5 | Aluminum compound of di-t-butylsalicylic acid | 1 | Potassium | 0.035 | Carbon black (16) | 15 | 110 | 7.73 | 1.16 | 14.2 | 94.3 | 11.0/15.0 | 23.0/7.5 |
| Production Example 33 | Azo-based iron compound | 0.5 | Aluminum compound of di-t-butylsalicylic acid | 1 | Potassium | 0.035 | Carbon black (17) | 10 | 112 | 7.73 | 1.16 | 14.5 | 96.6 | 11.0/15.0 | 23.0/7.5 |
| Production Example 34 | Azo-based iron compound | 0.5 | Aluminum compound of di-t-butylsalicylic acid | 1 | Potassium | 0.035 | Carbon black (18) | 10 | 112 | 7.73 | 1.16 | 14.5 | 96.6 | 11.0/15.0 | 23.0/7.5 |
| Production Example 35 | Azo-based iron compound | 0.5 | Aluminum compound of di-t-butylsalicylic acid | 1 | Potassium | 0.035 | Carbon black (19) | 10 | 116 | 7.73 | 1.16 | 14.9 | 100 | 11.0/15.0 | 23.0/7.5 |